US010179343B2

(12) United States Patent
Compton et al.

(10) Patent No.: US 10,179,343 B2
(45) Date of Patent: Jan. 15, 2019

(54) DISPENSING SYSTEM, PACKAGING SYSTEM, PACKAGE, CLOSURE SYSTEM, DISPENSING GUN SYSTEM, METHOD OF MAKING A PACKAGE, AND METHOD OF DISPENSING A PRODUCT

(71) Applicant: Cryovac, Inc., Charlotte, NC (US)

(72) Inventors: Stephen F. Compton, Spartanburg, SC (US); Joe Milton Bowen, Anderson, SC (US); Steven T. Calvert, Simpsonville, SC (US); Andrew B. Carrouth, Woodruff, SC (US); Timothy G. Caudle, Simpsonville, SC (US); David L. Ackerman, Greenville, SC (US); Howard Dean Conner, Mauldin, SC (US); Hubert J. Cook, Simpsonville, SC (US); Csaba Frank Kiss, Simpsonville, SC (US); Andrew W. Moehlenbrock, Simpsonville, SC (US)

(73) Assignee: Cryovac, Inc., Charlotte, NC (US)

( * ) Notice: Subject to any disclaimer, the term of this patent is extended or adjusted under 35 U.S.C. 154(b) by 0 days.

(21) Appl. No.: 15/329,747

(22) PCT Filed: Jul. 22, 2015

(86) PCT No.: PCT/US2015/041539
§ 371 (c)(1),
(2) Date: Jan. 27, 2017

(87) PCT Pub. No.: WO2016/018694
PCT Pub. Date: Feb. 4, 2016

(65) Prior Publication Data
US 2017/0225192 A1 Aug. 10, 2017

Related U.S. Application Data

(60) Provisional application No. 62/170,732, filed on Jun. 4, 2015, provisional application No. 62/150,360, filed
(Continued)

(51) Int. Cl.
*B05C 17/005* (2006.01)
*B05C 17/01* (2006.01)
(Continued)

(52) U.S. Cl.
CPC .. *B05C 17/00583* (2013.01); *B05C 17/00503* (2013.01); *B05C 17/00513* (2013.01);
(Continued)

(58) Field of Classification Search
CPC ..... B05C 17/00583; B05C 17/00503; B05C 17/00513; B05C 17/00576;
(Continued)

(56) References Cited

U.S. PATENT DOCUMENTS 3,363,811 A 1/1968 Geist, Sr.
3,884,396 A * 5/1975 Gordon ..... B05C 17/00516 137/849
(Continued)

FOREIGN PATENT DOCUMENTS

IN 201003193 P1 3/2010
JP 2010163172 A 7/2010
(Continued)

*Primary Examiner* — Frederick C Nicolas
(74) *Attorney, Agent, or Firm* — Jon M. Isaacson

(57) ABSTRACT

The present invention includes a dispensing system for dispensing a packaged product, e.g. a condiment, including a pouch (60) having the product therein cooperates with a dispensing gun (30) to dispense a dose of product. In various aspects the invention includes a packaging system that includes a container (40) and a flexible package (50) with a frangible seal (70), and a flexible pouch (60); a dispensing
(Continued)

assembly (100) for dispensing a product from the package; a dispensing gun system; a method of making a package; and a method of dispensing a product. The packaging system includes a container such as a rigid sleeve, and a flexible pouch positioned within the container interior, and also includes a valve that enables the product to exit the pouch interior and be dispensed. An optional diffuser coordinates with the valve to dispense product from one or more product outlets.

16 Claims, 52 Drawing Sheets

Related U.S. Application Data on Apr. 21, 2015, provisional application No. 62/112,338, filed on Feb. 5, 2015, provisional application No. 62/029,679, filed on Jul. 28, 2014.

(51) Int. Cl.

| | |
|---|---|
| ***B65B 51/02*** | (2006.01) |
| ***B65B 51/30*** | (2006.01) |
| ***B65D 75/52*** | (2006.01) |
| ***B65D 75/58*** | (2006.01) |
| *B65B 51/10* | (2006.01) |
| *B65B 9/20* | (2012.01) |

(52) U.S. Cl.

CPC .. *B05C 17/00553* (2013.01); *B05C 17/00576* (2013.01); *B05C 17/00596* (2013.01); *B05C 17/01* (2013.01); *B65B 51/02* (2013.01); *B65B 51/30* (2013.01); *B65D 75/525* (2013.01); *B65D 75/5811* (2013.01); *B65D 75/5855* (2013.01); *B65D 75/5866* (2013.01); *B65B 9/20* (2013.01); *B65B 51/10* (2013.01)

(58) Field of Classification Search

CPC ... B05C 17/00596; B05C 17/01; B65B 51/02; B65B 51/30; B65B 9/20; B65B 51/10; B65D 75/525; B65D 75/5811; B65D 75/5855; B65D 75/5866

See application file for complete search history.

(56) References Cited

U.S. PATENT DOCUMENTS 4,356,935 A * 11/1982 Kamin ..... A47G 19/183 206/384
4,432,473 A 2/1984 Macewen
4,505,770 A * 3/1985 Larimore ..... A61F 15/001 156/235
4,706,439 A 11/1987 Barton
4,789,082 A * 12/1988 Sampson ..... B65D 47/2018 141/1
4,830,231 A 5/1989 Smith
4,938,390 A * 7/1990 Markva ..... B65D 51/20 156/69
4,963,045 A 10/1990 Willcox
4,969,572 A 11/1990 vanKerkhoven
5,076,440 A 12/1991 Drummond
5,097,993 A 3/1992 Davis
5,176,277 A 1/1993 Schuermann
5,178,300 A 1/1993 Haviv
5,195,645 A 3/1993 Schuermann
5,251,809 A 10/1993 Drummond
5,332,121 A 7/1994 Schmidt et al.
5,375,740 A 12/1994 Umetsu et al.
5,487,506 A 1/1996 Drummond
5,494,215 A 2/1996 Drummond
5,547,451 A 8/1996 Drummond
5,634,572 A 6/1997 Lane, Jr.
5,650,180 A 7/1997 Kumada et al.
5,713,824 A 2/1998 Drummond
5,857,613 A 1/1999 Drummond
5,893,485 A 4/1999 Mcgill
5,950,878 A 9/1999 Wade
5,992,635 A 11/1999 Walters
6,006,501 A 12/1999 Davis
6,079,594 A 6/2000 Brown et al.
6,098,845 A 8/2000 Stern
6,119,884 A 9/2000 Lowry
6,302,321 B1 10/2001 Reese
6,360,909 B1 3/2002 Bridge
6,557,597 B2 5/2003 Reisterer
6,598,764 B1 7/2003 Stern
6,651,848 B1 11/2003 Redmond
6,672,487 B1 1/2004 Lohrman
6,786,363 B1 9/2004 Lohrman
6,796,460 B2 9/2004 Ichikawa
6,846,532 B1 1/2005 Bensur
6,857,561 B2 2/2005 Williams
6,902,335 B2 6/2005 Bergey
6,983,839 B2 * 1/2006 Bertram ..... B29C 44/183 206/219
7,048,154 B2 5/2006 Phillips et al.
7,241,066 B1 7/2007 Rosen
7,322,491 B2 1/2008 Py et al.
7,445,135 B2 11/2008 Miyata
7,669,714 B1 3/2010 Grossman
7,775,399 B2 8/2010 Wood
7,810,677 B2 10/2010 Py
7,845,517 B2 12/2010 Py
7,922,045 B2 4/2011 Ianna
7,959,038 B2 6/2011 de Oliveira et al.
8,146,781 B2 4/2012 Robertson
8,220,668 B2 7/2012 Cadden
8,251,235 B2 8/2012 Py
8,348,104 B2 1/2013 Py
8,356,733 B2 1/2013 Py
8,424,727 B2 4/2013 Herman
8,511,924 B2 8/2013 Bartolucci
8,550,308 B2 10/2013 Py
8,556,123 B2 10/2013 Rodriguez et al.
8,650,736 B2 2/2014 Robertson
8,662,349 B2 3/2014 Genosar
8,915,359 B2 12/2014 DiLiberto
8,950,627 B2 2/2015 Herman
8,960,502 B2 2/2015 Stehli, Jr.
8,985,395 B2 3/2015 Tansey
2003/0132253 A1 7/2003 Pantelleria
2003/0148003 A1 8/2003 Wright
2003/0230604 A1 12/2003 Huffer
2004/0226990 A1 11/2004 Williams
2006/0060612 A1 3/2006 Antal
2006/0093765 A1 * 5/2006 Mueller ..... A61J 1/2093 428/35.2
2006/0127549 A1 6/2006 Murray
2006/0269174 A1 11/2006 Huffer
2007/0012727 A1 1/2007 Licari
2007/0080078 A1 4/2007 Hansen
2008/0023495 A1 1/2008 Takayama
2008/0078781 A1 4/2008 Py
2008/0142545 A1 6/2008 Priolo
2008/0142546 A1 6/2008 Priolo
2008/0173705 A1 7/2008 Girard
2008/0179357 A1 7/2008 Priolo
2008/0256901 A1 10/2008 Custer et al.
2010/0021672 A1 1/2010 Prizzi
2010/0276461 A1 11/2010 Stevens
2011/0121028 A1 5/2011 Rusch
2011/0150371 A1 6/2011 Bosman
2011/1179754 7/2011 Utz
2011/0206301 A1 8/2011 Vollenkemper
2011/0272033 A1 11/2011 Py
2011/0309096 A1 12/2011 Jones
2012/0141642 A1 6/2012 Kubik et al.
2012/0241466 A1 9/2012 Genosar
2012/0292340 A1 11/2012 Nadon

(56) References Cited

U.S. PATENT DOCUMENTS

| | | | | |
|---|---|---|---|---|
| 2013/0037563 | A1* | 2/2013 | Steele | B65D 75/5883 222/1 |
| 2013/0126370 | A1 | 5/2013 | DiLiberto | |
| 2013/0153600 | A1 | 6/2013 | Sanfilippo | |
| 2013/0181005 | A1 | 7/2013 | Stribling et al. | |
| 2013/0190704 | A1 | 7/2013 | Py | |
| 2013/0209003 | A1 | 8/2013 | Hansen | |
| 2013/0233886 | A1 | 9/2013 | Long | |
| 2014/0008397 | A1* | 1/2014 | Edamatsu | B65D 47/103 222/326 |
| 2014/0124533 | A1 | 5/2014 | Melia | |
| 2014/0166682 | A1 | 6/2014 | Huffer | |
| 2014/0263326 | A1 | 9/2014 | Antal, Sr. | |
| 2014/0263356 | A1 | 9/2014 | Antal, Sr. | |
| 2014/0263474 | A1 | 9/2014 | Skillin | |
| 2014/0370162 | A1 | 12/2014 | Vyas | |
| 2015/0076171 | A1 | 3/2015 | Herman | |
| 2015/0375905 | A1 | 12/2015 | Caunant | |

FOREIGN PATENT DOCUMENTS

| | | | |
|---|---|---|---|
| WO | 9117110 | A1 | 11/1991 |
| WO | 2006034823 | A1 | 4/2006 |

* cited by examiner

DISPENSING SYSTEM, PACKAGING SYSTEM, PACKAGE, CLOSURE SYSTEM, DISPENSING GUN SYSTEM, METHOD OF MAKING A PACKAGE, AND METHOD OF DISPENSING A PRODUCT

This application claims the benefit of U.S. Provisional Patent Application No. 62/029,679, filed Jul. 28, 2014, U.S. Provisional Patent Application No. 62/112,338, filed Feb. 5, 2015, U.S. Provisional Patent Application No. 62/150,360, filed Apr. 21, 2015, and U.S. Provisional Patent Application No. 62/170,732, filed Jun. 4, 2015, each of these provisional applications incorporated herein by reference in its entirety.

FIELD OF THE INVENTION

The present invention relates generally to a dispensing system for dispensing a packaged product; a packaging system that includes a container and a flexible package; a package with a frangible seal; a dispensing assembly; a dispensing gun system; a method of making a package; and a method of dispensing a product.

BACKGROUND OF THE INVENTION

In food service, and in particular in the field of high volume fast food service, it is frequently desired that food be supplemented by condiments such as ketchup, mustard, mayonnaise, and the like. It has recently become customary in retail fast service chain food outlets to use a wide variety of devices to dispense a measured quantity of flowable product. For example, a trigger-activated dispensing gun assembly has commonly been used in "back of the restaurant" operations for discharging one or more condiments or sauces. The gun assembly dispenses a quantity of a condiment with each pull of a gun trigger. The gun assembly includes a cylindrical container that houses the condiment and cooperates with a trigger in a gun to dispense the condiment out of a nozzle. However, the gun, cylindrical container, and nozzle are typically disassembled and/or cleaned each time the container is emptied and/or refilled In addition, the gun assembly typically can be messy, as condiment can drip from the nozzle between uses; conventional systems can be labor intensive; and the container can sometimes become damaged and not insert properly into the gun.

SUMMARY OF THE INVENTION

In a first aspect, a dispensing system comprises a) a packaging system comprising a container comprising first and second openings and an interior; a package positioned within the container interior, the package comprising a pouch comprising a first and second panel with a frangible seal positioned between the panels, and a flowable product disposed in the pouch; and a dispensing assembly; and b) a dispensing gun into which the packaging system is disposed.

In a second aspect, a packaging system comprises a container comprising first and second openings and an interior; a package positioned within the container interior, the package comprising a pouch comprising a first and second panel with a frangible seal positioned between the panels, and a flowable product disposed in the pouch; and a dispensing assembly.

In a third aspect, a package comprises a pouch comprising a first and second panel with a frangible seal disposed between the panels, and a flowable product disposed in the pouch, wherein the pouch comprises a) a first transverse seal at a first end of the pouch, b) a second transverse seal at a second end of the pouch, c) a first fold at a first side edge of the pouch, d) a second fold at a second side edge of the pouch, and e) a longitudinal seal extending from the first end of the pouch to the second end of the pouch;

wherein the first transverse seal comprises i) a central seal segment intersected by the longitudinal axis of the pouch;

ii) a second and third seal segment each arranged oblique to the longitudinal axis of the pouch, the second seal segment in communication with the first fold, and the third seal segment in communication with the second fold, and iii) a fourth and fifth seal segment each arranged substantially perpendicular to the longitudinal axis of the pouch, the fourth seal segment in communication at one end thereof with the second seal segment, and at the other end thereof with the central seal segment, and the fifth seal segment in communication at one end thereof with the third seal segment, and at the other end thereof with the central seal segment.

In a fourth aspect, a dispensing assembly comprises a valve, a valve housing that retains the valve, and a connecting portion that functionally cooperates with, and is in engagement with a container.

In a fifth aspect, a dispensing gun system comprises a dispensing gun comprising a piston; a cylindrical container having an interior surface; a cylindrical pusher plate, having an annular outside edge, attached to the piston, and configured, when advanced by the piston into the container, to fit within the container in close proximity to the interior surface of the container; and a package disposed within the container, the package comprising a film having a thickness.

In a sixth aspect, a method of making a package in a vertical form/fill/seal process comprises a) providing a lay-flat web on a first roll, the lay-flat web comprising a first and second surface;

b) providing a film strip on a second roll, a first surface of the film strip comprising a peelable interface, and a second surface of the film strip comprising a permanent sealant;

c) advancing the lay-flat web over a forming device to convert the lay-flat web to a folded web having an interior surface;

d) advancing the film strip to an apparatus that seals the film strip to the lay-flat web, and cuts the film strip into a label, such that when the package is made, the label is disposed between a first and second panel of the package;

e) making a longitudinal seal in the folded web;

f) transversely sealing the folded web to produce a first transverse seal to define a first pouch, wherein the first transverse seal is a bottom transverse seal of the first pouch;

g) putting a product in the first pouch;

h) advancing the folded web, with the first pouch, downward a predetermined distance;

i) transversely sealing the first pouch to produce a top transverse seal in the first pouch, and a bottom transverse seal in a second pouch, the second pouch disposed above the first pouch; and j) transversely cutting the folded web to separate the first pouch from the second pouch to make a package, the package comprising the first and second panels and the label;

wherein at any time before or during the step of making a longitudinal seal in the folded web, the label is sealed to the lay-flat web or the folded web.

In a seventh aspect, a method of dispensing a product comprises a) providing a packaging system comprising a container comprising a first and second end, first and second openings and an interior; a package positioned within the container interior, the package comprising a pouch comprising a first and second panel with a frangible seal positioned between the panels, and a flowable product disposed in the pouch; and a dispensing assembly;

b) providing a dispensing gun configured to house the packaging system;

c) inserting the packaging system into the dispensing gun; and d) initiating linear movement of a pusher plate toward the second end of the container to cause the product to be dispensed through the dispensing assembly.

In an eighth aspect, a method of making a package in a vertical form/fill/seal process comprises a) providing a lay-flat web on a roll, the lay-flat web comprising a label having a first surface comprising a peelable interface, and a second surface comprising a permanent sealant, one of the first and second surfaces adhered to the lay-flat web;

b) advancing the lay-flat web with the label adhered thereto over a forming device to convert the lay-flat web to a folded web having an interior surface;

c) making a longitudinal seal in the folded web;

d) transversely sealing the folded web to produce a first transverse seal to define a first pouch, wherein the first transverse seal is a bottom transverse seal of the first pouch;

e) putting a product in the first pouch;

f) advancing the folded web, with the first pouch, downward a predetermined distance;

g) transversely sealing the first pouch to produce a top transverse seal in the first pouch, and a bottom transverse seal in a second pouch, the second pouch disposed above the first pouch; and h) transversely cutting the folded web to separate the first pouch from the second pouch to make a package, the package comprising a first and second panel with the label disposed between and sealed to the panels to provide a frangible seal.

In a ninth aspect, a method of making a package in a vertical form/fill/seal process comprises a) providing a lay-flat web;

b) advancing the lay-flat web over a forming device to convert the lay-flat web to a folded web having an interior surface;

c) making a longitudinal seal in the folded web;

d) transversely sealing the folded web to produce a first transverse seal to define a first pouch, wherein the first transverse seal is a bottom transverse seal of the first pouch;

e) putting a product in the first pouch;

f) advancing the folded web, with the first pouch, downward a predetermined distance;

g) transversely sealing the first pouch to produce a top transverse seal in the first pouch, and a bottom transverse seal in a second pouch, the second pouch disposed above the first pouch; and h) transversely cutting the folded web to separate the first pouch from the second pouch to make a package having an interior surface;

wherein at any time before or during the step of making a longitudinal seal in the folded web, the lay-flat web or the folded web is selectively treated to produce an area, on the interior surface of the package, that comprises a frangible seal.

In a tenth aspect, a method of making a package in a vertical form/fill/seal process comprises a) providing a lay-flat web on a roll, wherein the lay-flat web has been selectively treated to produce an area, on the interior surface of the package, that comprises a frangible seal;

b) advancing the lay-flat web over a forming device to convert the lay-flat web to a folded web having an interior surface;

c) making a longitudinal seal in the folded web;

d) transversely sealing the folded web to produce a first transverse seal to define a first pouch, wherein the first transverse seal is a bottom transverse seal of the first pouch;

e) putting a product in the first pouch;

f) advancing the folded web, with the first pouch, downward a predetermined distance;

g) transversely sealing the first pouch to produce a top transverse seal in the first pouch, and a bottom transverse seal in a second pouch, the second pouch disposed above the first pouch; and h) transversely cutting the folded web to separate the first pouch from the second pouch to make the package.

In an eleventh aspect, a method of making a package in a vertical form/fill/seal process comprises a) providing a lay-flat web comprising an easy-open sealant;

b) advancing the lay-flat web over a forming device to convert the lay-flat web to a folded web having an interior surface comprising the easy-open sealant;

c) making a longitudinal seal in the folded web;

d) transversely sealing the folded web to produce a first transverse seal to define a first pouch, wherein the first transverse seal is a bottom transverse seal of the first pouch;

e) putting a product in the first pouch;

f) advancing the folded web, with the first pouch, downward a predetermined distance;

g) transversely sealing the first pouch to produce a top transverse seal in the first pouch, and a bottom transverse seal in a second pouch, the second pouch disposed above the first pouch; and h) transversely cutting the folded web to separate the first pouch from the second pouch to make a package comprising a frangible seal.

In a twelfth aspect, a dispensing assembly comprises a diffuser comprising an outlet, a valve in juxtaposed relation to the outlet, a housing, and a connecting portion that functionally cooperates with, and is in engagement with a container.

In a thirteenth aspect, a method of making a package in a horizontal form/fill/seal process comprises:

providing a lay-flat web on a first roll, the lay-flat web having a first and second longitudinal edge;

providing a film strip on a second roll, a first surface of the film strip comprising a peelable interface, and a second surface of the film strip comprising a permanent sealant;

advancing the lay-flat web to a forming device to convert the lay-flat web to a folded web having an interior surface;

advancing the film strip to an apparatus that seals the film strip to the lay-flat web, and cuts the film strip into a label, such that when the package is made, the label is disposed between a first and second panel of the package;

making side seals in the folded web to produce an open pouch comprising the first and second panels and the label;

putting a product in the open pouch; and sealing the first panel to the second panel to close the pouch;

wherein at any time before putting a product in the open pouch, the film strip is attached to the lay-flat web or the folded web:

at any time before or during the step of making side seals in the folded web, the label is sealed to the lay-flat web or the folded web; and the web is cut at the side seals during or after the step of making side seals in the folded web to make a package comprising a frangible seal.

In a fourteenth aspect, a method of making a package in a horizontal form/fill/seal process comprises:

providing a lay-flat web on a roll, the lay-flat web comprising a label having a first surface comprising a peelable interface, and a second surface comprising a permanent sealant, one of the first and second surfaces attached to the lay-flat web;

advancing the lay-flat web with the label adhered thereto to a forming device to convert the lay-flat web to a folded web having an interior surface;

making side seals in the folded web to produce an open pouch comprising the first and second panels and the label;

putting a product in the open pouch; and sealing the first panel to the second panel to close the pouch;

wherein the web is cut at the side seals during or after the step of making side seals in the folded web to make a package comprising a frangible seal.

In a fifteenth aspect, a method of making a package in a horizontal form/fill/seal process comprises:

providing a lay-flat web;

advancing the lay-flat web to a forming device to convert the lay-flat web to a folded web having an interior surface;

making side seals in the folded web to produce an open pouch comprising a first and second panel;

putting a product in the open pouch; and sealing the first panel to the second panel to close the pouch; wherein the web is cut at the side seals during or after the step of making side seals in the folded web, and at any time before or during the step of making side seals in the folded web, the lay-flat web or the folded web is selectively treated to produce an area, on the interior surface of the package, that comprises a frangible seal.

In a sixteenth aspect, a method of making a package in a horizontal form/fill/seal process comprises:

providing a lay-flat web on a roll, wherein the lay-flat web has been selectively treated to produce an area, on the interior surface of the package, that comprises a frangible seal;

advancing the lay-flat web to a forming device to convert the lay-flat web to a folded web having an interior surface;

making side seals in the folded web to produce an open pouch comprising a first and second panel;

putting a product in the open pouch; and sealing the first panel to the second panel to close the pouch;

wherein the web is cut at the side seals during or after the step of making side seals in the folded web.

In a seventeenth aspect, a method of making a package in a horizontal form/fill/seal process comprises:

providing a lay-flat web comprising an easy-open sealant;

advancing the lay-flat web to a forming device to convert the lay-flat web to a folded web having an interior surface;

making side seals in the folded web to produce an open pouch comprising a first and second panel;

putting a product in the open pouch; and sealing the first panel to the second panel to close the pouch;

wherein the web is cut at the side seals during or after the step of making side seals in the folded web.

In an eighteenth aspect, a segmented pusher plate comprises:

a) an outer plate segment;

b) an inner plate segment; and c) a biasing member;

wherein the outer and inner plate segments are arranged in a coaxial configuration, and are concentrically arranged.

In a nineteenth aspect, a cylindrical composite pusher plate comprises:

a) a rigid plate component; and b) an elastomeric plate component;

wherein the elastomeric plate component has a concave configuration on one surface thereof.

In a twentieth aspect, a package comprises a pouch comprising a first and second panel with a frangible seal disposed between the panels, and a flowable product disposed in the pouch, wherein the pouch comprises a) a first transverse seal at a first end of the pouch, b) a second transverse seal at a second end of the pouch, c) a first fold at a first side edge of the pouch, d) a second fold at a second side edge of the pouch, and e) a longitudinal seal extending from the first end of the pouch to the second end of the pouch;

wherein the first transverse seal comprises i) a central seal segment intersected by the longitudinal axis of the pouch; and ii) a second and third seal segment each arranged substantially perpendicular to the longitudinal axis of the pouch, the second seal segment in communication at one end thereof with the first fold, and at the other end thereof with the central seal segment, and the third seal segment in communication at one end thereof with the second fold, and at the other end thereof with the central seal segment.

In a twenty first aspect, a pusher plate system comprises:

a) a rigid plate component; and b) an elastomeric plate component;

wherein the elastomeric plate component is disposed adjacent and in contacting relationship with the rigid plate.

BRIEF DESCRIPTION OF THE DRAWINGS

The present invention is illustrated in various embodiments by reference to the following drawing figures wherein.

DETAILED DESCRIPTION OF THE INVENTION

I. Definitions

Figure 1A:
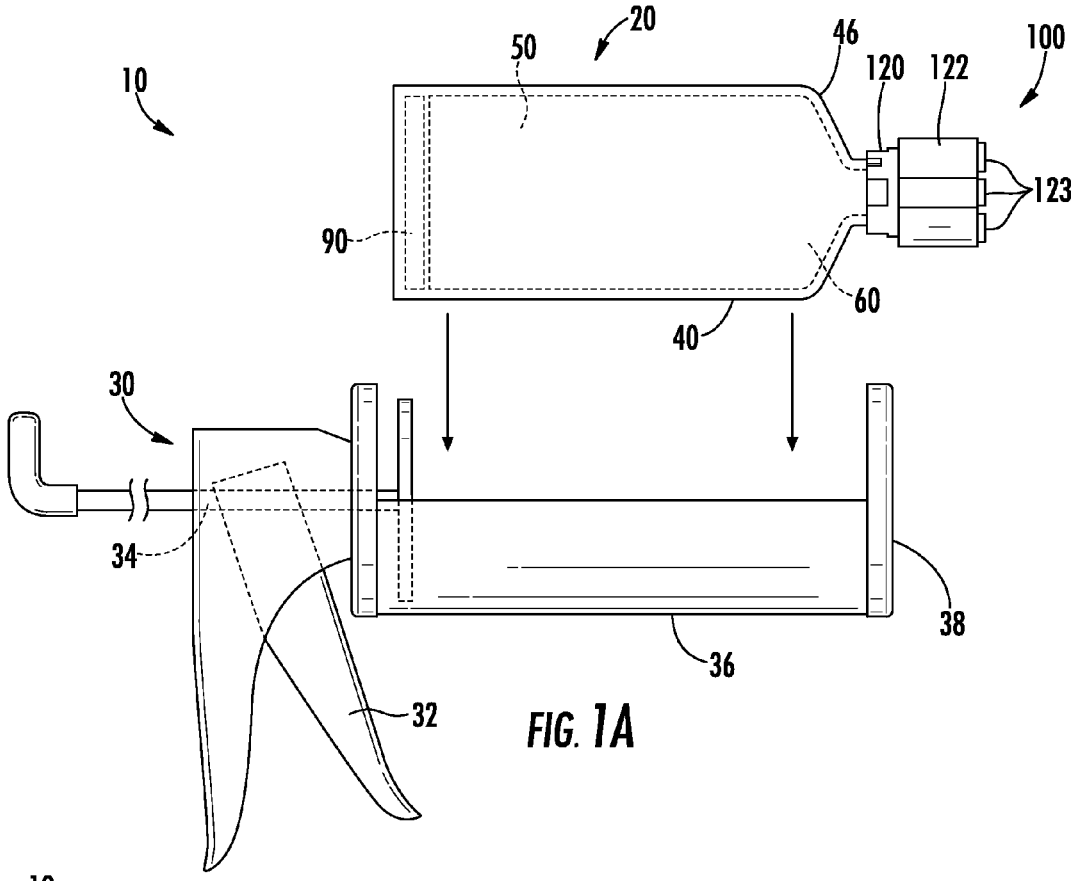
FIGS. 1*a* and 1*b* are side elevational views of a dispensing system, showing loading of the packaging system into a dispensing gun.

"A", "an", and "the" as used herein do not limit to the singular unless expressly so stated. Thus, for example, reference to "a package" can include a plurality of such packages, and so forth.

"Abuse layer" and the like herein refers to an outer film layer and/or an inner film layer, so long as the film layer serves to resist abrasion, puncture, and other potential causes of reduction of package integrity, as well as potential causes of reduction of package appearance quality. Abuse layers can comprise any polymer, so long as the polymer contributes to achieving an integrity goal and/or an appearance goal. In some embodiments, the abuse layer can comprise polyamide, ethylene/propylene copolymer, and/or combinations thereof.

"Antifog" and the like herein refers to an agent that can be incorporated into an outermost film layer, be coated onto an outermost film layer, or migrate from an internal layer to an outermost film layer, with the effect of lowering the seal strength of a seal subsequently made. Suitable antifog agents may fall into classes such as esters of aliphatic alcohols, esters of polyglycol, polyethers, polyhydric alcohols, esters of polyhydric aliphatic alcohols, polyethoxylated aromatic alcohols, nonionic ethoxylates, and hydrophilic fatty acid esters. Useful antifog agents include polyoxyethylene, sorbitan monostearate, polyoxyethylene sorbitan monolaurate, polyoxyethylene monopalmitate, polyoxyethylene sorbitan tristearate, polyoxyethylene sorbitan trioleate, poly(oxypropylene), polyethoxylated fatty alcohols, polyoxyethylated 4-nonylphenol, polyhydric alcohol, propylene diol, propylene triol, and ethylene diol, monoglyceride esters of vegetable oil or animal fat, mono- and/or diglycerides such as glycerol mono- and dioleate, glyceryl stearate, monophenyl polyethoxylate, and sorbitan monolaurate. The antifog agent is incorporated in an amount effective to suitably reduce the seal strength of the film.

"Barrier", "barrier layer", and the like herein refers to the ability of a film or film layer to serve as a barrier to one or more gases. For example, oxygen barrier layers can comprise, but are not limited to, ethylene/vinyl alcohol copolymer, polyvinyl chloride, polyvinylidene chloride, polyamide, polyester, polyacrylonitrile, and the like, as known to those of ordinary skill in the art. In some embodiments, the barrier film or layer has an oxygen transmission rate of no more than 100 cc $O_2/m^2$·day·atm; less than 50 cc $O_2/m^2$·day·atm; less than 25 cc $O_2/m^2$·day·atm; less than 10 cc $O_2/m^2$·day·atm; less than 5 cc $O_2/m^2$·day·atm; or less than 1 cc $O_2/m^2$·day·atm (tested at 1 mil thick and at 25° C. in accordance with ASTM D3985, herein incorporated by reference in its entirety).

"Bulk layer" and the like herein refer to any layer of a film that is present for the purpose of increasing the abuse-resistance, toughness, and/or modulus of a film. In some embodiments, bulk layers can comprise polyolefin, ethylene/alpha-olefin copolymer, ethylene/alpha-olefin copolymer plastomer, low density polyethylene, linear low density polyethylene, and combinations thereof.

"Condiment" and the like herein refers to (but is not limited to) ketchup, mustard, guacamole, sour cream, salsa, nacho cheese, taco sauce, barbecue sauce, tartar sauce, mayonnaise, jams, jellies, spices, and the like. In some embodiments, the term "condiment" can include any and all additives that a user can choose to add to any food item for any purpose, e.g. for organoleptic, processing, or preservative purposes.

"Container" and the like herein refers to tubes, bottles, jars, tubs, cylinders, vessels, flasks, chambers, and the like, whether pliable or rigid.

"Exterior" refers to the outside portion of an article.

"Filled" and the like herein, with respect to a pouch, refer to a pouch that has been filled with a product in a manner consistent with a commercial filling operation. Thus, a pouch may or may not be 100% filled.

"Film" and the like herein refers to a laminate, sheet, web, coating, or the like, that can be used to package a product. The film can be a rigid, semi-rigid, or flexible product. In some embodiments, the film is produced as a fully coextruded film, i.e., all layers of the film emerging from a single die at the same time. In some embodiments, the film is made using a flat cast film production process or a round cast film production process. Alternatively, the film can be made using a blown film process, double bubble process, triple bubble process, or adhesive or extrusion coating lamination.

"Flexible" and the like herein refer to materials that are pliable and easily deform in the presence of external forces.

"Frangible seal" and the like herein refer to a seal that is sufficiently durable to allow normal handling and storage, but ruptures or substantially ruptures under applied pressure. In some embodiments, suitable frangible seals will have a peel strength of from 0.5 to less than 5 pounds/inch as measured by ASTM F88.

"Heat seal" and the like herein refers to any seal of a first region of a film surface to a second region of a film surface, wherein the seal is formed by heating the regions to at least their respective seal initiation temperatures. Heat-sealing is the process of joining two or more thermoplastic films or sheets by heating areas in contact with each other to the temperature at which fusion occurs, usually aided by pressure. In some embodiments, heat-sealing can be inclusive of thermal sealing, melt-bead sealing, impulse sealing, dielectric sealing, and/or ultrasonic sealing. The heating can be performed by any one or more of a wide variety of means, such as (but not limited to) a heated bar, hot wire, hot air, infrared radiation, ultrasonic sealing, and the like.

"Interior" and the like herein refers to the inside portion of an article.

"Label" and the like herein refer to a portion of sheet or film material that can be used to construct a frangible seal in accordance with some embodiments of the present invention.

"Multilayer film" and the like herein refers to a thermoplastic film having one or more layers formed from polymeric or other materials that are bonded together by any conventional or suitable method, including one or more of the following methods: coextrusion, extrusion coating, lamination, vapor deposition coating, solvent coating, emulsion coating, or suspension coating.

"Outlet" and the like herein refer to an aperture, orifice, opening, chute, passage, or similar channel through which a product can exit the disclosed packaging system.

"Panel" and the like herein refer to a wall or major section of a pouch. A first and second panel can be derived from two pieces of film joined together by any suitable means, such as heat sealing. Alternatively, a single web of film can be folded into a tubular configuration, and longitudinally and transversely sealed to create a pouch exhibiting a first and second panel.

"Peelable sealant" and the like herein refers to any suitable polymer or polymer blend that forms at least a part of a film layer or is applied to a film layer, wherein the peelable sealant exhibits a seal strength that is less than the seal strength of the permanent sealant as described herein. In some embodiments, the peelable sealant can comprise a food grade cold seal adhesive.

"Permanent sealant" and the like herein refers to any suitable polymer or polymer blend that forms at least a part of a film layer or is applied to a film layer, wherein the permanent layer exhibits a seal strength that is greater than the seal strength of the peelable sealant as described herein.

"Pouch" and the like herein refers to any of a wide variety of containers known in the art, including (but not limited to) bags, packets, packages, and the like.

"Product" and the like herein refer to any of a wide variety of food or non-food items that can be packaged in the disclosed systems. In some embodiments, the product is a condiment, and/or a flowable product.

"Seal" and the like herein refer to any seal of a first region of a film surface to a second region of a film or substrate surface. In some embodiments, the seal can be formed by heating the regions to at least their respective seal initiation temperatures using a heated bar, hot air, infrared radiation, ultrasonic sealing, and the like. In some embodiments, the seal can be formed by an adhesive. Alternatively or in addition, in some embodiments the seal can be formed using a UV or e-beam curable adhesive seal.

"Seal layer" and the like herein refers to an outermost film layer or layers involved in heat sealing of the film to itself, to another film layer of the same or another film, and/or another article that is not a film. "Outermost" layer herein includes a layer found on the outside of a film, i.e. a layer not bounded on both major surfaces by another film layer. Layers involved in heat sealing can include a second layer, adjacent an outermost layer, that assists in or substantially affects or influences the overall strength of the heat seal. Heat sealing can be performed by any one or more of a wide variety of manners known to those of ordinary skill in art, including using heat seal technique (e.g., melt-bead sealing, thermal sealing, impulse sealing, ultrasonic sealing, hot air, hot wire, infrared radiation, and the like), adhesive sealing, UV-curable adhesive sealing, and the like.

"Tie layer" and the like herein refers to an internal film layer having the primary purpose of adhering two layers to one another. In some embodiments, a tie layer can comprise any nonpolar polymer having a polar group grafted thereon, such that the polymer is capable of covalent bonding to polar polymers such as polyamide and ethylene/vinyl alcohol copolymer. In some embodiments, the tie layers can comprise modified polyolefin, modified ethylene/vinyl acetate copolymer, and/or homogeneous ethylene/alpha-olefin copolymer.

"Transparent" and the like herein refers to the ability of a material to transmit incident light with negligible scattering and little absorption, enabling objects to be seen clearly through the material under typical unaided viewing conditions, i.e. the expected use conditions of the material, as measured in accordance with ASTM D1746.

"Valve" and the like herein refers to any device by which the flow of material can be started, stopped, rerouted or regulated by a movable part that opens, closes, or partially obstructs a passageway through which the material flows. In some embodiments, a suitable valve can comprise any of an umbrella valve, duckbill valve, reed valve, ball valve, flapper valve, poppet valve, Gott valve, check valve, or any suitable combination thereof.

All compositional percentages used herein are presented on a "by weight" basis, unless designated otherwise.

The definitions and disclosure of the present application control over any inconsistent definition or disclosure present in an incorporated reference.

II. Dispensing System 10

The present invention provides a dispensing system and method for dispensing a product onto one or more areas (one or more spots of mustard dispensed on a hamburger bun, for example). In one embodiment, the dispensing system includes a packaging system 20 that cooperates with a dispensing device (such as a dispensing gun 30) to dispense a dose of product.

As illustrated in the Figures, packaging system 20 comprises outer container 40 with first and second ends 42, 44, and package 50 positioned within the container interior 43. Package 50 includes a pouch 60 that houses product 80, which in some embodiments can be a condiment. Container first end 42 accommodates dispensing assembly 100, including a valve housing 120 comprising valve 112 that enables product 80 to exit the package interior, as set forth in more detail herein below. Diffuser 126 coordinates with valve housing 120 to dispense product 80 from one or more product outlets 123. Pusher plate 90 is in one embodiment configured on the interior 43 of container second end 44 and cooperates with a dispensing gun to dispense product 80.

III. Packaging System 20

III.A. Generally

As illustrated in the Figures, packaging system 20 comprises container 40, package 50, and dispensing assembly 100. System 20 optionally includes diffuser 126, and pusher plate 90. In some embodiments, pusher plate 90 does not form part of system 20 and is instead included as part of dispensing gun 30.

III.B. Container 40

Several of the figures, including FIGS. 2, 3, 22 to 24, 41 and 42, illustrate container 40. Container 40 includes tubular sidewall 47 with open second end 44 sized to house package 50 and accommodate pusher plate 90 within the interior 43 of the container. The container further includes mouth 41 positioned at first end 42, through which product 80 can be dispensed via valve housing 120 and diffuser 126. The container sidewall tapers (with a reduced diameter) into container neck 45 at first end 42. In some embodiments, neck 45 includes a fastening device 49, such as a screw thread, extending around the neck exterior for engaging dispensing assembly 100, as will be described below. Alternative methods of attaching a dispensing assembly include a location fit, press fit, twist lock, tab, slot, and/or snap fit arrangements.

Container 40 can be constructed from any of a variety of rigid or semi-rigid materials known in the art, e.g. plastic, metal, wood, cardboard, chipboard, stiff paper, foamed plastics, recycled materials, compostable materials, heavy foil, and/or combinations thereof; such as foamed or solid polystyrene, crystallized polystyrene (CPS), polyethylene terephthalate (PET), polypropylene, polyethylene, or combinations thereof. Such materials are typically suitable for forming, yet stiff or rigid enough to resist buckling, folding, crumbling or collapsing due to compression, handling, and shipping.

In some embodiments, container 40 can be constructed from a material that provides a barrier to the passage of oxygen, e.g., vinylidene chloride copolymer, nylon, polyethylene terephthalate, ethylene/vinyl alcohol copolymer, and the like. In some embodiments, the material(s) from which the container is constructed can comprise an oxygen scavenging material, e.g. Amisorb®. Alternatively or in addition, container 40 can comprise a substantially gas-impermeable sealant film laminated or otherwise bonded to the inner or outer surface thereof. In some embodiments, the material from which the container is made exhibits an oxygen transmission rate of no more than about 50 $cc/m^2/24$ hr. at 25° C., 0% RH, 1 atm (in accordance with ASTM D 3985), such as no more than 10 $cc/m^2/24$ hr. at 25° C., 0% RH, 1 atm.

Container 40 can be constructed using any conventional process known in the art, such as rotational molding, blow molding, reheat stretch blow molding, injection molding, casting, roll forming, stamping, and the like.

Container 40 is not limited to the cylindrical shape illustrated in the figures, and can have a rectangular, triangular, hexagonal, octagonal or square or other cross-sectional shape, including a combination of any of these shapes. The container be formed as any suitable receptacle with an interior 43 for housing a pouch, e.g. a carton, can, jar, or bottle, and can have different dimensions and volume capacities.

Figure 44:
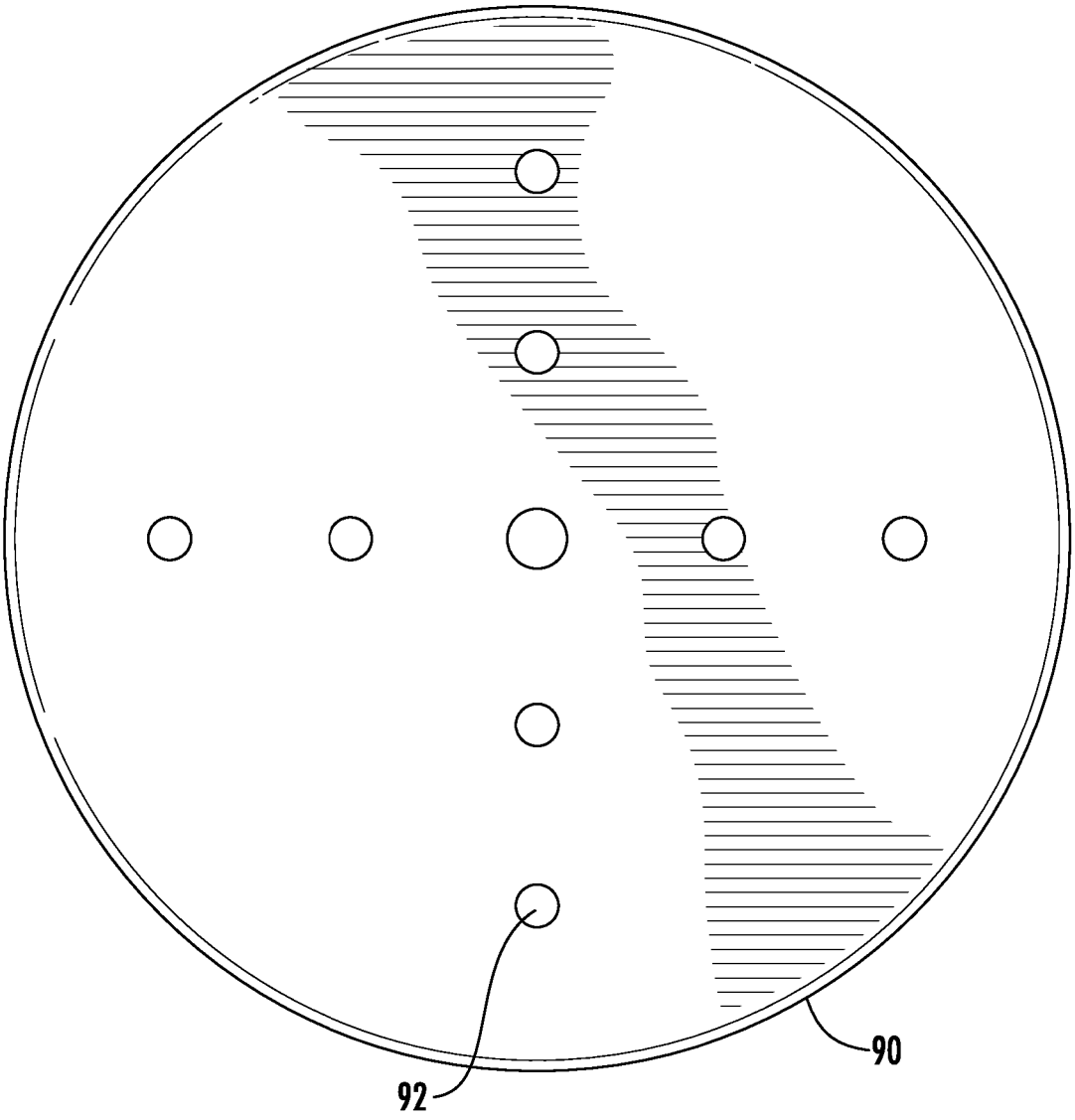
FIG. 44 is a plan view of a pusher plate.

Optionally, container 10 includes one or more vent holes in the upper part of the container, e.g. in the shoulder 46 of the container. Such vent holes can expedite manual removal of a spent package from the container interior after product 80 has been dispensed. The vent holes are in one embodiment small, round holes of the type shown as 92 in FIG. 44.

III.C. Package 50

Package 50 includes sealed pouch 60, with product 80 disposed therein. Pouch 60 can be any of a variety of pouches known in the art, including e.g. a stand-up pouch, a gusseted stand-up pouch, a lay-flat pouch, a pouch comprising at least one longitudinal seal, and the like. In some embodiments, pouch 60 can comprise a pair of films joined together along a pair of opposing sides and a bottom bridging the sides. Alternatively, in some embodiments, pouch 60 can be formed from a single film that has been center folded at one edge, or a pouch that includes one or more lap seals, fin seals, and/or edge seals. In another embodiment, pouch 60 can comprise a continuous tubular material with no longitudinal seal, but with transverse seals as disclosed herein. The description of the pouch herein as having "first and second panels" should be understood to describe a pouch that when filled with product and laid on a surface, will display a major first surface, wall or panel, and, on the opposite side of the pouch, a second major surface, wall, or panel.

Figure 5:
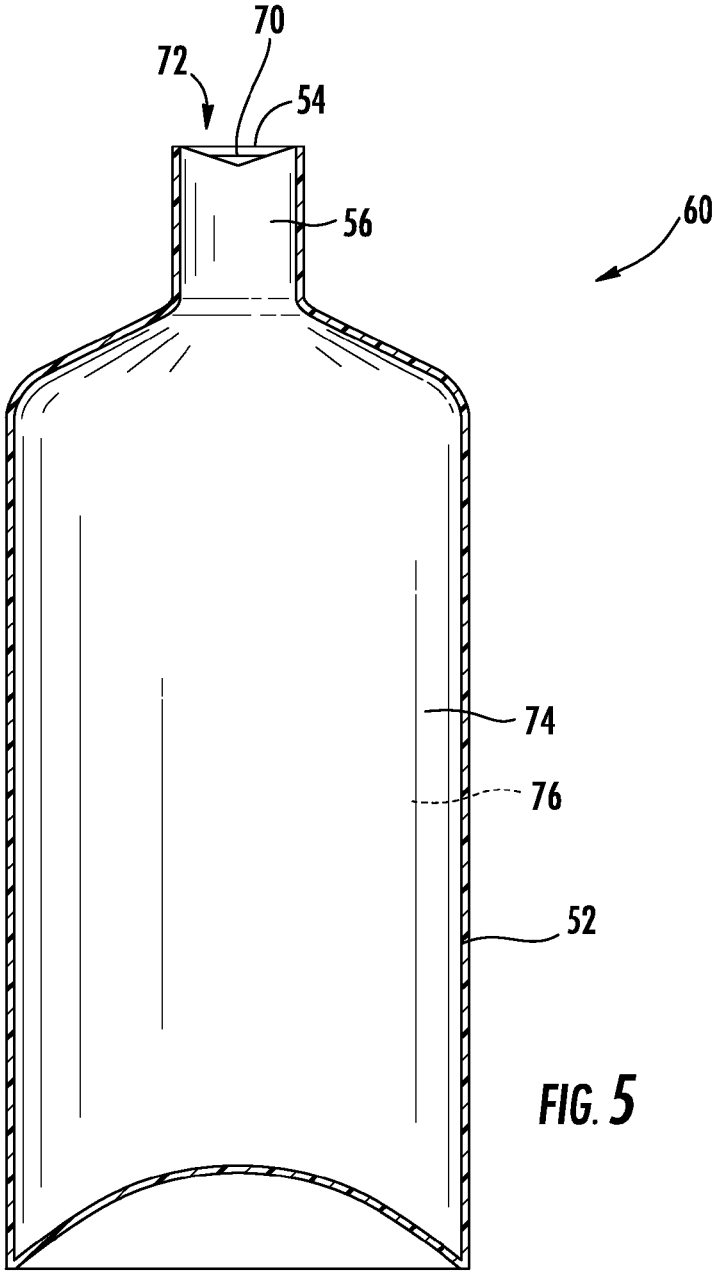
FIG. 5 is a lay flat view of a pouch.

As illustrated in FIG. 5, pouch 60 comprises first and second panels 74, 76 that are sealed together about the pouch perimeter with perimeter seal 52. Perimeter seal 52 can be formed using any suitable method, known and used in the art, including e.g. the use of heat, pressure, adhesive, and/or mechanical closure. As shown, perimeter seal 52 does not span top edge 54 of pouch spout 72. Rather, in some embodiments, pouch spout 72 includes frangible seal 70 positioned between the first and second panels 74 using a heat seal, ultrasonic seal, static seal, RF seal, adhesive, or a combination thereof. Frangible seals are known to those of ordinary skill in the packaging art. See, for example, U.S. Pat. No. 6,983,839 and U.S. Patent Application Publication No. 2006/0093765, the entire disclosures of which are hereby incorporated by reference.

Alternatively, as shown in FIGS. 26 to 29, pouch 60 comprises first and second panels 74, 76, a first transverse seal 62, a second transverse seal 64, a first side fold 66, a second side fold 68, a longitudinal seal 71, a first pouch end 77, and a second pouch end 78.

Figure 6:
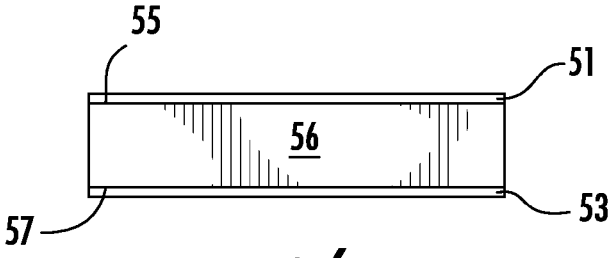
FIG. 6 is a cross-sectional view of a label.
Figure 7:
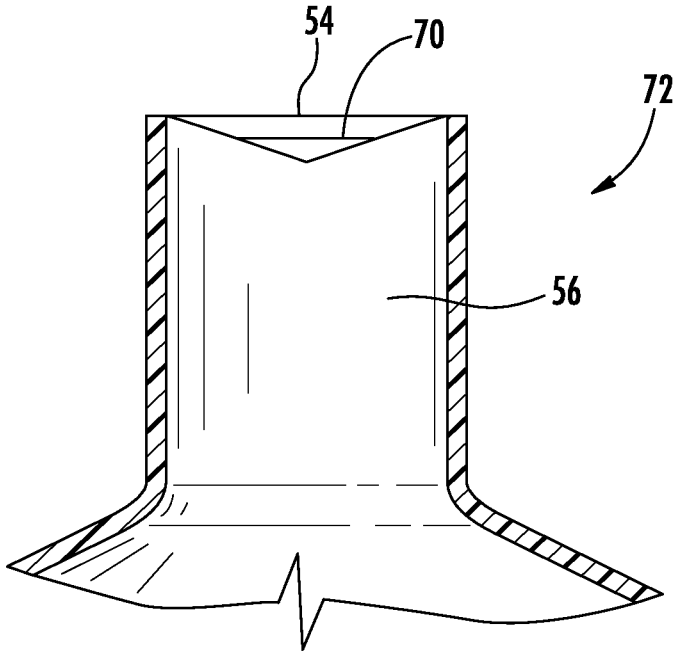
FIGS. 7 and 8 are enlarged fragmentary views of a pouch comprising a label.
Figure 8:
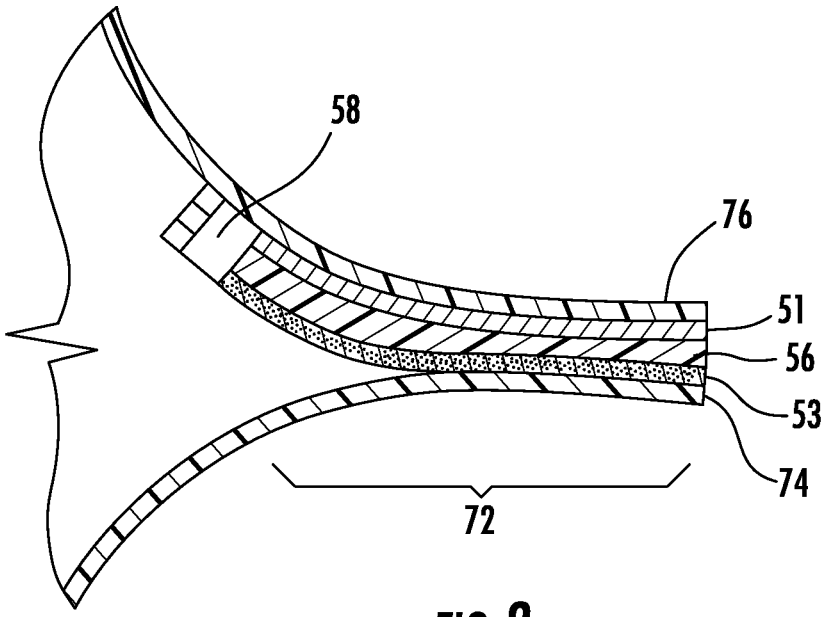

In some embodiments, frangible seal 70 can comprise label 56. Particularly, label 56 includes permanent sealant 51 positioned on first label face 55 and peelable sealant 53 positioned on second label face 57, as shown in FIG. 6. The sealants can comprise part of a film layer, or can be coated, extrusion coated, or applied to the surface of a film using conventional labeling systems known in the art. As depicted in FIGS. 7 and 8, pouch spout 72 can comprise label 56 with permanent sealant 51 positioned on one label face, adjacent to second panel 76, and peelable sealant 53 positioned on the opposing label face, adjacent to first panel 74. In some embodiments, the label is maintained in proper position using one or more spot seals 58. Label 56 can be positioned in any suitable location either fully or partially within pouch spout 72, e.g. adjacent to top edge 54.

Permanent sealant 51 can comprise any suitable polymer or polymer blend that makes up at least a portion of a film layer or is applied to a film layer (i.e., a coating). Suitable permanent sealants, for example, can be selected from the group comprising: Ziegler-Natta catalyzed linear low density polyethylenes (such as such as DOWLEX® 2045.03, DOWLEX® 2045.04, and DOWLEX® 2247G), metallocene-catalyzed LLDPE (such as EXCEED® 4518PA and EXCEED® 3518CB), polyolefin "plastomer" grade polyethylenes with high comonomer (such as Dow AFFINITY® PL 1888G, Dow AFFINITY® PL 1850G, Dow AFFINITY® PL 1850, EXACT® 4151, and EXACT® 3024), propylene-ethylene copolymer, LDPE (such as ESCORENE® LD-200.48), ionomer resin, such as SURLYN® 1650, ethylene/vinyl acetate copolymers, ethylene/methyl (meth)acrylate copolymers, and ethylene/butyl acrylate copolymers. Materials used as permanent sealant 51 typically melt with the application of heat and/or pressure to form permanent (non-frangible) seals. Typical seal strengths for the permanent sealant can range from 5 pounds/inch to 15 pounds/inch in accordance with ASTM F88-05. In some embodiments, the seal strength of the permanent sealant can be greater than the seal strength of the peelable sealant by a difference of at least 0.5, 1, 2, 3, 5, 10, 15, 20, or 25 pounds per inch.

Peelable sealant 53 can comprise any suitable sealant known in the art, e.g. DuPont APPEEL® resins such as those based on EVA, modified EVA, ethylene/acrylate copolymer, or modified ethylene/acrylate copolymer; blends of immiscible polymers, such as polyethylene and polybutylene; polyethylene, such as low density polyethylene and/or EVA copolymers blended with polypropylene, polyethylene blended with polybutene-1, random propylene/ethylene copolymer blended with polybutene-1, EVA or LDPE blended with polypropylene, LDPE blended with EVA and polypropylene, to introduce a molecular incompatibility into the sealant layer. It is believed that the molecular incompatibility creates discontinuities that reduce the force necessary to rupture the seal. Alternatively or in addition, the sealant can be printed in a pattern on a surface of the film. Typical seal strengths of peelable sealant 53 can in some embodiments be less than about 5 pounds/inch in accordance with ASTM F88-05. A peelable sealant will typically allow the user to open the seal with relatively little effort (e.g. by advancing a pusher plate 90 within the container interior). In some cases, peelable sealant 53 can peel away from the surface to which it is adhered. Alternatively, a rupture of the sealant (cohesive failure) or breakage of the sealant and delamination along an adjacent layer interface can occur. See, for example, U.S. Pat. Nos. 4,875,587; 5,023,121; 5,024,044; 6,395,321; 6,476,137; 7,055,683; and 2003/0152669, the entire disclosures of which are hereby incorporated by reference herein.

Figure 9:
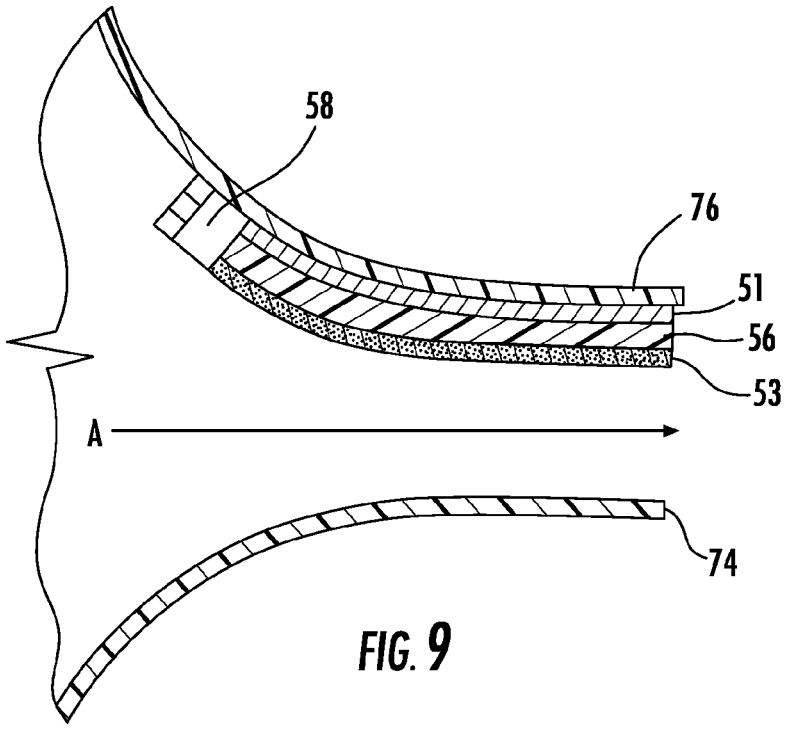
FIG. 9 is an enlarged fragmentary view of a method of dispensing from a package.

After label 56 has been positioned fully or partially within spout 72, frangible seal 70 can be constructed using the application of heat and/or pressure (i.e., heat sealing). Specifically, the application of heat/pressure activates permanent sealant 51 into an adhesive state. As a result, label 56 becomes permanently sealed to the adjoining pouch panel (second panel 76 in FIG. 8). The application of heat and/or pressure further activates peelable sealant 53, resulting in a frangible seal 70 positioned between label 56 and the adjoining pouch panel (first panel 74 in FIG. 8). As a result, label 56 becomes peelably sealed to first panel 74. The frangible seal can be constructed in any of a variety of patterns, such as straight line, chevron, half moon, and the like, using e.g., targeted application of heat/pressure. in use, after the frangible seal has been constructed, an increase in pouch pressure (such as from the advancement of pusher plate 90) forces peelable sealant 53 to separate from the adjacent pouch panel. As a result, product 80 is able to flow through the pouch spout 72, as depicted by Arrow "A" in FIG. 9.

Figure 10:
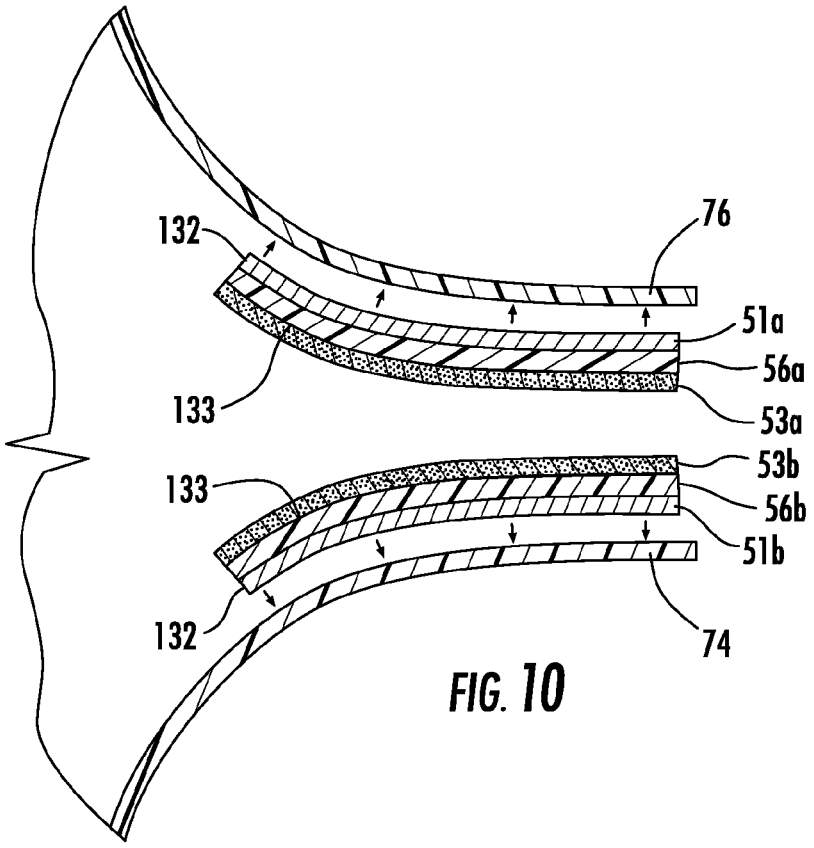
FIGS. 10 and 11 are enlarged fragmentary views of a package comprising more than one label.
Figure 11:
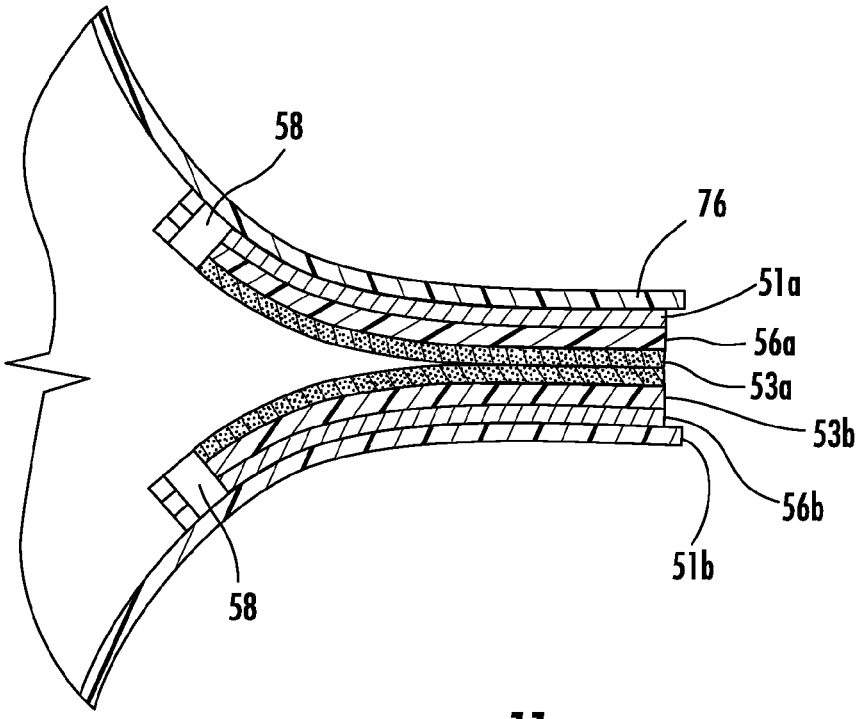
Figure 12:
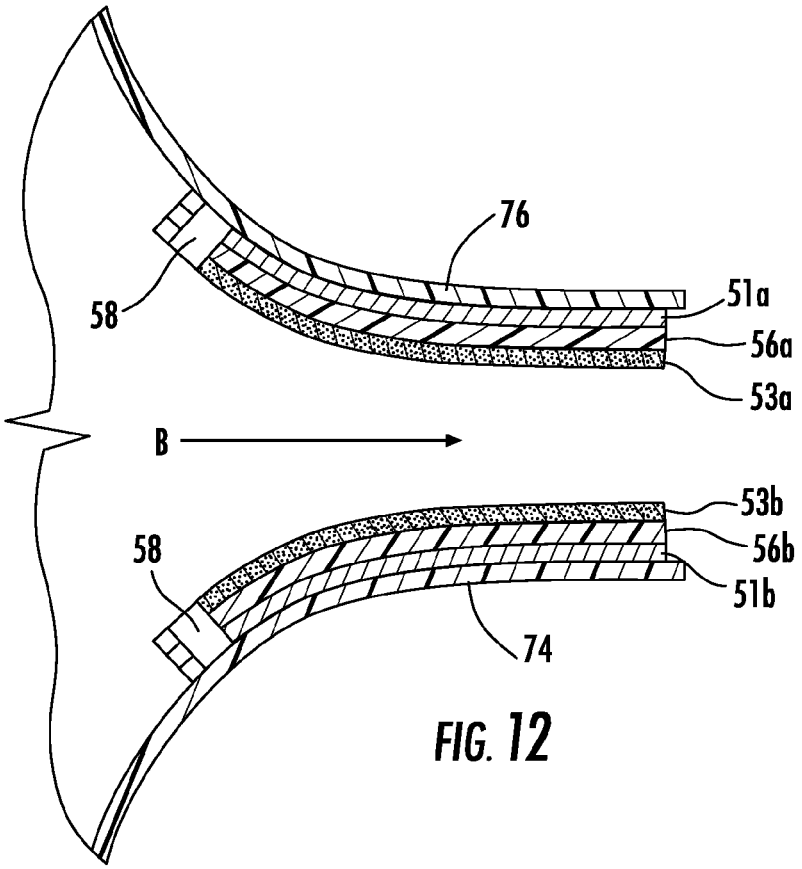
FIG. 12 is an enlarged fragmentary view of another method of dispensing from a disclosed package.

Alternatively, frangible seal 70 can be constructed using first and second labels as shown in FIGS. 10 and 11. The two labels include a permanent sealant 51*a*, 51*b* respectively positioned on outer label faces 132, adjacent to the pouch panels 76, 74. Either or both of the two labels further comprise peelable sealant 53*a*, 53*b* on their respective inner faces 133 (i.e., facing each other). After the labels have been positioned fully or partially within spout 72, frangible seal 70 can be constructed by heat sealing the labels to the pouch films as described earlier, creating permanent seals between the labels and front and rear panels. An alternative to the use of heat sealing to create a permanent seal, is the use of a permanent adhesive. Heat sealing creates a frangible seal 70 between the inner faces of the two labels, as a result of peelable sealant 53*a*, 53*b*. In some embodiments, the labels can include spot seals 58 to maintain proper positioning in the area outside of the frangible seal. In use, increased pressure within the pouch will rupture frangible seal 70, allowing product to flow between the labels to exit the pouch, as shown by Arrow B in FIG. 12.

The disclosed labels and pouch 60 can be constructed from any of a wide variety of polymeric materials known in the art, including in some embodiments food safe materials and/or a base film having a food safe material coated thereon. In some embodiments, the label(s) can be a continuous strip of material that spans the entire pouch length in the machine direction, e.g. parallel to the pouch longitudinal seal. In these embodiments, the label(s) can be indexed from a roll and applied (sealed, adhered, or the like) to a pouch. Alternatively, in some embodiments, the label(s) can be an intermittent strip (registered film) positioned in the transverse seal area on one end of pouch 60 in the machine direction, i.e., perpendicular to the longitudinal seal. In these embodiments, the label can be indexed from a roll and applied to the middle of the pouch film web. Alternatively, the frangible strip can run continuously in the transverse or other suitable direction. In some embodiments, the label(s) can be constructed from one or more semi-rigid materials (e.g., EVA sealant/semi-rigid layer/lock down sealant) that can be registered and applied on an end of the pouch parallel to the pouch longitudinal seal. In an alternative embodiment, a food grade cold seal can be used.

A film used to construct the disclosed pouch and/or label(s) can be multilayer or monolayer. Typically, the films employed will have two or more layers to incorporate a variety of properties, such as, for example, sealability, gas impermeability, and toughness into a single film. Thus, in some embodiments, the films can comprise a total of from 1 to 20 layers, such as from 4 to 12, or from 5 to 9 layers. The films can comprise more than 20 layers e.g. in embodiments wherein the films comprise microlayering technology.

The films used to construct pouch 60 and/or the disclosed labels(s) can include one or more barrier layers, bulk layers, tie layers, abuse layers, and/or sealant layers, e.g., at least one barrier layer such that the pouch has an oxygen transmission rate of no more than about 50 $cc/m^2/24$ hr. at 25° C., 0% RH, 1 atm (in accordance with ASTM D 3985).

The polymer components used to fabricate the films can also comprise appropriate amounts of other additives normally included in such compositions. For example, slip agents (such as talc), antioxidants, fillers, dyes, pigments and dyes, radiation stabilizers, antistatic agents, elastomers, and the like can be added to the disclosed films. See, for example, U.S. Pat. Nos. 7,205,040; 7,160,378; 7,160,604; 6,472,081; 6,222,261; 6,221,470; 5,591,520; and 5,061,534, the disclosures of which are hereby incorporated by reference in their entireties. In some embodiments, pouch 60 can be constructed from a food grade material, as would be well known to those of ordinary skill in the art.

The films used to construct pouch 60 and the disclosed label(s) can have any total thickness so long as they provide the desired properties for the particular packaging operation in which they are to be used. Nevertheless, in some embodiments the disclosed films have a total thickness of from 0.1 mils to 20 mils, such as from 0.2 mils to 10 mils; 0.3 mils to about 5.0 mils; and from 1.0 mils to 3.0 mils.

The films can be provided in sheet or film form and can be any of the films commonly used for the disclosed type of packaging, and can be constructed by any suitable process including e.g. coextrusion, lamination, extrusion coating, and combinations thereof. See, for example, U.S. Pat. No. 6,769,227, the content of which is herein incorporated by reference in its entirety.

In some embodiments, the films can be transparent (at least in any non-printed regions) such that the packaged product is at least partially visible through the films. The transparency of the films can be at least about any of the following values: 20%, 25%, 30%, 40%, 50%, 65%, 70%, 75%, 80%, 85%, and 95%.

In some embodiments the films used to construct pouch 60 or label 56 can be pigmented, tinted, or printed. Printing can be employed at any time prior to use of the pouch. In some embodiments, pouch 60 can be ink jet or thermal transfer printed using a device mounted on a packaging machine that forms and seals the pouch. In some embodiments, printing can include branding, product information, use instructions, and/or a mark that identifies the region of the pouch that is to align with the neck of container 40.

In one embodiment, package 50 can be configured to provide a first transverse seal 62 that facilitates the insertion of package 50 into container 40. Viewing FIGS. 26 to 29, first transverse seal 62 can include (i) a central seal segment 140 intersected by the longitudinal axis 25 of the pouch;

(ii) a second and third seal segment 150*a*, 150*b* respectively each arranged oblique to the longitudinal axis 25 of the pouch, the second seal segment 150*a* in communication with a first side fold 66 of the pouch, and the third seal segment 150*b* in communication with a second side fold 68 of the pouch, and (iii) a fourth and fifth seal segment 160*a*, 160*b* respectively each arranged substantially perpendicular to the longitudinal axis 25 of the pouch, the fourth seal segment 160*a* in communication at one end thereof with the second seal segment 150*a*, and at the other end thereof with the central seal segment 140, and the fifth seal segment 160*b* in communication at one end thereof with the third seal segment 150*b*, and at the other end thereof with the central seal segment 140.

Figure 26:
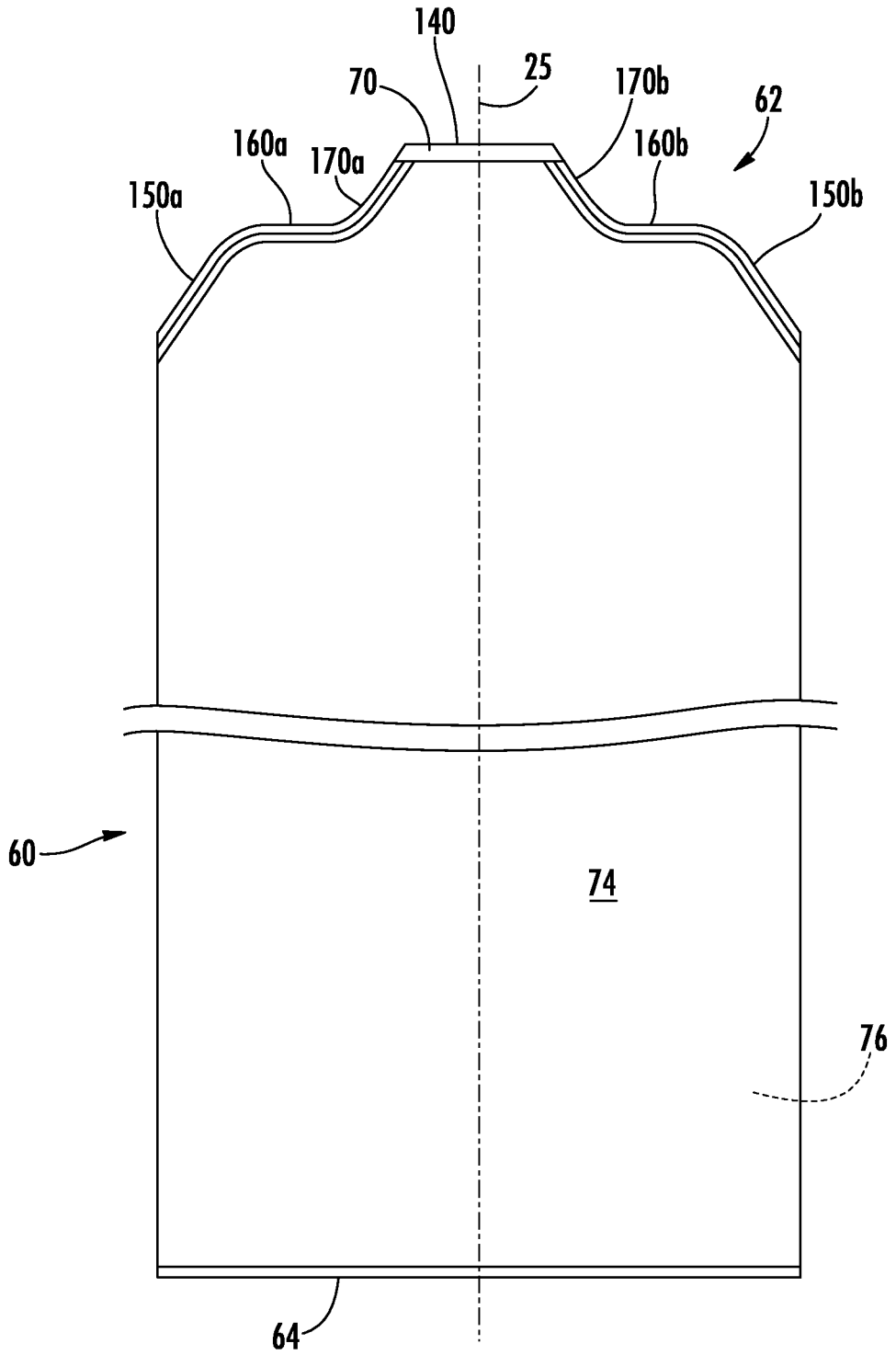
FIG. 26 is a lay flat view of a first embodiment of a pouch.

In the embodiment shown in FIG. 26, the central seal segment 140 comprises two oblique portions 170*a* and 170*b*, and a central linear portion, connecting 170*a* and 170*b*, disposed substantially perpendicular to the longitudinal axis 25 of the pouch. This particular configuration not only facilitates manual loading of package 50 into container 40, but also improves the centering of spout 72 with relation to neck 45 of the container. Centering of spout 72 in turns facilitates dispensing of product 80 out of the package 50 and through the dispensing assembly 100.

Figure 28:
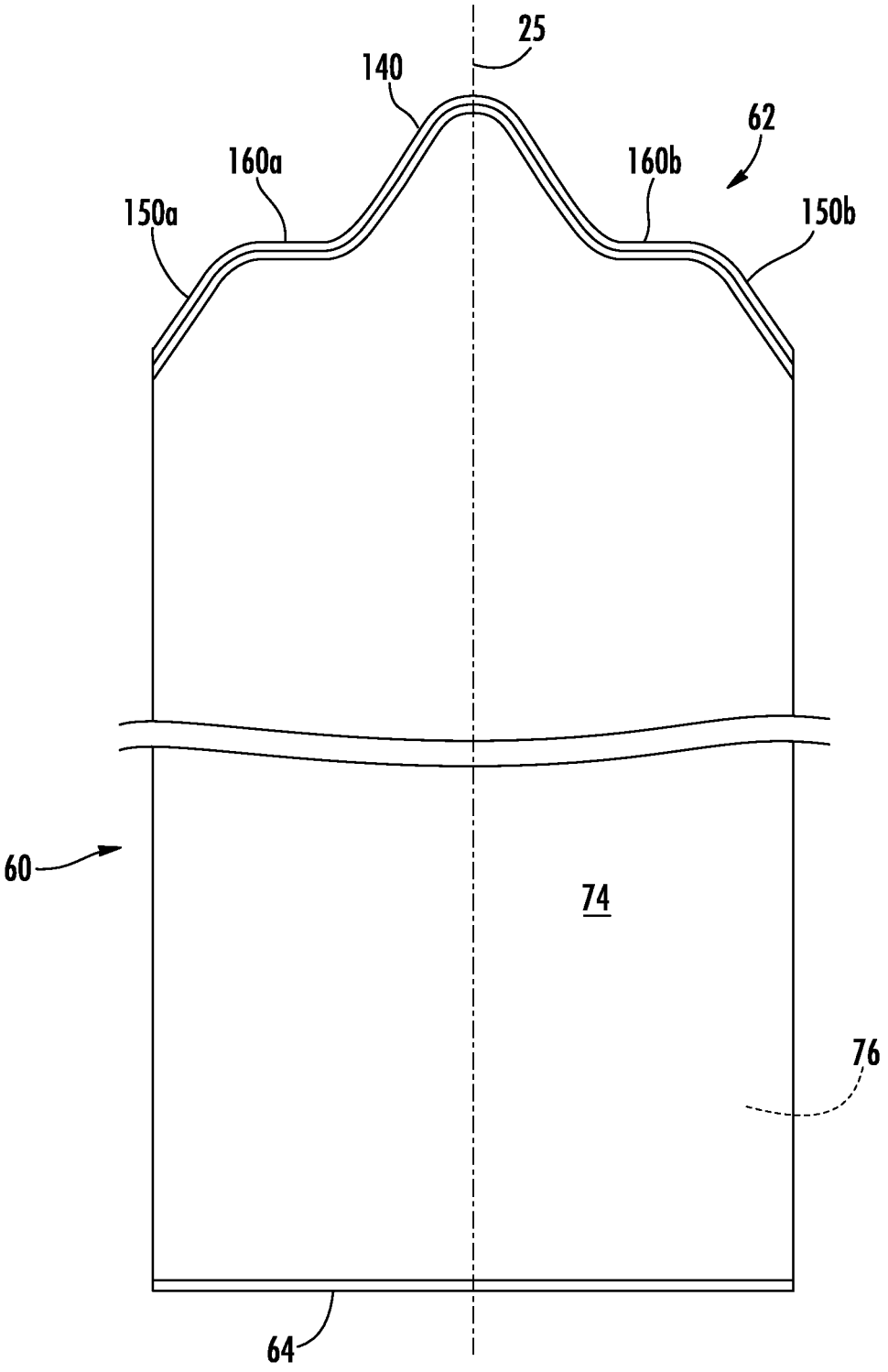
FIG. 28 is a lay flat view of a third embodiment of a pouch.
Figure 29:
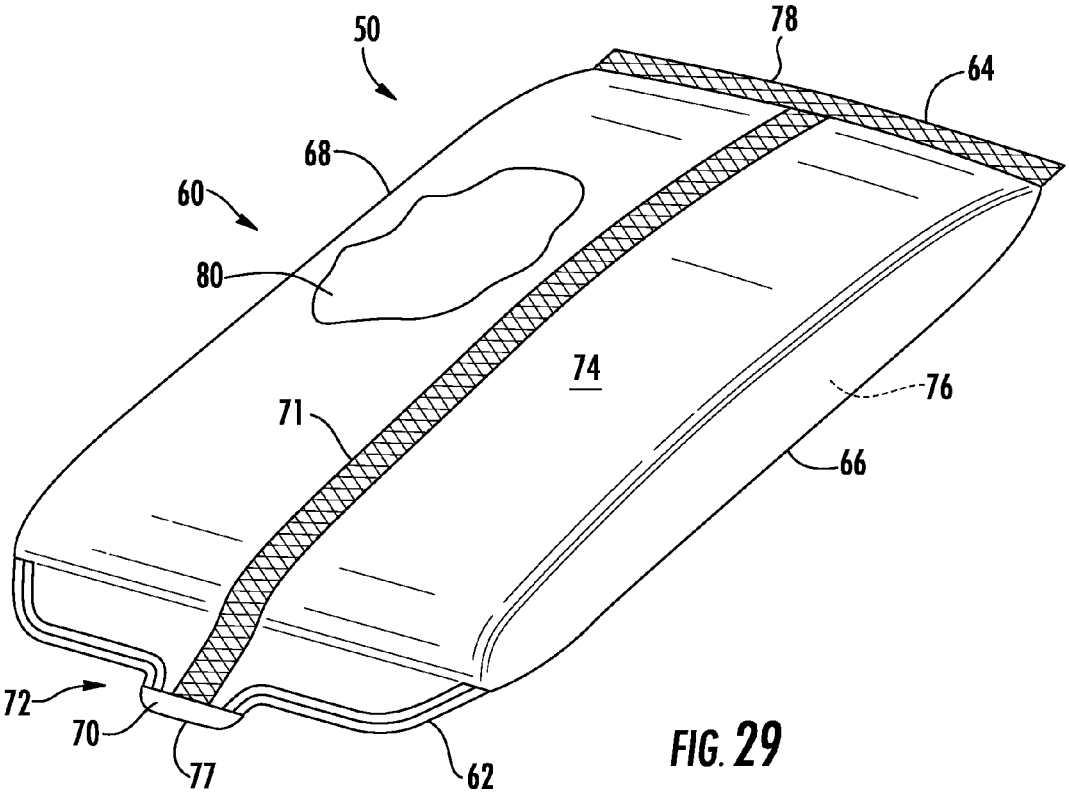
FIG. 29 is a perspective view of a package.
Figure 30:
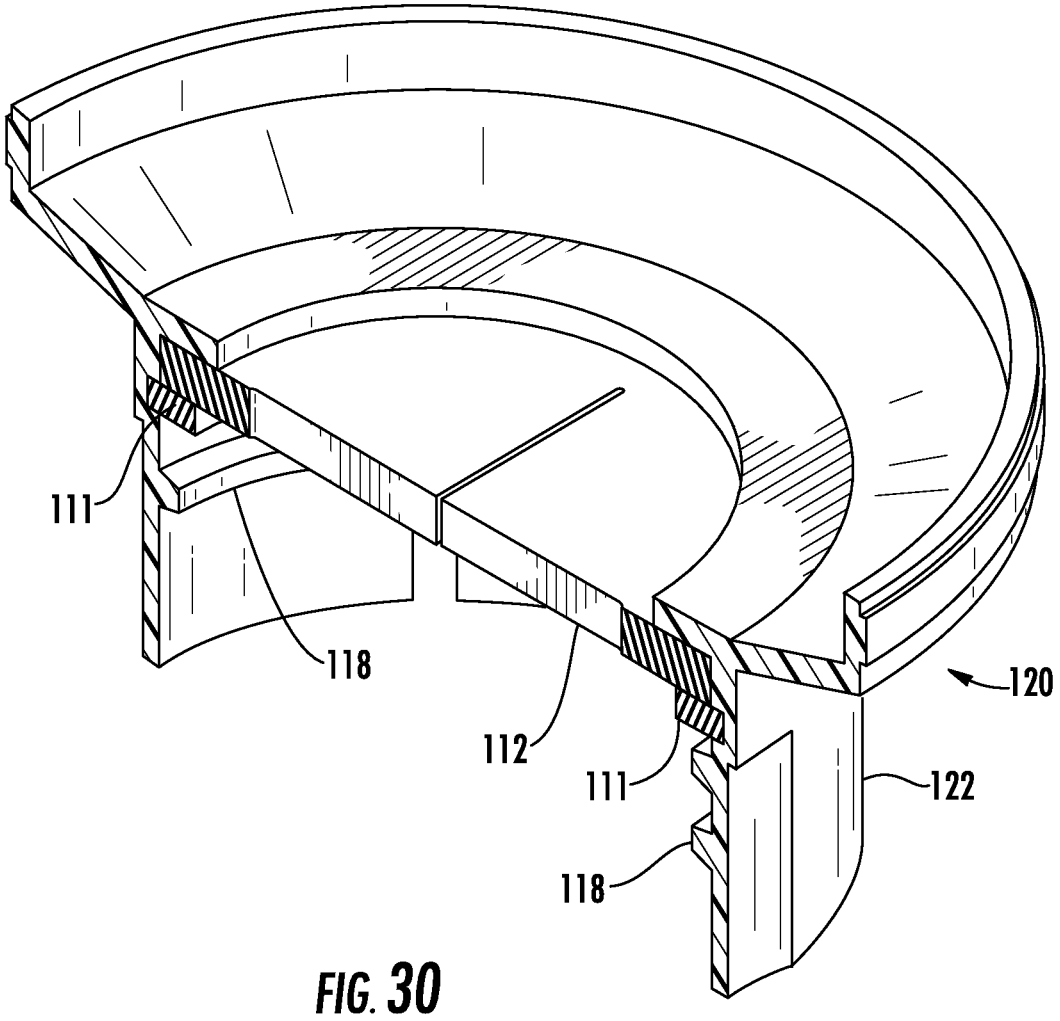
FIG. 30 is a perspective cross-sectional view of a valve housing.
Figure 31:
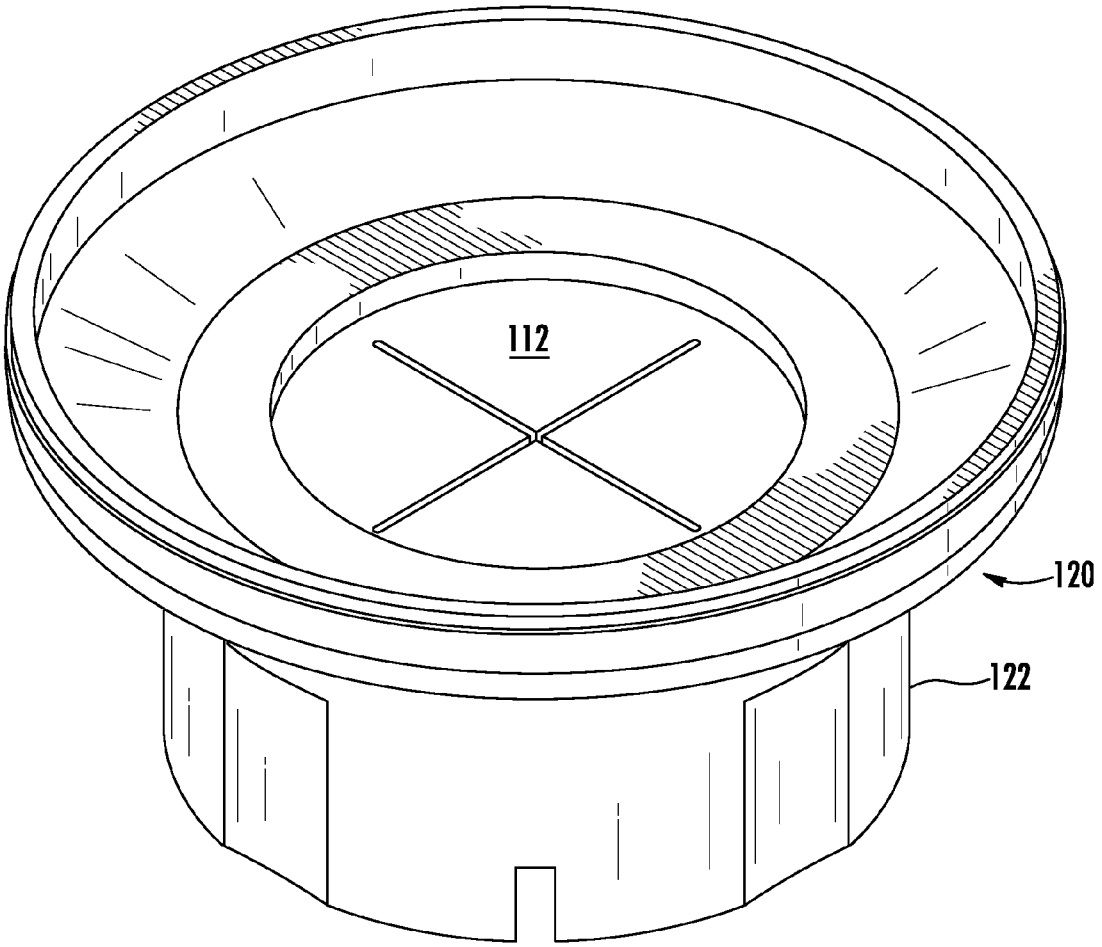
FIG. 31 is a perspective view of a valve housing.
Figure 32:
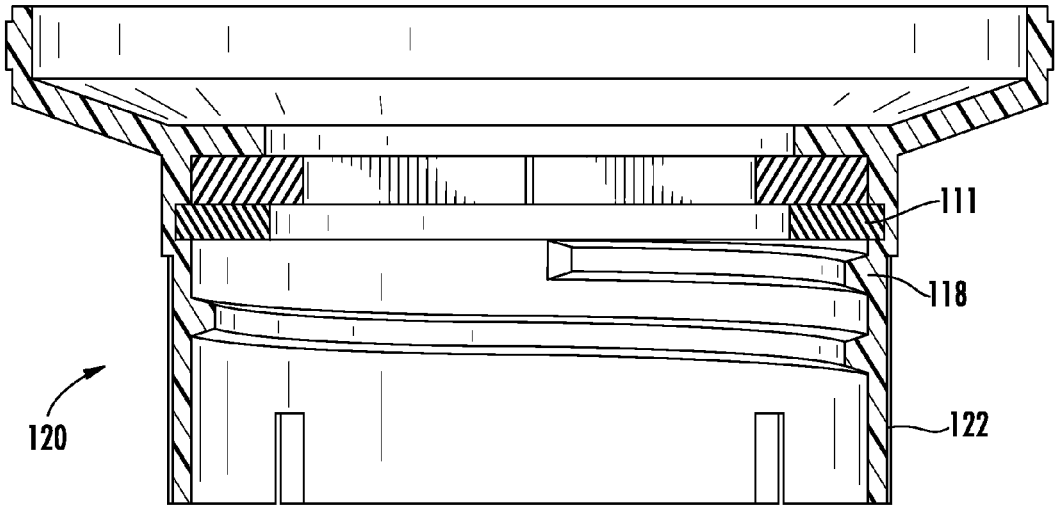
FIG. 32 is an elevational cross-sectional view of a valve housing.
Figure 33:
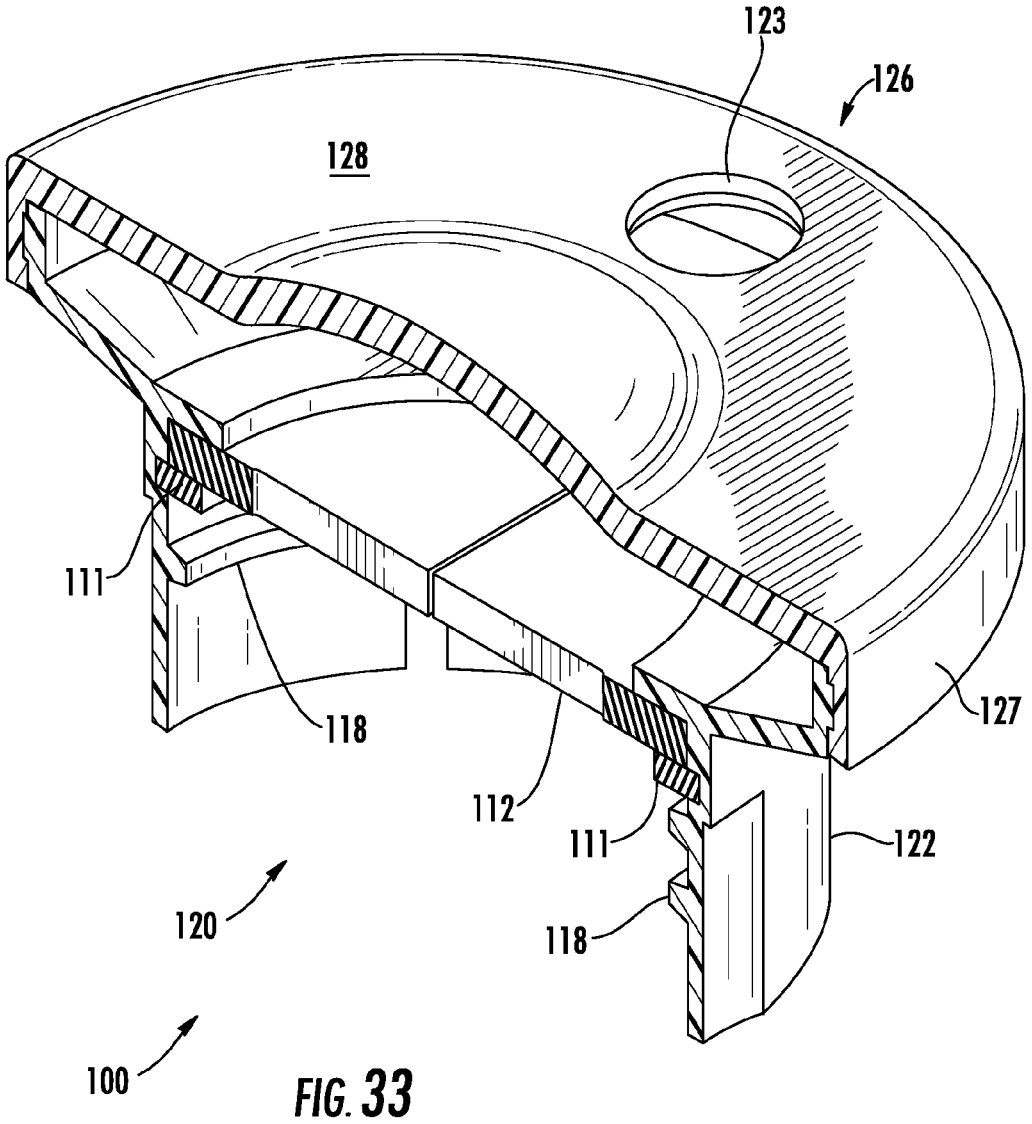
FIG. 33 is a perspective cross-sectional view of a dispensing assembly.
Figure 34:
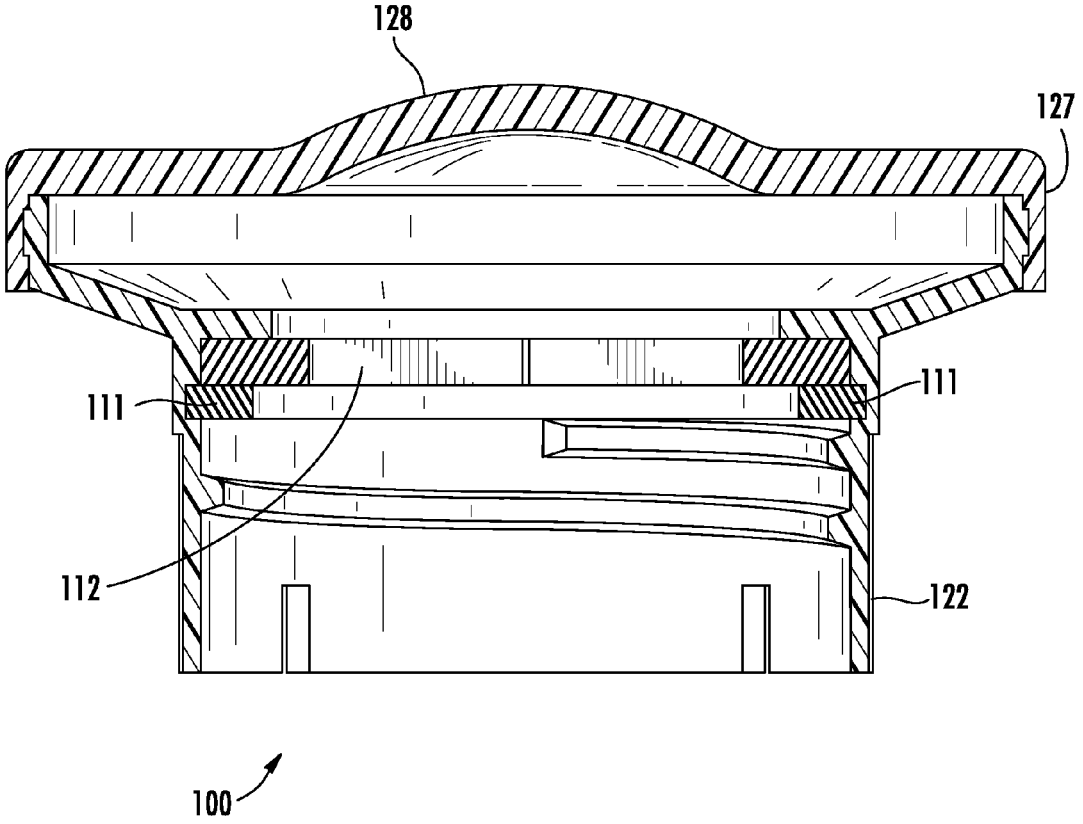
FIG. 34 is an elevational cross-sectional view of a dispensing assembly.
Figure 35:
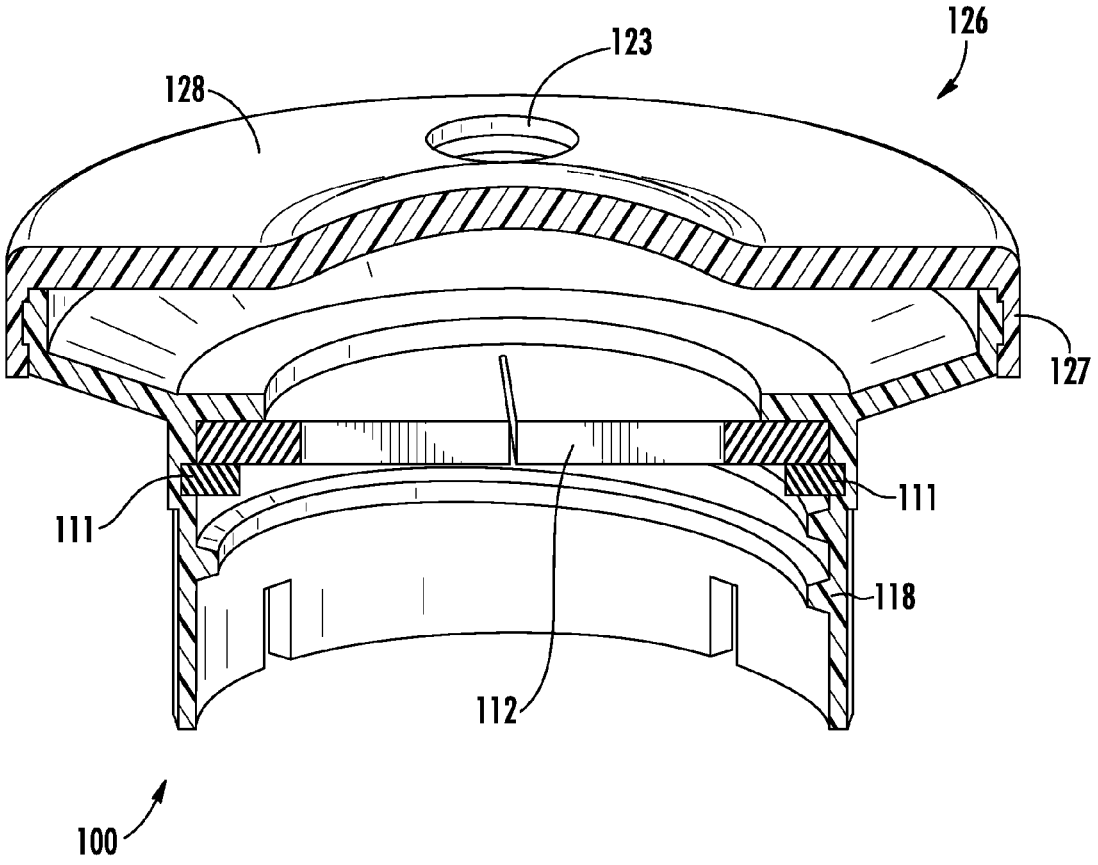
FIG. 35 is a perspective cross-sectional view of a dispensing assembly.

Alternatively, central seal segment 140 is substantially U-shaped, as shown in FIG. 28.

Figure 27:
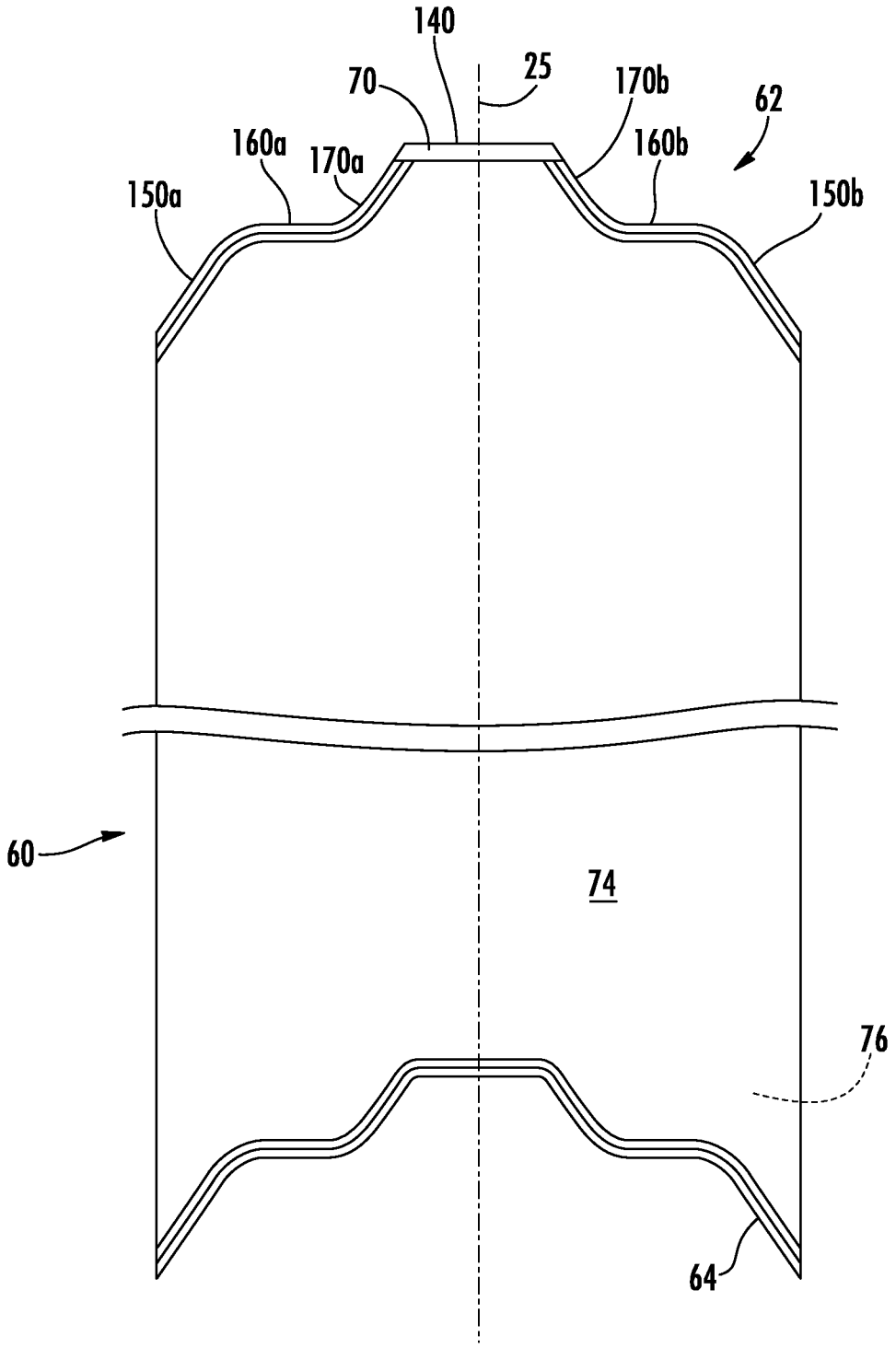
FIG. 27 is a lay flat view of a second embodiment of a pouch.

Second transverse seal 64 can take the form of first transverse seal 62, as shown for example in FIG. 27, but without the presence of a frangible seal 70. Alternatively, second transverse seal 64 can take the form of a conventional, linear seal running perpendicular to the longitudinal axis 25 of the pouch. These two alternative configurations are related to the design of the seal bars used, the desired look of the pouch, and the internal pouch volume.

In an alternative embodiment, the package can be made with the frangible seal positioned in the machine direction, with waste areas at the side of the package perforated for tear off. The lap seal in this embodiment runs from side to side in the package. In another alternative embodiment, the package can be made without a lap seal, but with a fin seal located at the side of the package.

In some embodiments, in lieu of a frangible seal, the pouch spout can have a tear-off feature, such as a tear notch optionally combined with a line of weakness such as a score area or line of perforations, that enables access to the pouch contents.

In another embodiment, the pouch can have neither a frangible seal nor a tear off feature, and the pouch contents can be accessed by mechanically cutting off a portion of the pouch spout.

Figure 62:
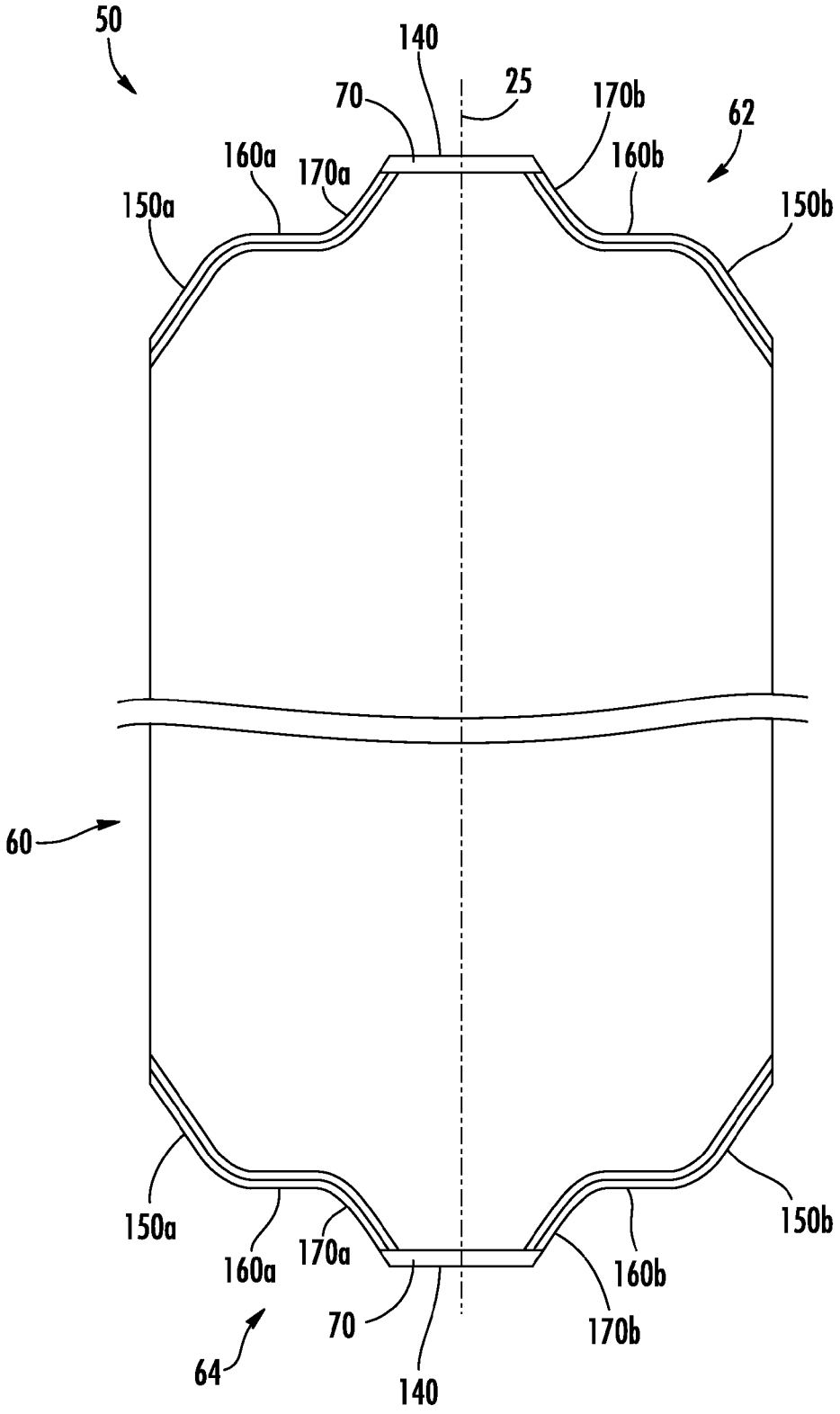
FIG. 62 is a lay flat view of another embodiment of a pouch.

FIG. 62 shows, in an alternative embodiment, a first and second transverse seal 62, 64 that each include the contoured seal disclosed herein for the embodiment of FIGS. 26 and 27. A frangible seal 70 is thus provided at each of the two ends of the pouch 60. In one embodiment, a single transverse seal bar can, in accordance with the VFFS process disclosed herein, simultaneously produce seals 62 and 64. As can be seen in FIG. 62, the seal configuration results in a pouch 60 that is symmetrical with respect to the central transverse axis of pouch 60. The embodiment of FIG. 62 provides for a package 50 that can be loaded into container 40 with either first transverse seal 62 or second transverse seal 64 facing downstream in the container, while still providing a frangible seal in the downstream portion of the pouch.

In the embodiments disclosed in FIGS. 26 to 29, and FIG. 62, production of pouches with a contoured transverse seal in a VFFS process would typically result in the production of scrap as a part of the pouch making process. Although this scrap can be removed during production, it would be beneficial to avoid the necessity of providing for scrap removal, while still gaining the benefit of the contoured spout. This can be achieved by the embodiment of FIG. 63, where a pouch 60 like that of FIG. 62 is provided, but which includes skirts 172*a,b* located on respective sides of the contoured seals 62 and 64. These skirts, made during the VFFS process, in effect capture what would otherwise be scrap material by retaining these portions of the pouch material on the finished pouch rather than cutting the material away from the pouch. Scrap removal is thus avoided. Skirts 172*a,b* can be included in one embodiment at one transverse seal of the pouch 60, or alternatively at both transverse seals of the pouch.

Figure 63:
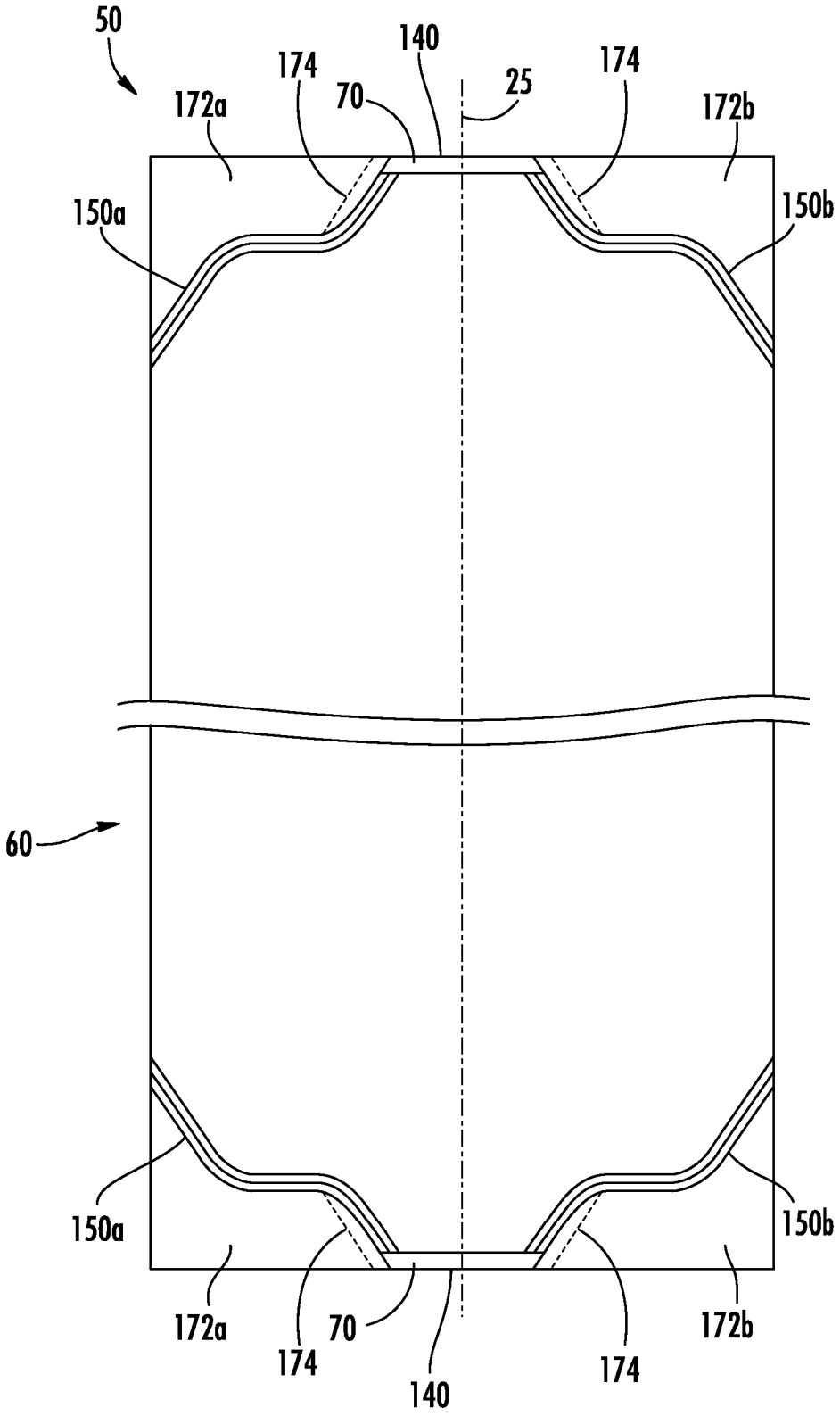
FIG. 63 is a lay flat view of another embodiment of a pouch.

In one embodiment, the embodiment of FIG. 63 can optionally include slits 174. These slits can be produced during production of the transverse seals, by a suitable cutting device. At point of use, when package 50 is loaded in container 40, and the packaging assembly is activated by dispensing gun 30, slits 174 allow skirts 172*a,b* to fold or bend back inside container 40, enhancing the orientation of frangible seal 70 with respect to the first end 42 of container 40, and dispensing of product 80 from package 50. The slits 174 as shown in FIG. 63 extend obliquely from respective ends of skirt 172*a,b* towards the respective contoured seal 62, 64. Those skilled in the art will appreciate, after a review of this disclosure, that the location, length, shape (linear, curved, etc.), and orientation of slits 174 can be selected as needed to optimize the performance of package 50.

III.D. Product 80

System 20 can be used to house any of a wide variety of food and non-food products. For example, product 80 can include any of a wide variety of condiments, including (but not limited to) mustard, ketchup, salsa, guacamole, cheese sauce, sour cream, taco sauce, mayonnaise, tartar sauce, syrup, gravy, hot fudge, caramel, butterscotch toppings, flowable margarine and butter, horseradish, creamers, cream, yogurt, jelly, peanut butter, and the like. Liquids (such as water, milk, lemonade, and the like) can also be packaged in accordance with the present invention.

III.E. Method of Making a Package 50

Figure 46:
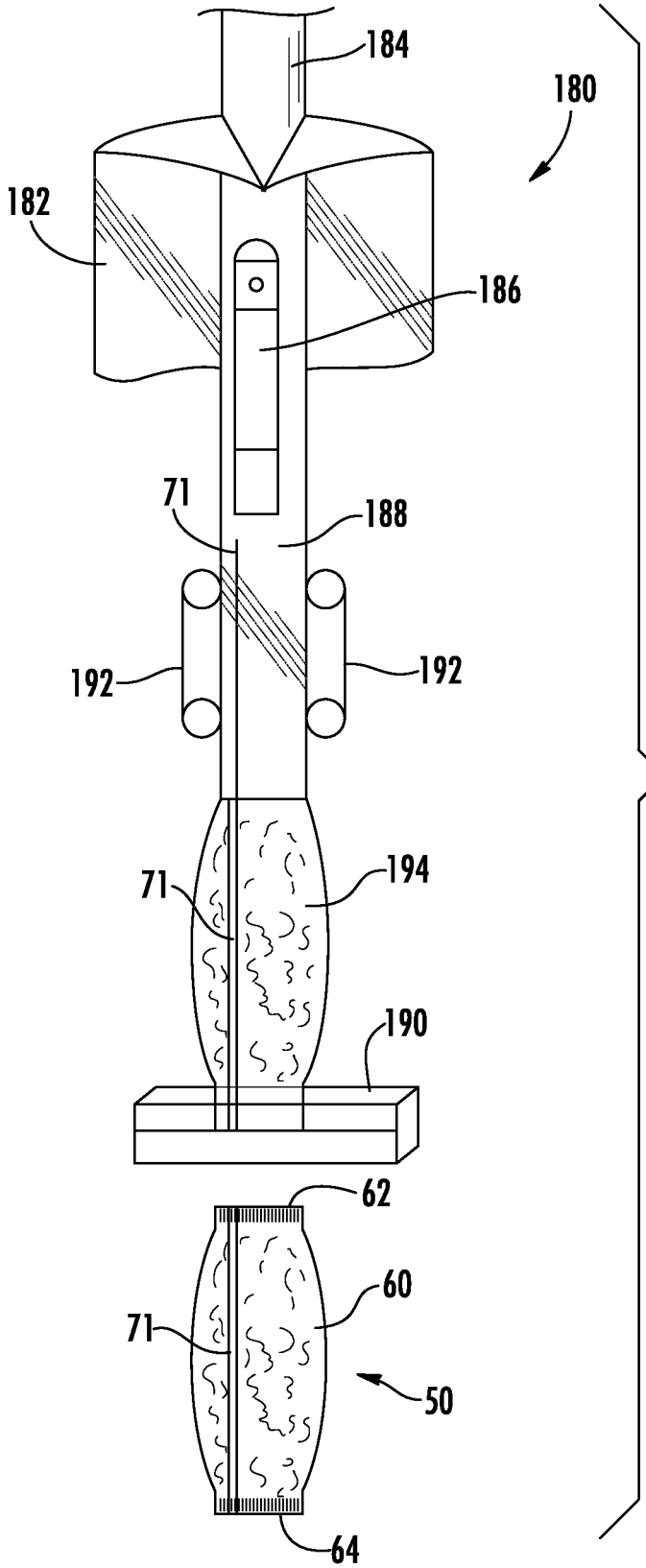
FIG. 46 (PRIOR ART)
FIG. 46 is a schematic elevational view of a portion of a prior art vertical form/fill/seal system.

FIG. 46 schematically illustrates a vertical form/fill/seal (VFFS) apparatus that can be used in conjunction with the apparatus and process according to some embodiments of the present invention. VFFS packaging systems are generally well known to those of skill in the art, and described for example in U.S. Pat. No. 4,589,247 (Tsuruta et al), U.S. Pat. No. 4,656,818 (Shimoyama et al.), U.S. Pat. No. 4,768,411 (Su), and U.S. Pat. No. 4,808,010 (Vogan), all incorporated herein by reference in their entirety.

Apparatus 180 utilizes a lay-flat web 182 as a rollstock. Product 80 is manually or mechanically supplied to apparatus 180 from a source (not illustrated), from which a predetermined quantity of product 80 reaches the upper end portion of forming tube 184 via a funnel (not shown) or other conventional means. The packages are formed in a lower portion of apparatus 180, and web 182 from which the packages are formed is fed from a feed roll or other feeding device over certain forming bars (not illustrated), is wrapped about forming tube 184 (sometimes known as a "sailor's collar" or "forming collar") and is provided with a longitudinal fin seal or lap seal 71 by longitudinal heat sealing device 186, resulting in the formation of a vertically-oriented folded web in the form of a tube 188.

Transverse heat seal bars 190 operate to close and seal horizontally across the lower end of vertically-sealed tube 188, to form a pouch 60 which is thereafter immediately packed with product 80. Film drive belts 192, powered and directed by rollers, as illustrated, or by suitable alternative motive means, advance tube 188 and pouch 60 a predetermined distance, after which seal bars 190 close and simultaneously seal horizontally across the lower end of vertically-sealed tube 188 and across the upper end of sealed pouch 60, to form a package 50 in which a product 80 is disposed in sealed pouch 60. The next pouch 194, thereabove, is then filled with a metered quantity of product 80, forwarded, and the packaging cycle is repeated. It is conventional to incorporate with the seal bars 190 a cut-off knife (not shown) which operates to sever a lower sealed pouch 50 from the bottom of upstream pouch 194.

Lay-flat web 182 of FIG. 10 will in operation typically travel vertically upward from a feed roll to forming tube 184, and then vertically downward for the remaining process steps.

Figure 47:
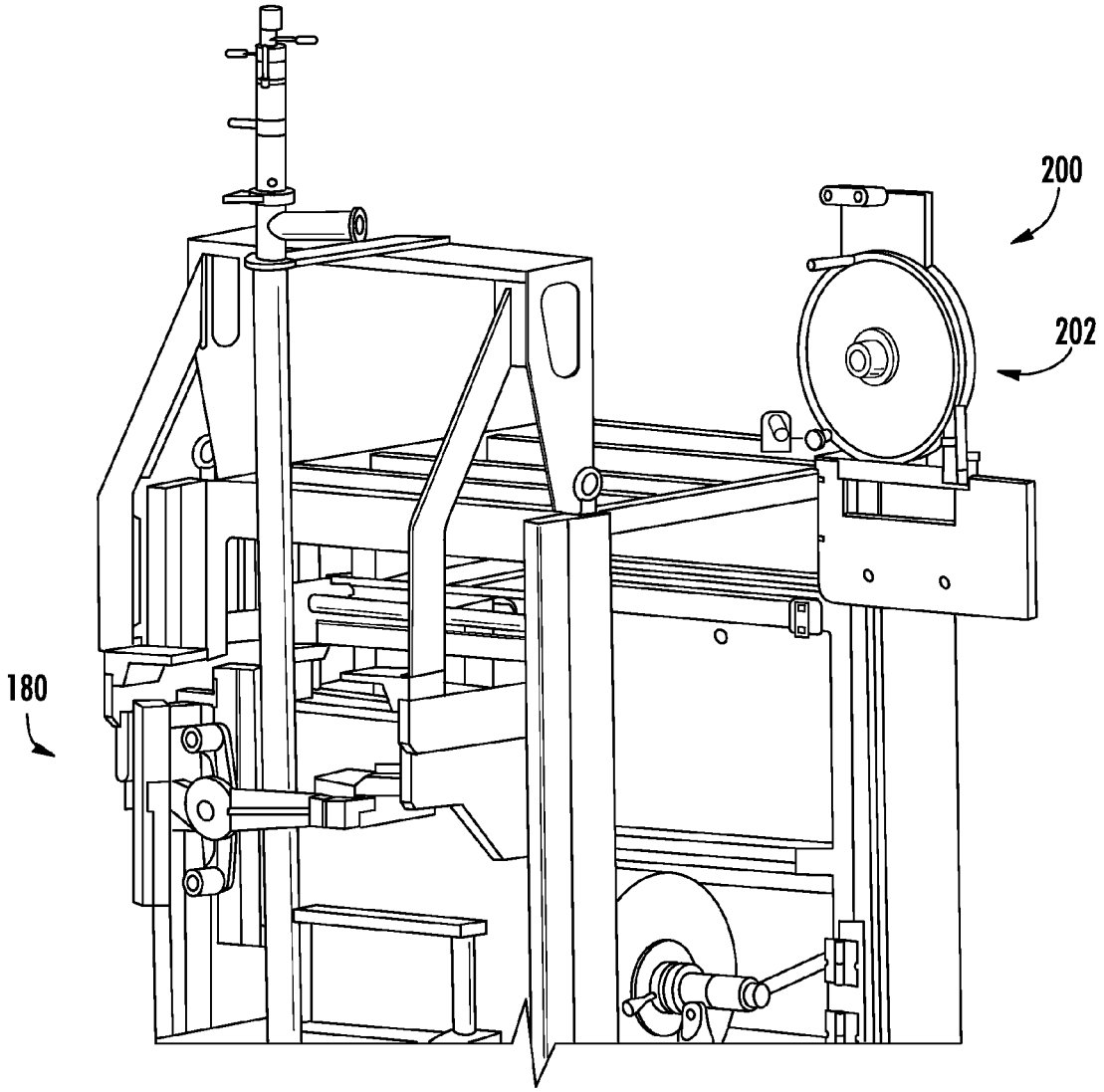
FIG. 47 is a perspective view of a portion of a vertical form/fill/seal system and frangible seal applicator in accordance with the invention.
Figure 48:
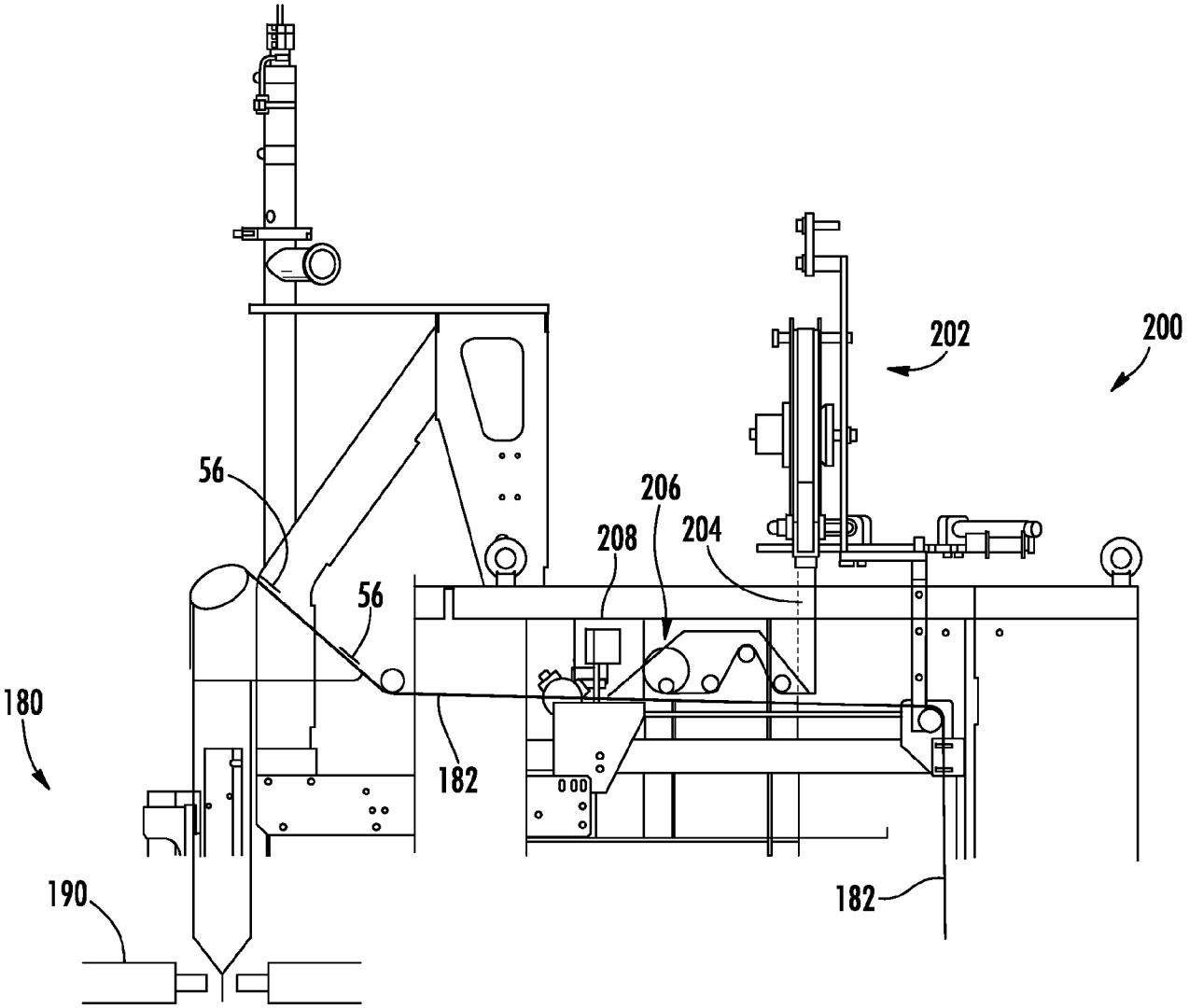
FIG. 48 is a schematic elevational view of a portion of a vertical form/fill/seal system and frangible seal applicator in accordance with the invention.
Figure 49:
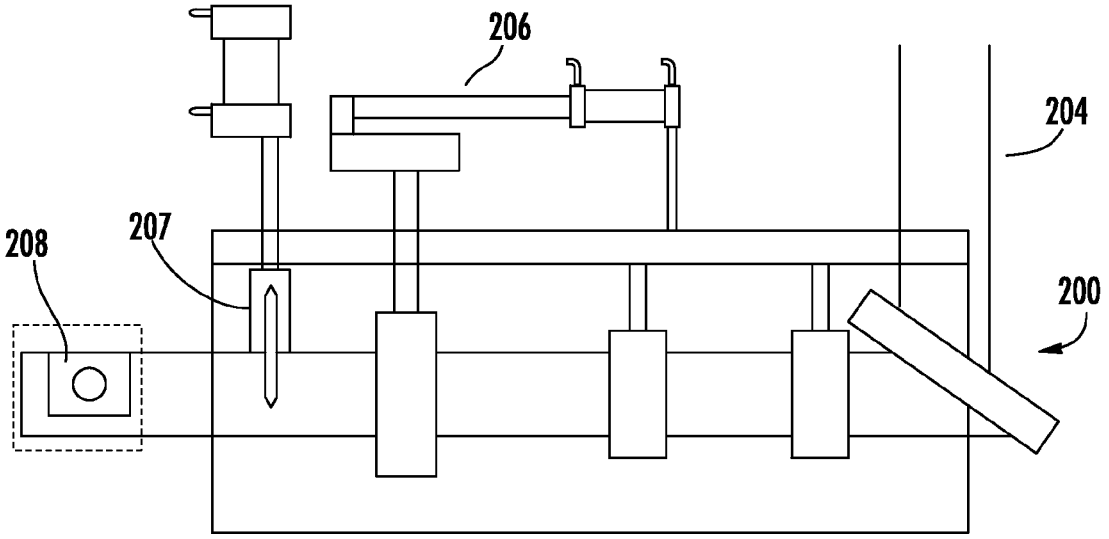
FIG. 49 is a top plan schematic view of a portion of a vertical form/fill/seal system and frangible seal applicator in accordance with the invention.

FIGS. 47 to 49 illustrate a frangible seal applicator 200 that can be used to apply a frangible seal 70, as disclosed herein, in a package.

Applicator 200 includes a film strip mandrel/unwind 202 for supporting a roll of frangible strip 204 and maintaining tension. This part of the applicator is mounted to the VFFS machine in a location that can be accessed for easy loading of the frangible strip 204. Applicator 200 also includes an indexer 206, a heat sealer 208, and a slitter 207. Indexer 206 feeds a short section of film strip 204, e.g. about one inch in length. Heat sealer 208 is then activated, and the film strip 204 is tack sealed to film web 182 along the film path 210 of web 182. This is done so that frangible strip 204 will stay in position as web 182 is indexed and pull over the forming collar. The result is a film tube with a frangible strip adhered to the inside. Each time apparatus 180 indexes, a new label 56 will be applied to the film web.

While the heat seal is being made, slitter 207 cuts off the small section of film strip 204 that was fed through the indexer, effectively creating a label 56. Apparatus 180 then indexes, i.e. web 182 is advanced, thus pulling the new sealed label 56 along with it. After the machine cycle completes, applicator 200 indexes, seals, and cuts another label 56.

Applicator 200 is mounted to apparatus 180 so that the frangible strip 204 is positioned in the center of web 182, perpendicular to the web path. Strip 204 will be sealed to the surface of web 182 that will comprise the interior surface of the finished package 50. Where strip 204 meets web 182, the strip will be parallel to web 182.

If the apparatus 180 being used is one that makes a fold over seal or a side seal, the location of the strip may be moved from center so that strip 204 will be located in the center of the transverse seal, perpendicular to the film path. Alternately, strip 204 can be located anywhere along the transverse seal, thus resulting in a frangible seal at any location along the transverse seal. By changing the length of each label 56, the size of the package opening, when product is eventually dispensed, can be changed. Applicator 182 is in one embodiment located so that the position of the applied label 56 will be a distance from the transverse seal that is a multiple of the finished package length. Because of the location of applicator 200, each label 56 sealed into the transverse seal 62 of the package. The resulting package 50 has a strong seal all around except for the location of label 56.

The invention provides the creation of a weak spot in the package that enables dispensing of a flowable product out of the package in a controlled manner, and as desired, while maintaining a strong, integral package during production, shipping and storage. As an alternative to providing a film strip that can be cut into labels and applied to the film web, alternative methods can be employed for achieving a weak spot in a package, including:

1) printing an area of web 182 so that the printed area is difficult to seal. This can be done in-line, i.e. during the pouch making process, or using registered film, i.e. registration marks, such as eye-spots. Those skilled in the art will be familiar with the use of eye-spots and registration marks in processing web material in packaging operations. Registration marks are printed in uniformly spaced fashion along or near an edge of a web or tape, and facilitate the controlled production of packages. In the case of an in-line process, the film strip mandrel/unwind, indexer, sealer, and slitter are replaced with a coating applicator. For example, an anti-fog coating can be pattern-coated onto web 182 because such coatings are difficult to seal through.

2) treating or crosslinking the web 182, either by the processor or in advance by the web supplier, at the specific locations on the web where a weak seal is desired.

3) mechanically, modifying heat seal bars 190 to produce a transverse seal with a localized weakened area. To produce weak seals in specific areas mechanically, it is necessary to precisely control the time, temperature and pressure of the seal bars. By lowering the time, temperature and/or pressure in specific areas, weak seal can be produced. It is in some embodiments necessary to use multiple seal bars (with separate controls) to accomplish this mechanical method of applying weak (frangible) seals.

4) pre-installing labels 56 on lay-flat web 182 prior to the start of the VFFS packaging process. This can be accomplished off-site from the processor, e.g. by the supplier of lay-flat web 182.

5) applying an adhesive, such as a food-grade adhesive, to web 182 using an applicator, or pre-applying an adhesive to the web prior to processing.

6) using a printed area on a label like that described above, instead of a peelable sealant, to create a low peel strength interface.

7) using a film web comprising an easy-open sealant, and controlling the time, temperature and pressure of the seal bars to produce a package that is sufficiently robust to endure processing, storage and shipment, while exhibiting a frangible seal as described herein when used in the disclosed dispensing system. The easy-open sealant can be produced based on:

- resin selection for an outermost layer of the film web; or
- a hot stamp coater for coating the exterior surfaces of the film web to impart easy-open characteristics to the package; or
- the use of a peelable sealant as a thin outermost layer of the film web, and a permanent sealant as a layer of the film adjacent the outermost layer; or
- the use of a layer of the film web, such as an interior layer, that ruptures by cohesive failure.

In one embodiment, strip 204 and the resulting individual labels 56 are visually colored or patterned in a manner that allows visual verification that each label is positioned correctly in the respective transverse seal, and also for verifying that label 56 is not in the second transverse seal of each package.

Packages 50 can alternatively be made using horizontal form/fill/seal (HFFS) packaging systems, such as those available from Bossar, KHS-Bartelt, Mespack, Laudenberg, and other suppliers; and can also be made using rotary FFS systems such as those marketed by RA Jones, Cloud, etc.

III.F. Dispensing Assembly 100

Figure 13:
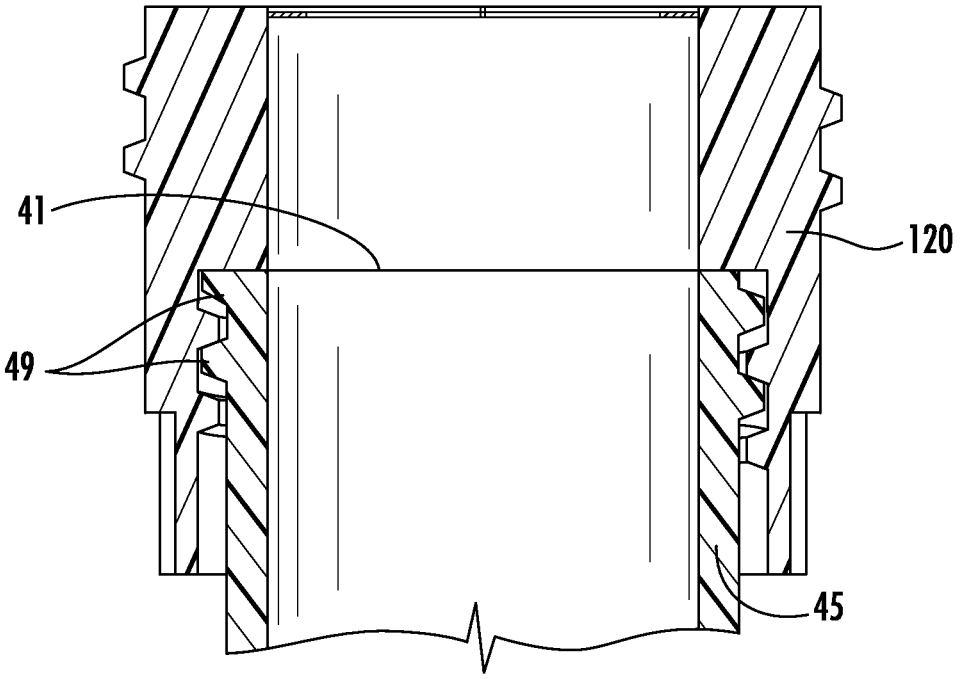
FIG. 13 is a fragmentary view of a container spout and valve housing.

As illustrated in the drawings, in particular FIGS. 13 to 17, and 30 to 40, dispensing assembly 100 comprises a valve 112, a valve housing 120 that retains the valve, and a connecting portion 122 that functionally cooperates with, and is in engagement with container 40 (valve 112 not shown in FIG. 13). In particular, dispensing assembly 100 is positioned adjacent to, and connected to container neck 45.

Figure 14:
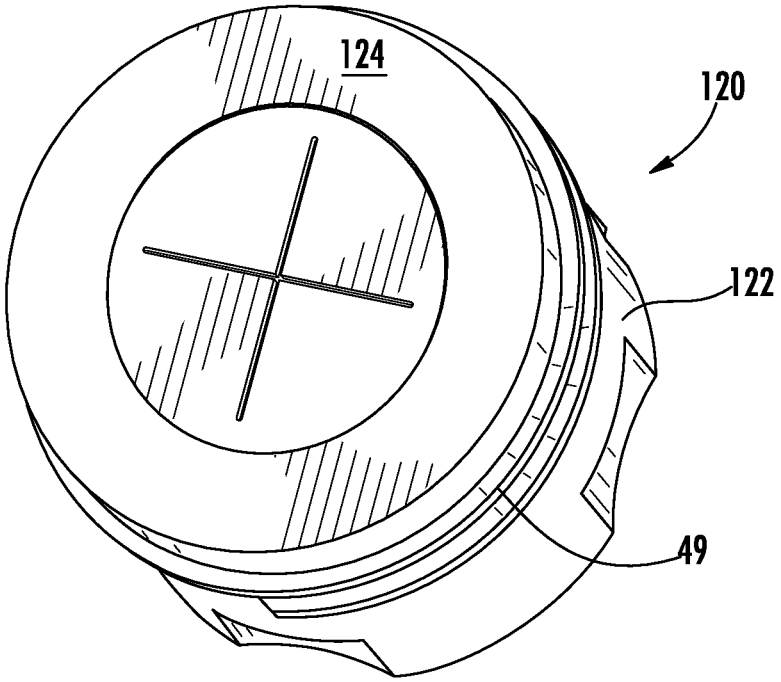
FIGS. 14 and 15 are perspective views of a valve housing.
Figure 15:
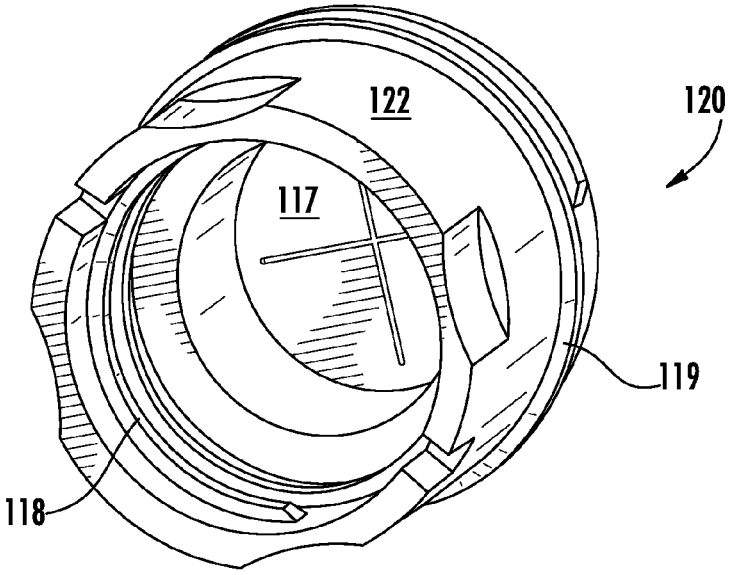
Figure 16:
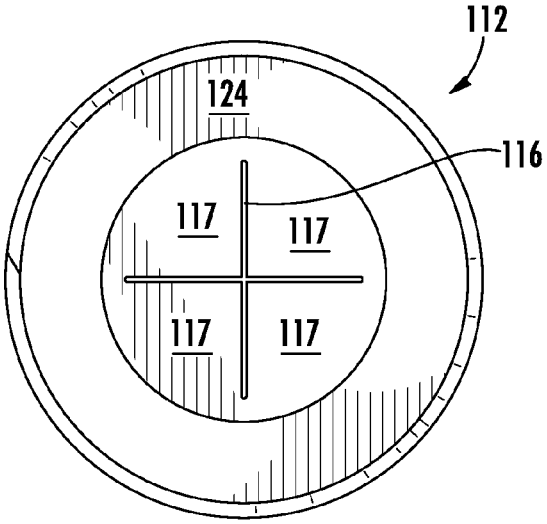
FIG. 16 is a lay flat view of a valve.
Figure 17:
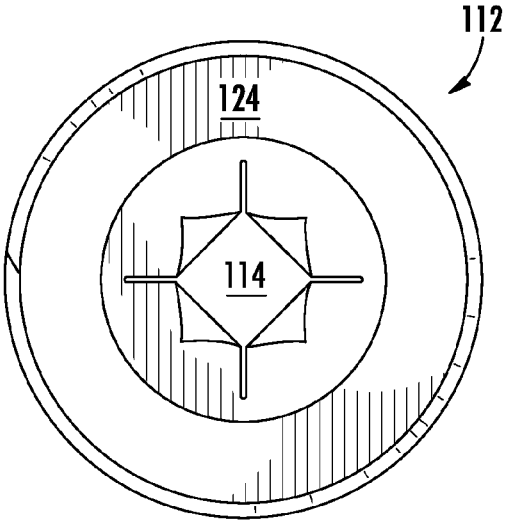
FIG. 17 is a lay flat view of a valve in an open arrangement.

In one embodiment, as shown in FIGS. 14 and 15, the valve housing includes a top face 124 and wall 122 configured to extend down onto all or part of container neck 45. The valve housing interior can in some embodiments include a fastening device 118, such as inner valve housing threads, for mating with the container screw threads 49 positioned around the external circumference of container neck 45 (see FIG. 13). Alternatively, the valve housing interior can include any other suitable mechanism (such as location fit, press fit, twist lock, tab, slot, and/or snap fit arrangements) to cooperate with the container neck. In some embodiments, the exterior of valve housing body includes a fastening device (such as outer threads 165 or a location fit, press fit, twist lock, tab, slot, and/or snap fit arrangement) that allow coupling with diffuser 126, as set forth in more detail herein below.

Valve housing 120 includes at least one valve 112 through which product 80 can be dispensed during use. Valve 112 can be of any suitable variety known in the art, and can have (see FIGS. 16 and 17) at least one cut 116 to form arms 117 that move in response to increased pressure, such as from the advancement of the pusher plate 90, to form at least one passageway 114. Product 80 can travel from the interior of package 50, through passageway 114 of valve 112, to be dispensed on an item such as a food product, either directly, or indirectly by first entering and then exiting diffuser 126. Once pressure ceases, valve 112 closes (i.e., arms 117 resume the original closed position of FIG. 16) to shut passageway 114. Valve 112 may fully close after pressure ceases, or alternatively remain slightly open (i.e., about 1-10% open), partially open (i.e., about 11-30% open), or somewhat open (i.e., about 31-50% open). Valve 112 can be constructed in any suitable shape, e.g. circular, square, oval, and the like. Although depicted as X-shaped in the figures, the valve arms can be also be constructed using any suitably shaped cut, e.g. slits, star, etc.

Valve housing 120 can be constructed from any suitable rigid or semi-rigid material known in the art, such as metal, wood, rubber, plastic, and the like; from polyethylene terephthalate, high density polyethylene, low density polyethylene, polyvinyl chloride, polypropylene, polystyrene, polycarbonates, or combinations thereof. Although depicted as circular in shape in the drawings, the valve housing can be formed in any desired shape, e.g. oval, circular, square, rectangular, and the like.

In some embodiments, valve 112 can be constructed from an appropriately flexible material, e.g. polymeric, rubber, silicone, polyester, thermoplastic polyester elastomer, and the like, including polymeric films that include these materials. In some embodiments, the materials used to form the valve and the shape of the valve cuts can be selected based on the product viscosity, as would be known to those of ordinary skill in the art. For example, products that include particulates (like tartar sauce) can be used with a flexible valve with large cuts to allow the particulates to pass through.

Valve 112 can be of any suitable type, such as an umbrella valve, duckbill valve, reed valve, ball valve, flapper valve, poppet valve, Gott valve, check valve, or any suitable combination thereof.

Valve 112 can be retained or seated in the valve housing in any suitable manner. In one embodiment, as shown in FIGS. 30 and 31 to 36, a retainer 111, such as a retaining ring, is adapted to secure the valve within the valve housing. A retaining clip, or a flange or flanges molded into the valve housing so as to retain the valve 112, can alternatively be used. In some embodiments, fastening device 118 can function as a retainer for the valve.

Valve housing 120 can in some embodiments also include a fastening device 119 such as external valve housing threads, disposed on the outside surface of wall 122, and adapted to interconnect with a diffuser 126 discussed in more detail below.

III.G. Diffuser 126

Figure 18:
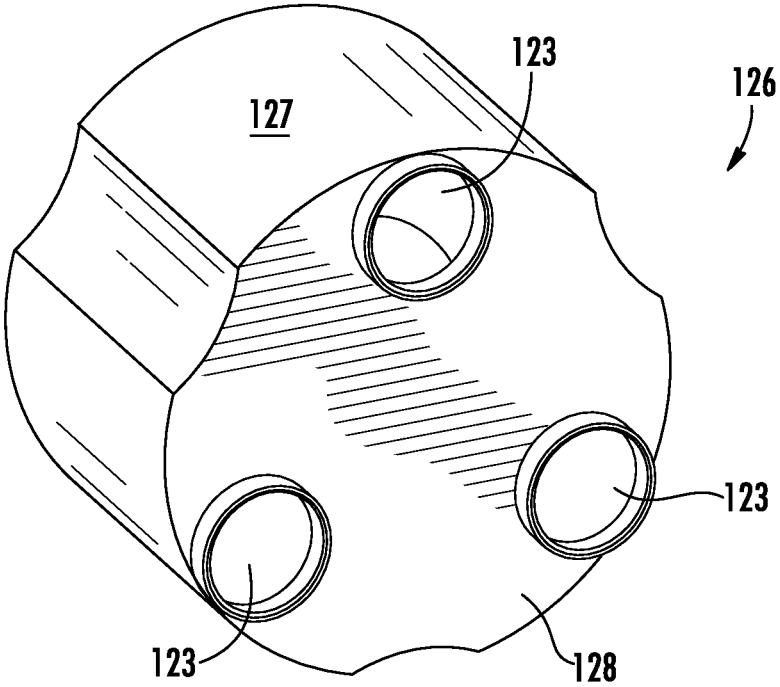
FIGS. 18 and 19 are perspective views of a diffuser.
Figure 19:
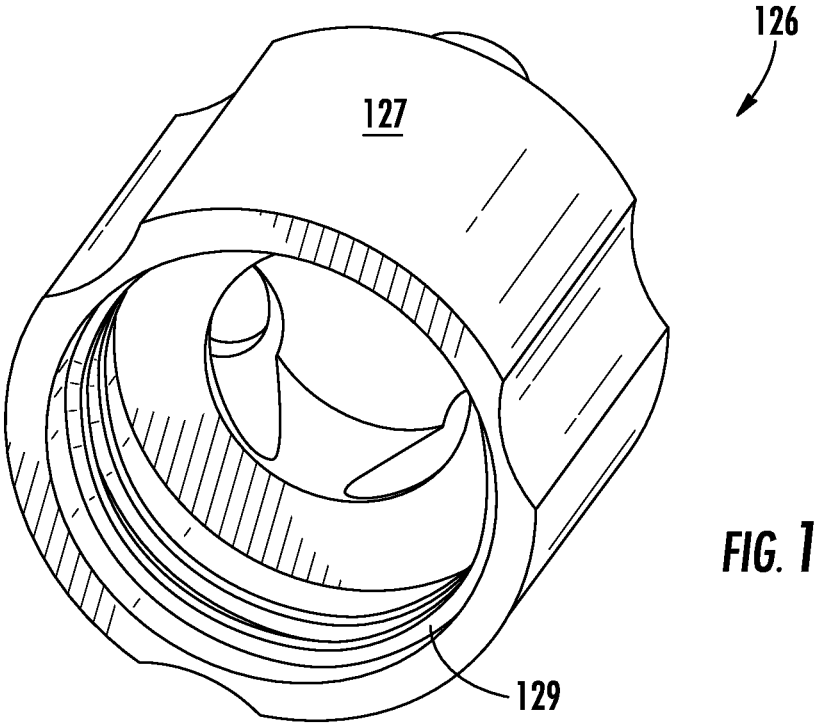

As illustrated in the drawings, in particular FIGS. 1*b*, 2, 18 and 19, 22 to 23, and 32 to 38, in some embodiments packaging system 20 comprises diffuser 126 positioned adjacent to and in communication with valve housing 120 to facilitate dispensing of product 80 from package 50. FIGS. 18 and 19 illustrate one embodiment of a suitable diffuser comprising top face 128 and wall 127 that extends down onto all or part of valve housing 120. The interior of diffuser 126 can include a fastening device, such as internal threads 129 or a location fit, press fit, twist lock, tab, slot, and/or snap fit arrangement) for engaging external valve housing threads or other fastening device 119 of valve housing 120. In one embodiment, the diffuser is connected to the valve housing by a snap fit. This snap fit can be installed on the valve housing so as to render it not removable from the valve housing in normal use, i.e. is permanently installed on the valve housing. This particular feature of the invention can be beneficial when the use includes use of the combined valve housing/diffuser such that when desired, both are discarded as a unit. In some embodiments, the dispensing assembly does not include a diffuser, i.e. the overall packaging assembly, and the overall dispensing system, does not in every instance require a diffuser.

In some embodiments, the diffuser 126 can further include one or more conduits (not shown) or the like that extends through the interior of the space defined by the valve housing and the diffuser.

Diffuser 126 includes one or more outlets 123, that can be of any suitable size, shape, distribution and number, these choices dictated at least in part by the properties, e.g. viscosity or particulate content of the product being dispensed.

Diffuser 126 can be constructed from any suitable material, such as metal, wood, rubber, polyethylene terephthalate, high density polyethylene, low density polyethylene, polyvinyl chloride, polypropylene, polystyrene, polycarbonates, and combinations thereof. Although depicted as circular in shape in the drawings, the diffuser 126 and/or outlets 123 can be formed in any desired shape known in the art, e.g. oval, circular, square, rectangular, and the like.

III.H. Alternative Dispensing Assembly

Figure 50:
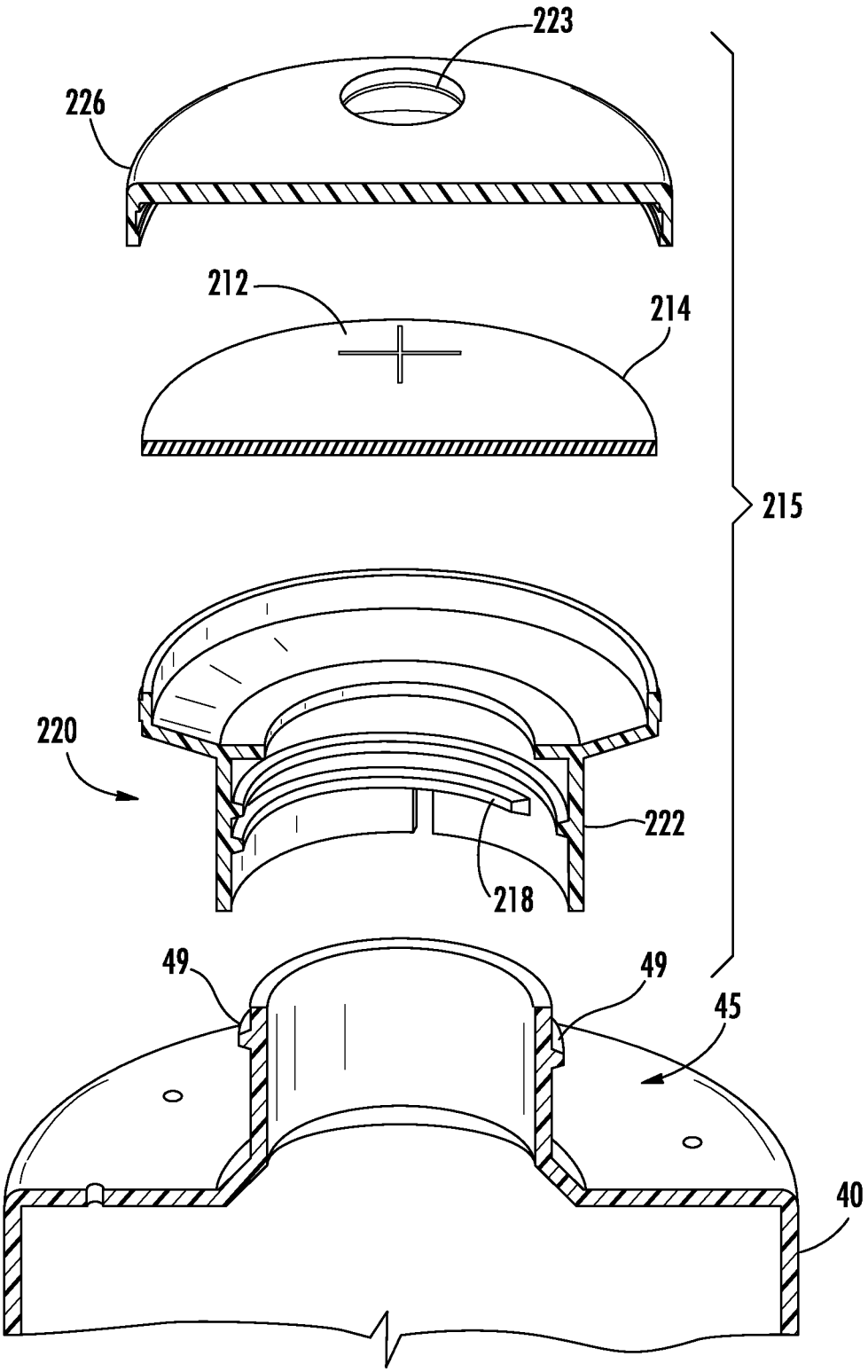
FIG. 50 is an exploded perspective cut-away view of a dispensing system.
Figure 51:
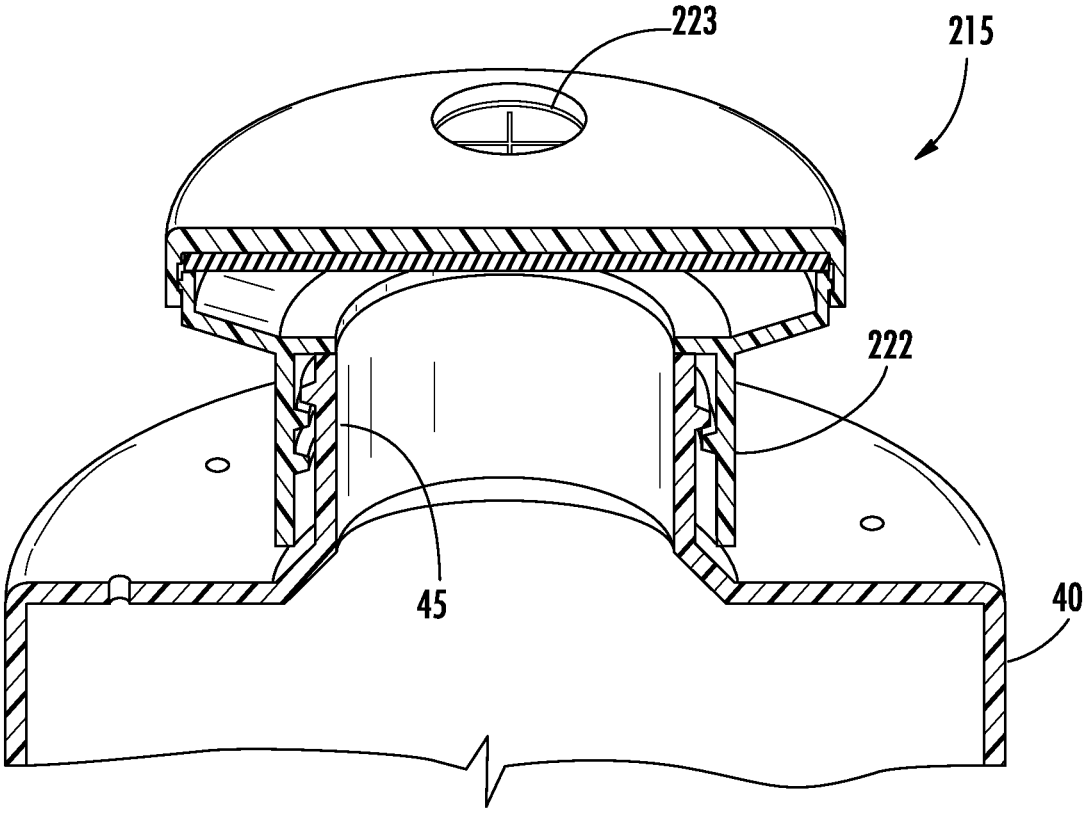
FIG. 51 is a perspective cut-away view of a dispensing system.
Figure 52:
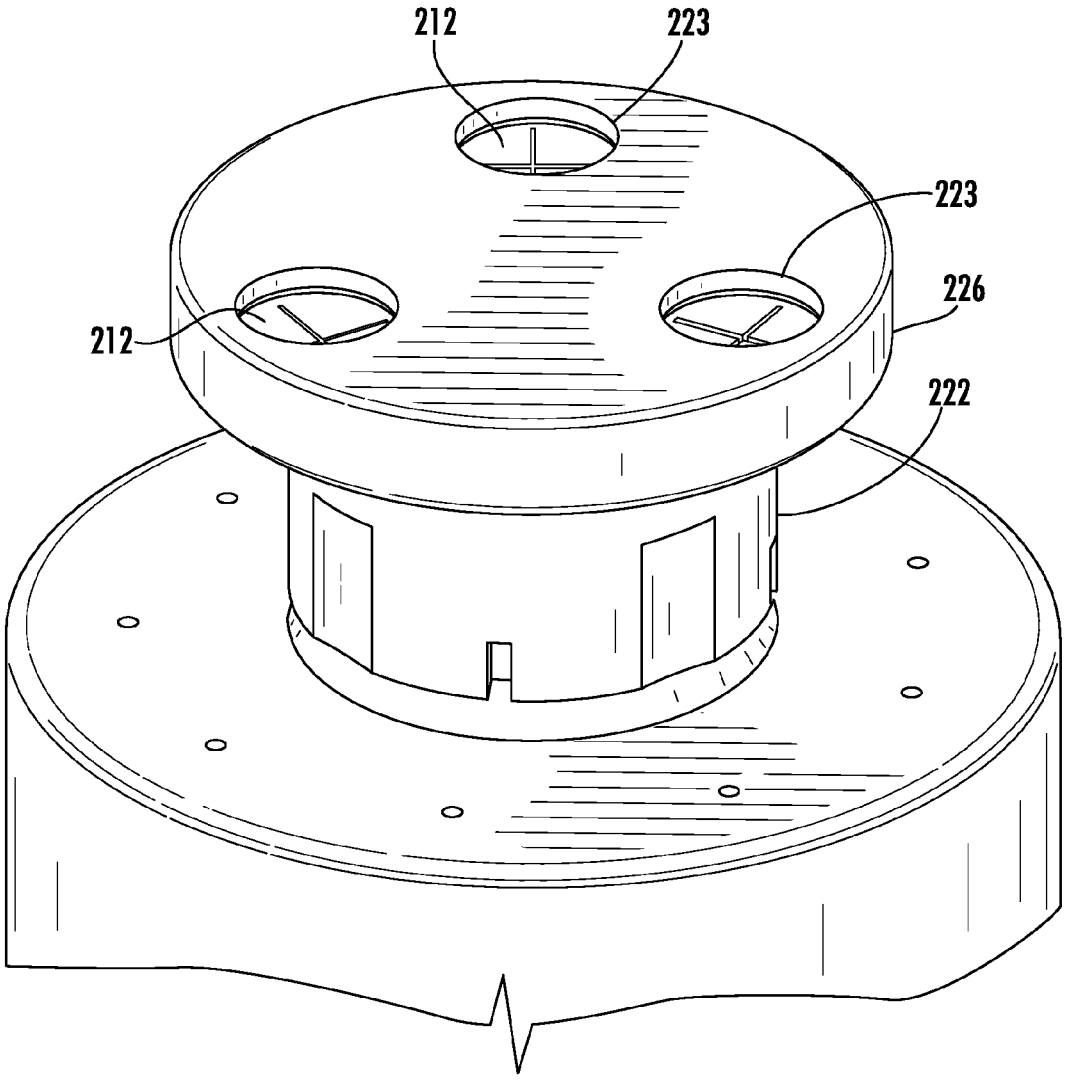
FIG. 52 is an enlarged perspective view of a dispensing system.

In an alternative embodiment (see FIGS. 50 to 52), a dispensing assembly_215 can comprise_one or more valves 212, of any of the types disclosed herein for valve 112, but in which each valve 212 is juxtaposed adjacent an outlet 223, analogous to outlets 123, in a diffuser 226 analogous to diffuser 126 as shown herein. In one embodiment, a single disc 214 of a thermoplastic and/or elastomeric material can be installed inside the diffuser 226, with a valve 212 positioned in each portion of disc 214 that is juxtaposed to and in communication with each respective outlet 223. For example, a diffuser 226 with three outlets 223, as shown in FIG. 52, can be underlain by a thermoplastic and/or elastomeric disc 214 with a reed valve 212 positioned in each portion of disc 214 that underlies a respective outlet 223. The single disc 214 can have a geometry suitable for fitting inside and suitably attaching to the interior (pouch side) of diffuser 226.

Alternatively, an individual disc 214 bearing a valve 212 can be separately placed adjacent each outlet 223, such that e.g. three individual discs 214, each bearing a valve 212, are present in the embodiment of FIG. 52; but such an arrangement may be less convenient and more difficult to install than the embodiment employing a single disc 214.

Diffuser 226 with the underlain juxtaposed disc 214 bearing valves 212 can be connected, integrally or as a discrete, attached component, to a housing 220 similar to valve housing 120 disclosed herein, but not including a valve. Diffuser 226 can be permanently attached to housing 220, or alternatively releasably attached thereto (for example, for purposes of cleaning between uses). Housing 220 provides a plenum for product 80 flowing out of package 50 to be directed to diffuser 226 and out through the individual valves 212 and outlets 223.

Dispensing assembly 215 also includes a connecting portion 222, like connecting portion 122, that functionally cooperates with, and is in engagement with container 40. The housing interior can in some embodiments include a fastening device 218, like device 118, e.g. inner housing threads, for mating with the container screw threads 49 positioned around the external circumference of container neck 45 (see FIG. 13).

III.I. Pusher Plate 90

In one embodiment, packaging system 20 comprises pusher plate 90, configured to cooperate with piston 34 of a dispensing gun. The pusher plate is sized and shaped to be closely received within the container interior at second end 44 to help ensure that the package 50 is fully retained within the container 40 during dispensing. In some embodiments, pusher plate 90 can be configured to define a mating relationship with the interior surface 48 of container 40 when in contact. The pusher plate 90 is slidable within the interior of the container to ultimately allow product 80 to be dispensed from the package. When pressure is exerted on pusher plate 90 from a dispensing gun, the pusher plate reacts by slidably moving from container second end 44 towards container first end 42. As a result, pouch 60 is compressed, thereby increasing pressure on frangible seal 70 to dispense product 80.

In some embodiments, pusher plate 90 can be slightly undersized in relation to the inner diameter of container 40 allowing it (in conjunction with package 50) to wipe product as it transverses the length of the container, pushing toward the outlet. The package binds to the pusher plate 90 as it is retracted, thereby permitting easy removal of the used pouch.

Alternatively, the pusher plate can be a component of a dispensing gun instead of, or in addition to, a component of packaging system 20, as described herein.

Suitable materials for use in constructing pusher plate 90 include (but are not limited to) plastic, wood, metal, rubber, and the like. In some embodiments, pusher plate 90 is configured as part of a dispensing gun. Alternatively, in some embodiments, the pusher plate can be configured as part of packaging system 20.

Figure 60:
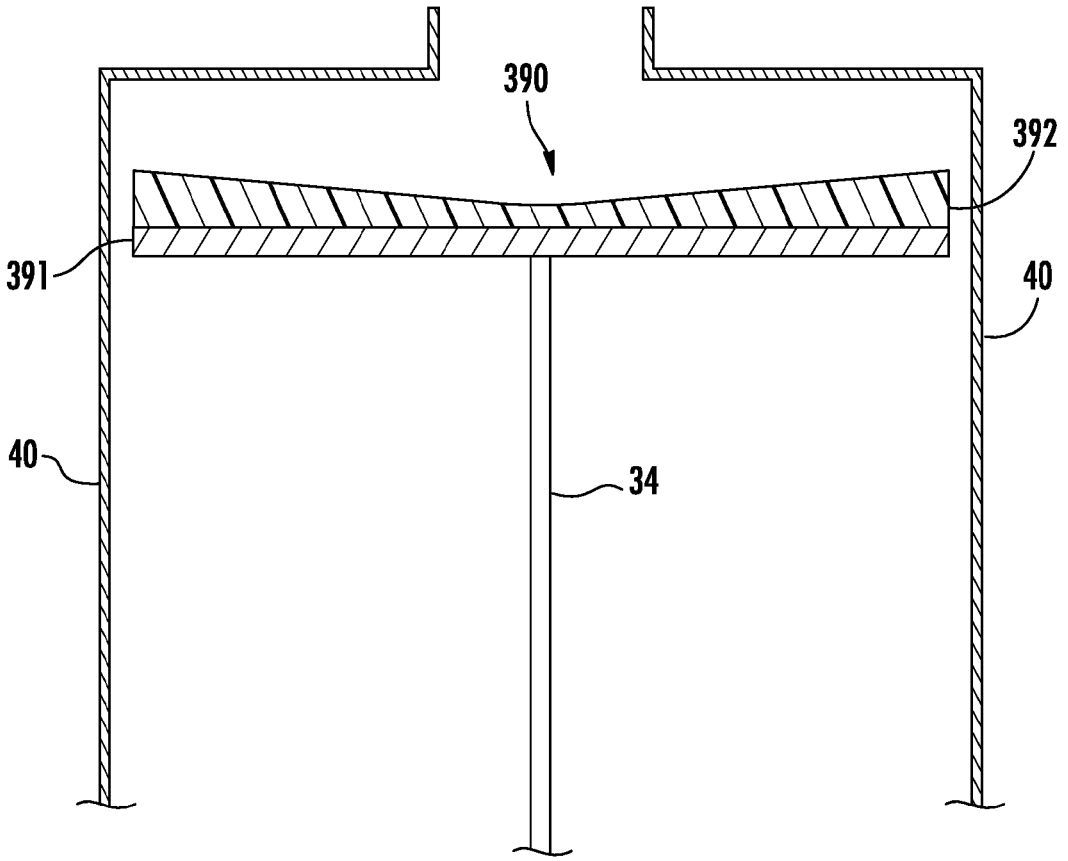
FIG. 60 is a schematic elevational view of a portion of a packaging system with a composite pusher plate.
Figure 61:
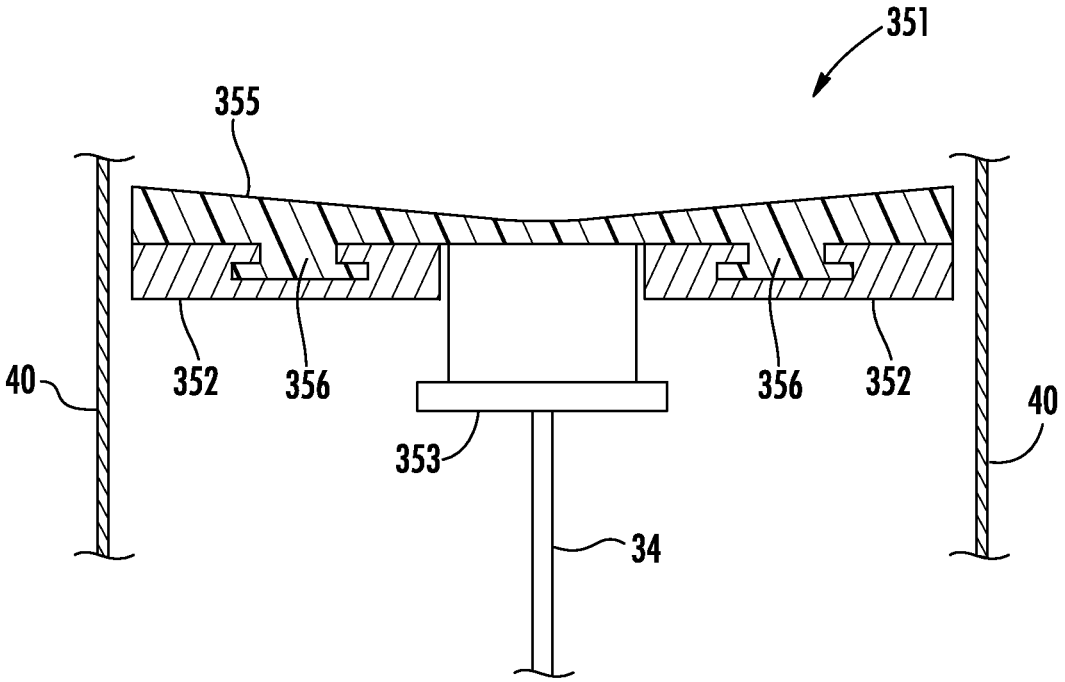
FIG. 61 is a schematic elevational view of a portion of a packaging system with a segmented composite pusher plate.

An alternative embodiment to the pusher plate 90 described above, is a segmented pusher plate 290 (see FIG. 53A through FIG. 59) that includes in various embodiments an outer plate segment 291, an inner plate segment 292, a biasing member 293 such as a spring, an upper plug 276, a lower plug 278, and a retaining pin 280 (for simplicity, package 50 is not shown in FIG. 53A through FIG. 61, but in practice is present inside container 40 as indicated elsewhere in the description and drawings.) In one embodiment, segmented pusher plate 290 has a telescopic coaxial configuration, such that the outer and inner plate segments 291 and 292 are concentrically arranged, either within a single plane or within two planes. As shown in various embodiments in FIGS. 53A, 54A, 55A, 56, and 57, pusher plate 290 has been advanced to the container first end 42, with the inner plate segment 292 in a retracted position. Inner plate segment 292 is attached to piston rod 34, and is retained in this retracted position by biasing member 293, such as a mechanical or elastomeric spring.

In practice, at this stage of the dispensing cycle, the package 50 inside container 40 is nearly completely collapsed, and most of the contained product 80 has already been dispensed from the pouch 60.

With further advancement of the pusher plate, by additional force put on piston rod 34, outer plate segment 291 remains essentially stationary, but inner plate segment 292 advances further, overcoming the biasing action of biasing member 293 (e.g. by compressing a spring), to take an extended position, i.e. move further toward or up the container neck 45. FIGS. 53B, 54B, 55B, and 58 show in various embodiments the inner plate segment 292 in its extended position. This action results in removal of much of the remaining product 80 inside pouch 60. Thus, segmented pusher plate 290 in use provides a method of reducing the product 80 left in package 50 at the completion of a dispensing cycle, this configuration leading to higher dispensing yield, i.e. the percentage of product 80 that is dispensed from pouch 60.

In one embodiment (see FIG. 56), the shoulder 46 of the first end 42 of container 40 is configured as a flat, circular planar surface (disregarding container neck 45) that is positioned at right angles to the longitudinal axis of container 40, i.e. at right angles to side wall 47 of container 40. In certain technologies such as blow-molding and injection-molding, however, a certain "draft", i.e. an amount of taper for molded or cast parts perpendicular to the parting line is necessary. Thus, for example as shown in FIGS. 53A through 54B, as well as FIGS. 57 through 59, at least a shallow draft, of e.g. about 5 degrees, is included for shoulder 46. For an embodiment where some draft is required for container 40, a discrete shim 282 (see e.g. FIG. 59) can be separately made and then installed inside container 40, juxtaposed against the interior surface of shoulder 46, in a "donut" fashion, to accommodate the draft on the container by providing a first surface matching the taper of the first end, while providing a second surface with a flat configuration, i.e. a planar surface that is positioned at right angles to the longitudinal axis of container 40. It can be seen that this arrangement will provide a geometry that maximizes the utility of either an unsegmented pusher plate 90 or a segmented pusher plate 290 by allowing the collapsing pouch 60 to operate against a flat surface.

Figure 53A:
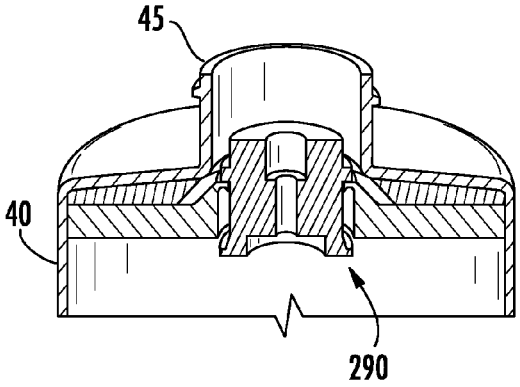
FIG. 53A is a perspective cross-sectional view of a portion of a packaging system with a segmented pusher plate in a first position.
Figure 53B:
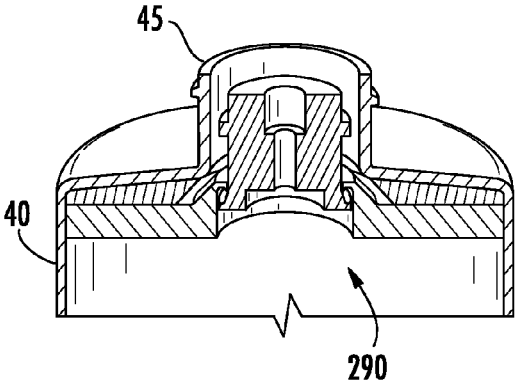
FIG. 53B is a perspective cross-sectional view of a portion of a packaging system with a segmented pusher plate in a second position.
Figure 54A:
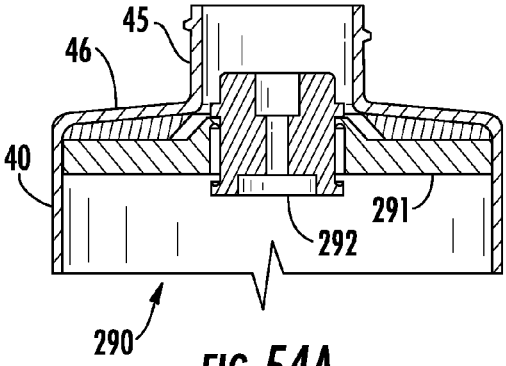
FIG. 54A is an elevational cross-sectional view of a portion of a packaging system with a segmented pusher plate in a first position.
Figure 54B:
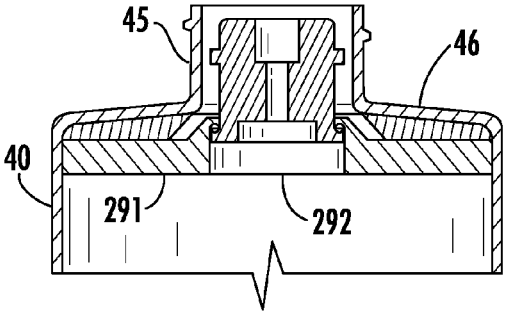
FIG. 54B is an elevational cross-sectional view of a portion of a packaging system with a segmented pusher plate in a second position.
Figure 55A:
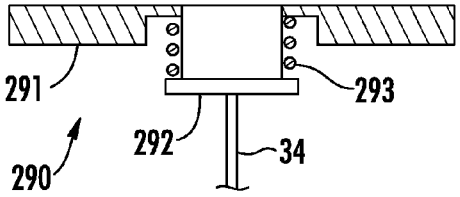
FIG. 55A is a schematic elevational view of a portion of a packaging system with a segmented pusher plate in a first position.
Figure 55B:
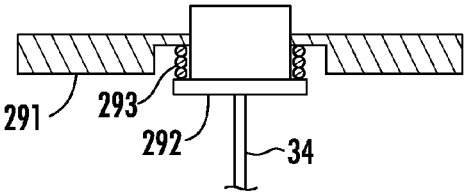
FIG. 55B is a schematic elevational view of a portion of a packaging system with a segmented pusher plate in a second position.
Figure 56:
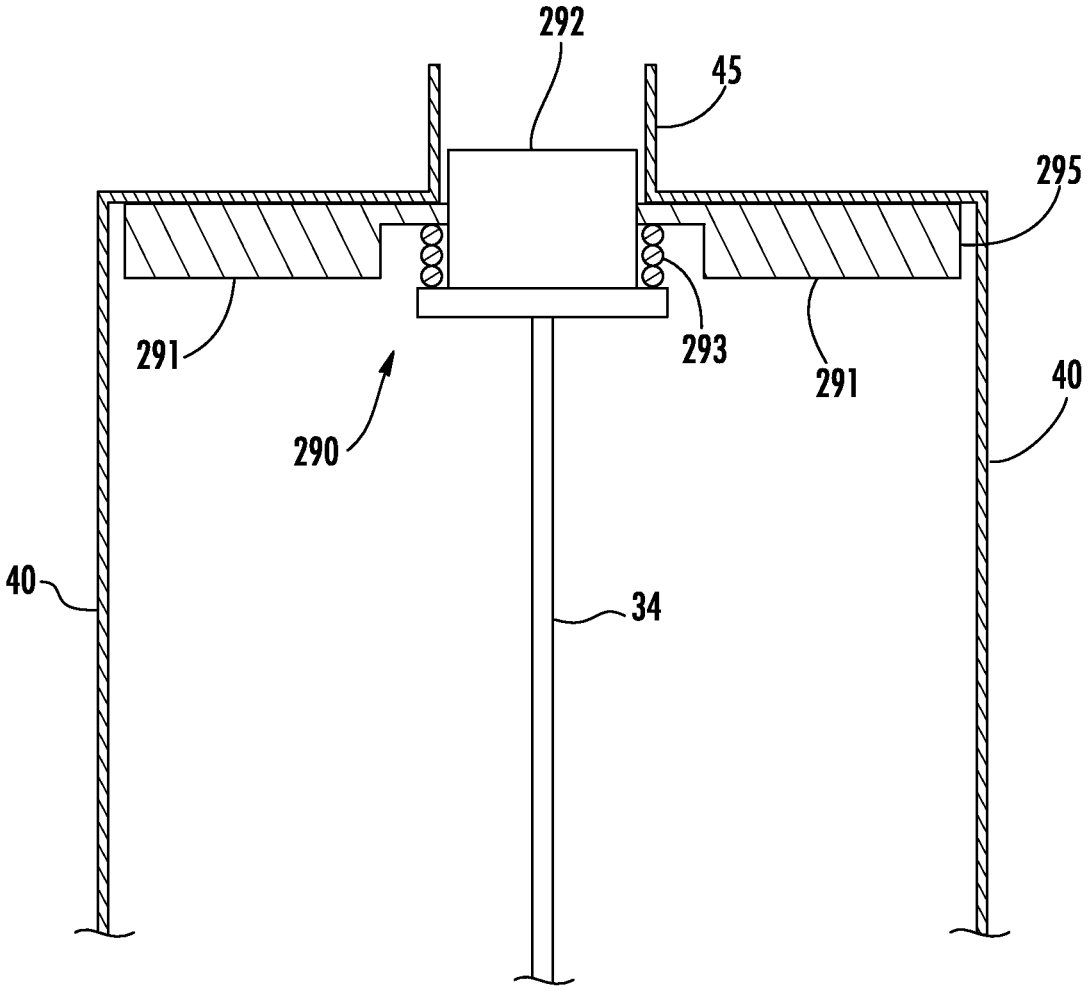
FIG. 56 is an elevational cross-sectional view of a portion of a packaging system with a segmented pusher plate in a second position.
Figure 57:
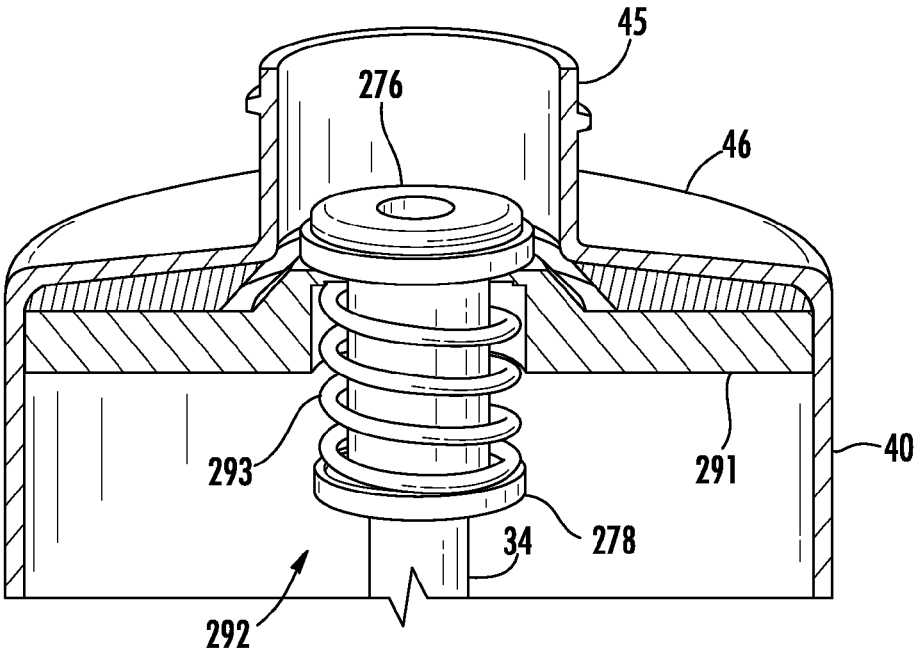
FIG. 57 is a perspective cross-sectional view of a portion of a packaging system with a segmented pusher plate in a first position.
Figure 58:
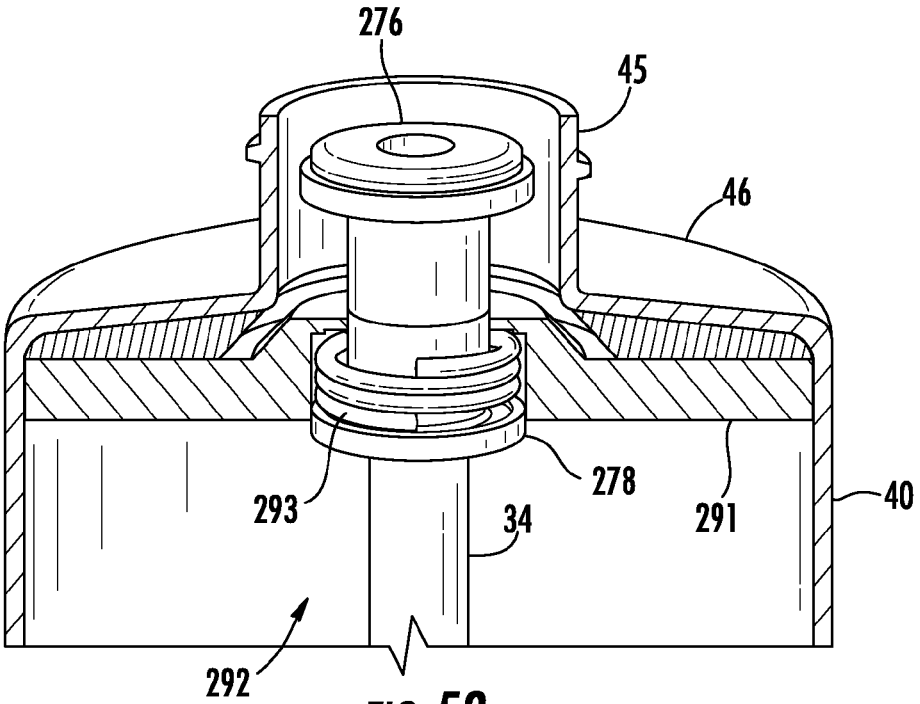
FIG. 58 is a perspective cross-sectional view of a portion of a packaging system with a segmented pusher plate in a second position.
Figure 59:
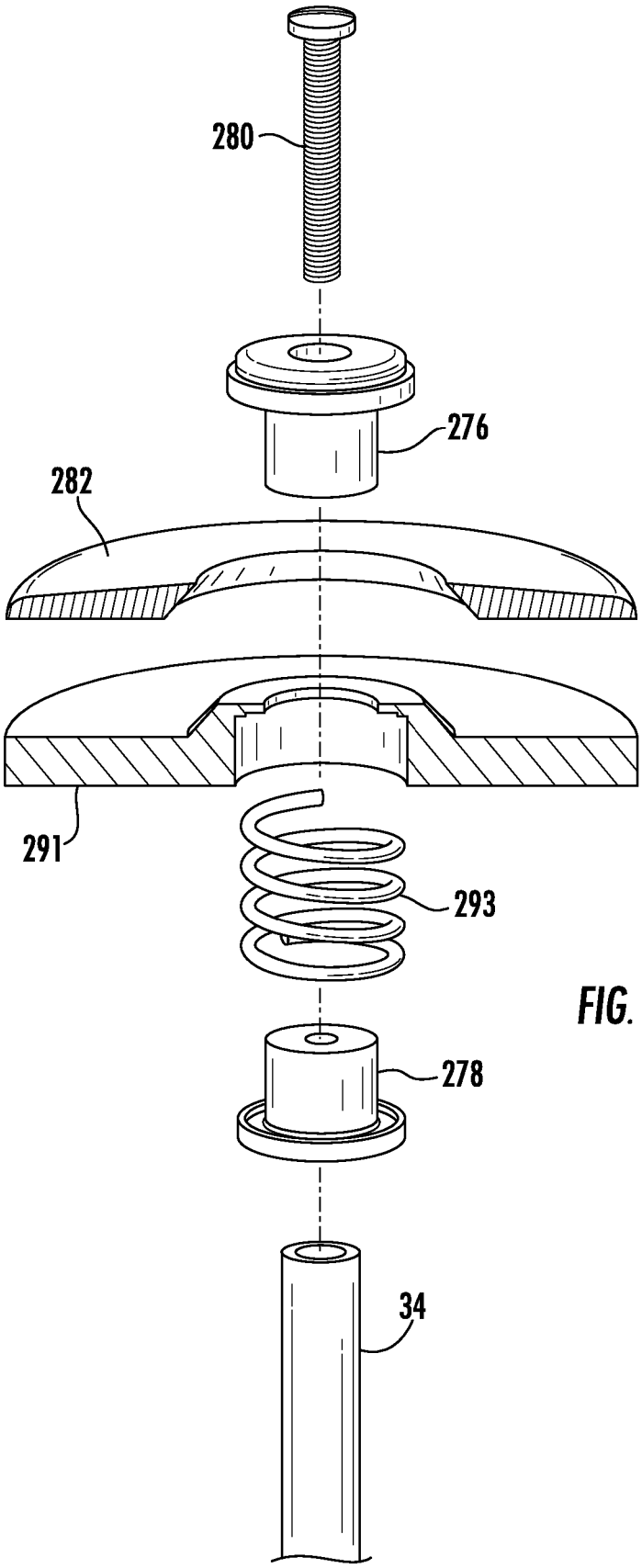
FIG. 59 is an exploded perspective cut-away view of a portion of a packaging system with a segmented pusher plate.

In some embodiments, the segmented pusher plate 290 can be arranged so that, when inner plate segment 292 is in a retracted position, as shown in FIGS. 53A and 54A, the downstream surface of inner plate segment 292 is not in substantially the same plane as the downstream surface of outer plate segment 291. In other embodiments, the segmented pusher plate 290 can be arranged so that, when inner plate segment 292 is in a retracted position, as shown in FIG. 55A, the downstream surface of inner plate segment 292 is in substantially the same plane as the downstream surface of outer plate segment 291.

Although the segmented pusher plate 290 is shown in one embodiment as having an outer plate segment 291, an inner plate segment 292, and a biasing member 293, in yet another alternative embodiment, a segmented pusher plate can comprise more than two segments, for example a multisegmented pusher plate having an outer plate segment, an inner plate segment, and an intermediate plate segment, wherein the intermediate plate segment is disposed between the outer and inner plate segments, and the respective plate segments are concentrically arranged, either within a single plane or within multiple planes. In such an embodiment, a first biasing member can regulate the relative axial movement of the outer and intermediate plate segments, and a second biasing member can regulate the relative axial movement of the intermediate and inner plate segments, in a telescoping coaxial configuration.

Another alternative embodiment to the pusher plate 90 described above, is a composite pusher plate 390 (see FIG. 60) that includes a rigid plate component 391, and an elastomeric plate component 392 attached to the rigid plate component. Plate component 391 is in one embodiment made from a rigid material such as a metal or metal alloy, or a hard, rigid plastic. It will typically have substantially the same geometry, although not necessarily the same thickness, as pusher plate 90 shown e.g. in FIGS. 24 and 45. Plate component 392 is in one embodiment made from an elastomeric material that will under load exhibit a certain degree of flexibility, but return to its original position when the load is removed. Plate component 392 in one embodiment has a concave configuration on its downstream surface, i.e. on the surface of plate component 392 that faces the first end of container 40. This concavity can be in the form of a curved surface, or as shown in FIG. 60, in the form of a beveled surface having one or more planar portions, where the depth or thickness of the plate component 392 is greater along the outside circumference of the plate component than at its center. Thus, the change in thickness of the plate component, moving from the outside edge of the plate component 392 to the radial center of plate component 392 can be linear or non-linear. An advantage of the configuration of composite pusher plate 390 is to distribute the load forces on package 50 such that product 80 inside pouch 60 will tend to move toward the longitudinal center axis of the dispensing system, that is, towards the pouch spout, to expedite dispensing of product out of the pouch. Rigid plate component 391 and an elastomeric plate component 392 can be attached to each other by any suitable means, including a mechanical or chemical bond or seal, using for example an adhesive.

In another embodiment, a pusher plate system can be used similar to composite pusher plate 390 (see FIG. 60) that includes a rigid plate component 391, but in which the elastomeric plate component 392 does not have a concave profile, but instead has two major surfaces that are each substantially planar. In one embodiment, the elastomeric plate component 392 can have an annular or circumferential bead or protrusion along the outside cylindrical periphery of the component, the bead disposed on the downstream surface of plate component 392, i.e. on the surface of plate component 392 that faces the first end of container 40.

In both this and the other described alternative embodiments of a composite pusher plate, the rigid component 391 and the elastomeric component 392 can be attached at their mating surfaces by any suitable means, including a mechanical means such as an external coaxial screw or bolt that holds the rigid and elastomeric components together, or a chemical bond or seal, or using for example an adhesive.

Figure 24:
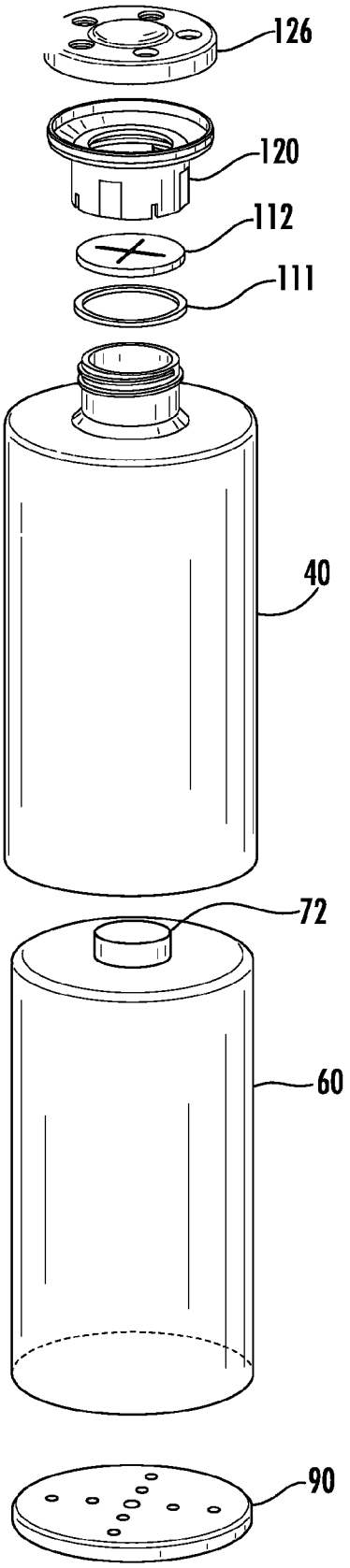
FIG. 24 is an exploded view of a packaging system.
Figure 25:
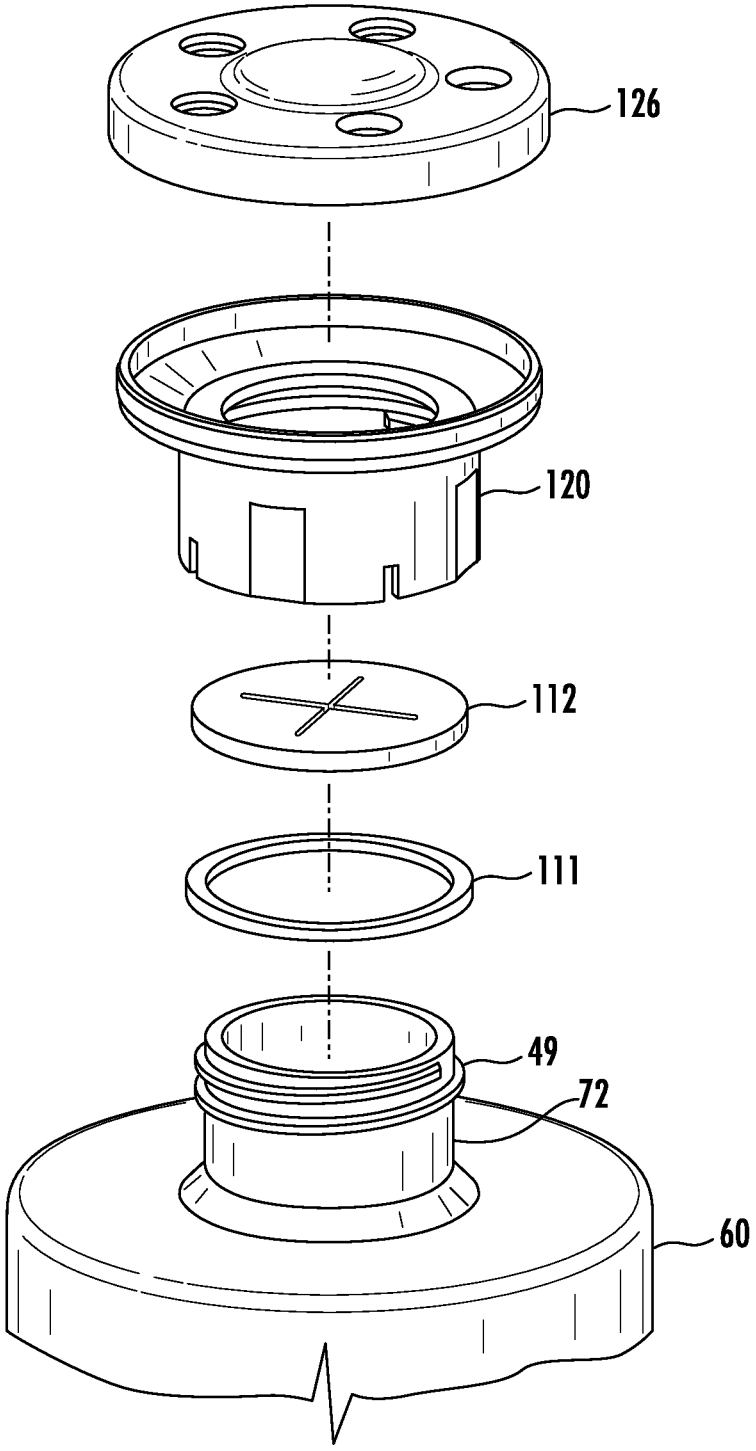
FIG. 25 is an exploded view of a portion of a packaging system.
Figure 45:
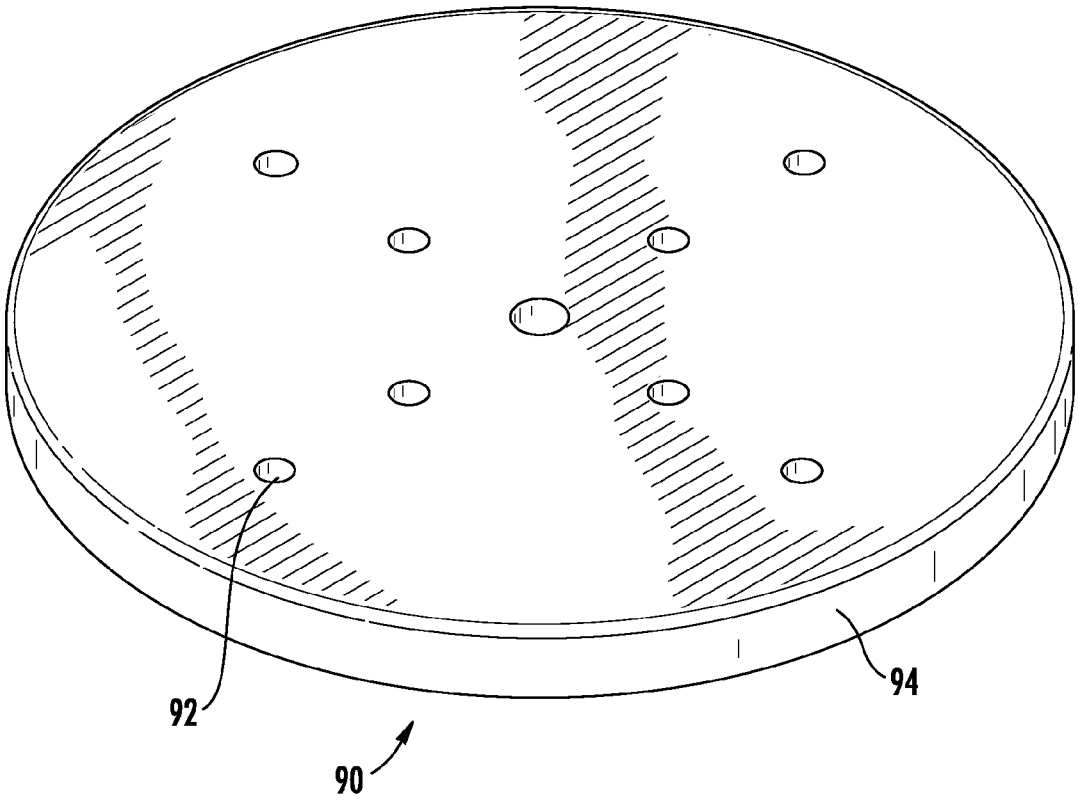
FIG. 45 is a perspective view of a pusher plate.

Also, in both this and the other described alternative embodiments of a composite pusher plate, the rigid component 391 and the elastomeric component 392 can typically have substantially the same geometry, although not necessarily the same thickness, as pusher plate 90 shown e.g. in FIGS. 24 and 45. Alternatively, the elastomeric plate component can have a slightly larger OD (outside diameter) than the rigid plate component.

Yet another alternative embodiment to the pusher plate 90 described above, is a segmented composite pusher plate 351 (see FIG. 61) that includes a rigid plate component comprising an outer rigid plate segment 352 and an inner rigid plate segment 353; and an elastomeric plate component 355 attached to the rigid plate component. Plate segments 352 and 353 are in one embodiment made from a rigid material such as a metal or metal alloy, or a hard, rigid plastic. Elastomeric plate component 355 is in one embodiment made from an elastomeric material that will under load exhibit a certain degree of flexibility, but return to its original position when the load is removed, and in one embodiment has a concave configuration on its downstream surface, i.e. on the surface of plate component 355 that faces the first end of container 40. This concavity can be in the form of a curved surface, or a beveled surface having one or more planar portions, where the depth or thickness of the plate component 355 is greater along the outside circumference of the plate component than at its center. In another embodiment, the elastomeric plate component 355 can be substantially planar on both major surfaces, and optionally can include a circumferential bead or protrusion as described above on its downstream surface.

Thus, the pusher plate 351 of FIG. 61 is in at least one respect like pusher plate 290 of FIGS. 53A through 59, in that the pusher plate has a segmented outer and inner portion. Pusher plate 351 of FIG. 61 is in at least one respect like pusher plate 390 of FIG. 60, in that the pusher plate has a rigid and an elastomeric portion. One advantage of the embodiment of FIG. 61 is that no separate biasing member, such as a spring, is needed, since a load force put on piston rod 34 pushes inner rigid plate segment 353 up against the central portion of elastomeric plate component 355, tending to move plate component 355 downstream, assisting in removal of much of the remaining product 80 inside pouch 60. The concavity of elastomeric plate component 355 can provide the same beneficial effect in distributing the load forces on package 50, as described above for the embodiment of FIG. 60. Outer and inner rigid plate segments 352 and 353 and an elastomeric plate component 355 can be attached to each other by any suitable means, including a mechanical or chemical bond or seal, using for example an adhesive; or as shown in FIG. 61, by an interlocking joint 356 including a groove in each of plate segments 352 and 353, and a mating fastener in preselected portions of plate component 355. Of course, the inverse could also accomplish the same attachment, i.e. a groove present in preselected portions of plate component 355, and a mating fastener in each of plate segments 352 and 353. In another alternative embodiment, plate segments 352 and 353, and an elastomeric plate component 355 can be comolded.

IV. Dispensing Gun System 130

The dispensing gun system 130 includes a dispensing gun 30, a cylindrical container 40, a cylindrical pusher plate 90, and a package 50 disposed within the container.

Figure 1B:
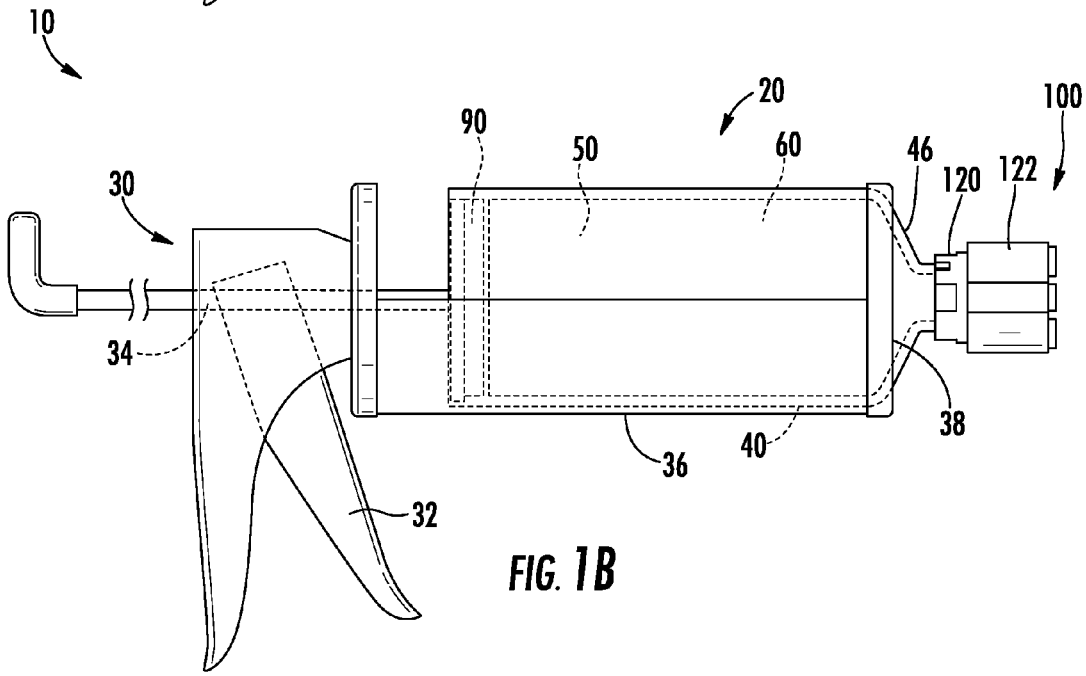
Figure 2:
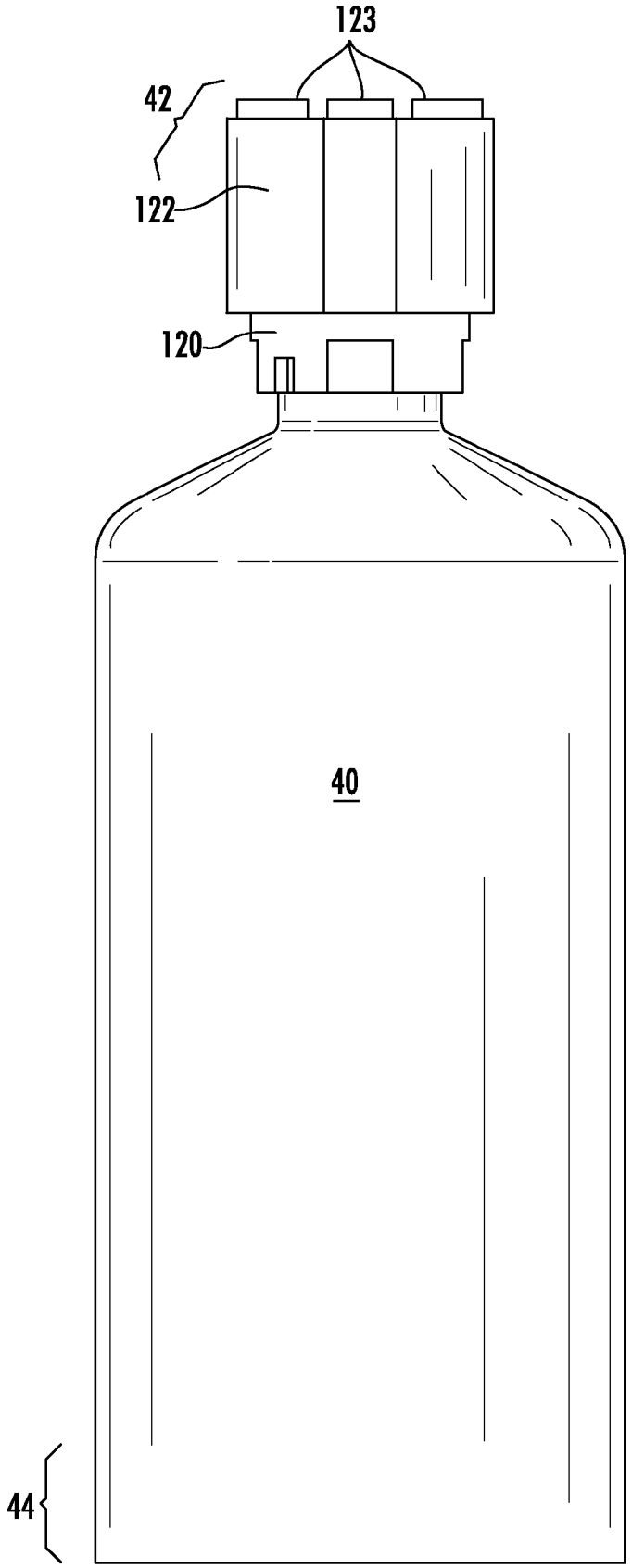
FIG. 2 is a front elevation view of a packaging system.
Figure 3:
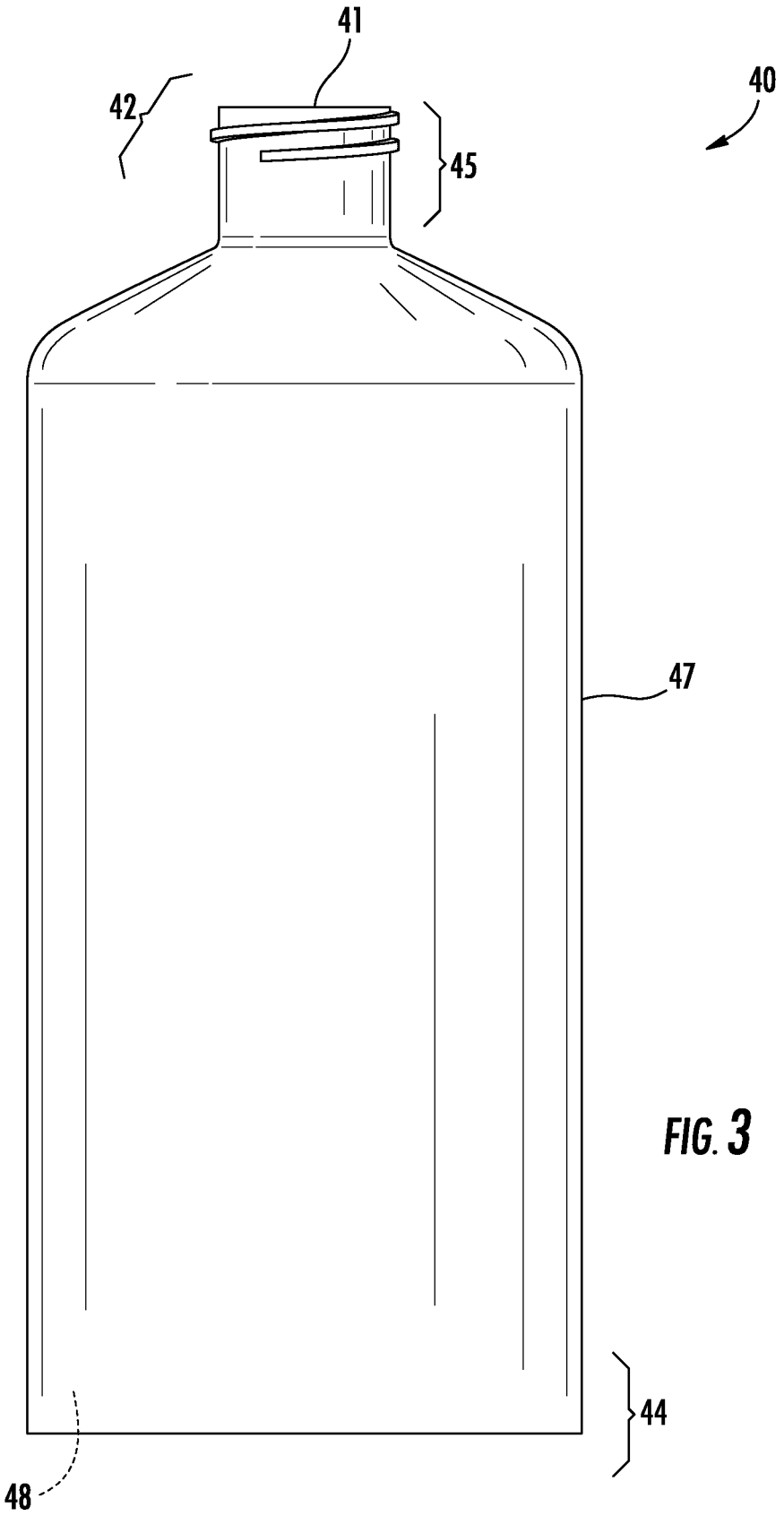
FIG. 3 is a front elevation view of a container.
Figure 4:
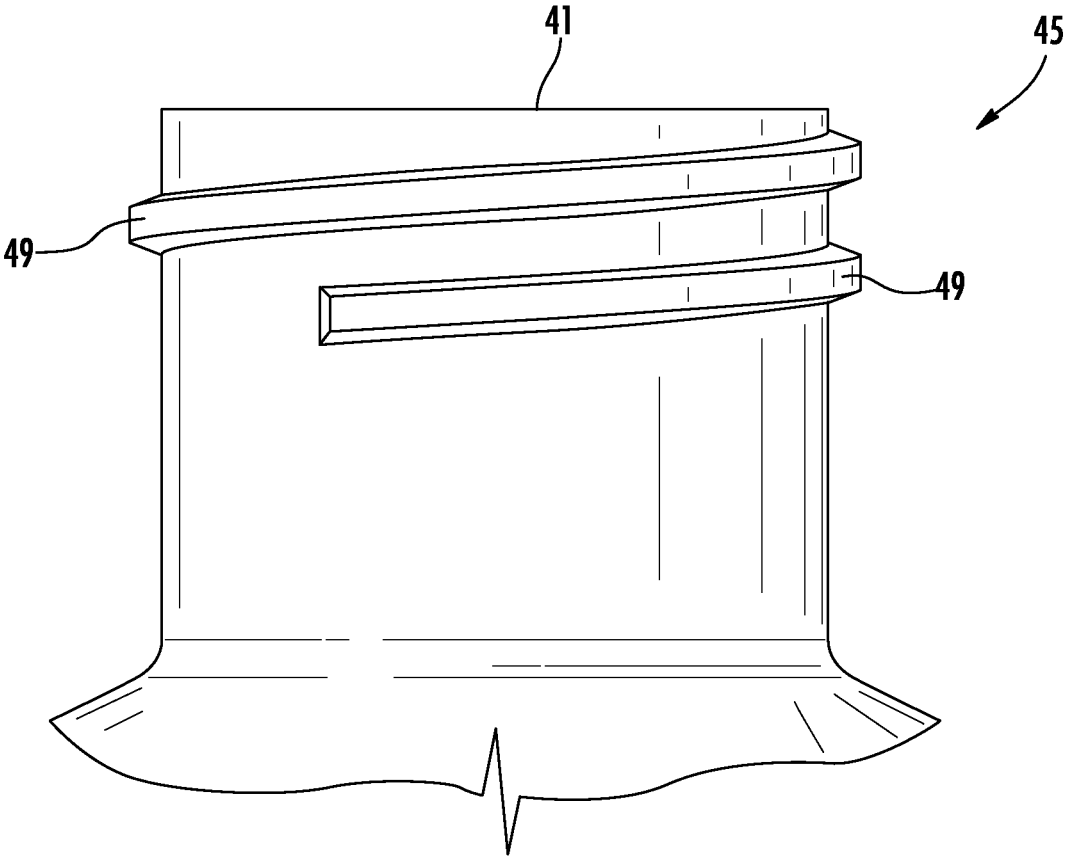
FIG. 4 is a sectional view of the neck of the container of FIG. 3.

Dispensing gun 30 can comprise any apparatus that comprises a component of the disclosed dispensing system 10, and/or functions in cooperation with the disclosed packaging system 20, to dispense a product; as disclosed for example in U.S. Pat. Nos. 4,681,524; 5,211,311; 5,242,115; 5,462,204; 5,589,226; 5,812,355; and 5,875,922, the entire contents of which patents are hereby incorporated by reference herein. Dispensing gun 30 will typically comprise a mechanical device that can accommodate a packaging system as described herein, and can effect movement of a flowable product, contained in a flexible package, out of the package, through a dispensing valve, and onto an area. As shown in FIGS. 1*a* and 1*b*, the dispensing gun in one embodiment includes a trigger 32 to activate the dispensing system 10; a piston 34 to drive pusher plate 90 through the container 40 and thus push the flexible package 50 toward the first end 42 of the container; a barrel 36 to house packaging system 20; and a wall 38 against which the container 40 of packaging system 20 can abut.

The cylindrical pusher plate 90, is configured, when advanced by the piston into the container, to fit within the container in close proximity to the interior surface of the container. In one embodiment, the space between the annular outside edge of the pusher plate and the interior surface of the container, as the pusher plate passes through the interior of the container, is less than three times the thickness of the film thickness of the package; such as less than two times the film thickness of the package.

V. Assembly of Packaging System 20

Figure 20:
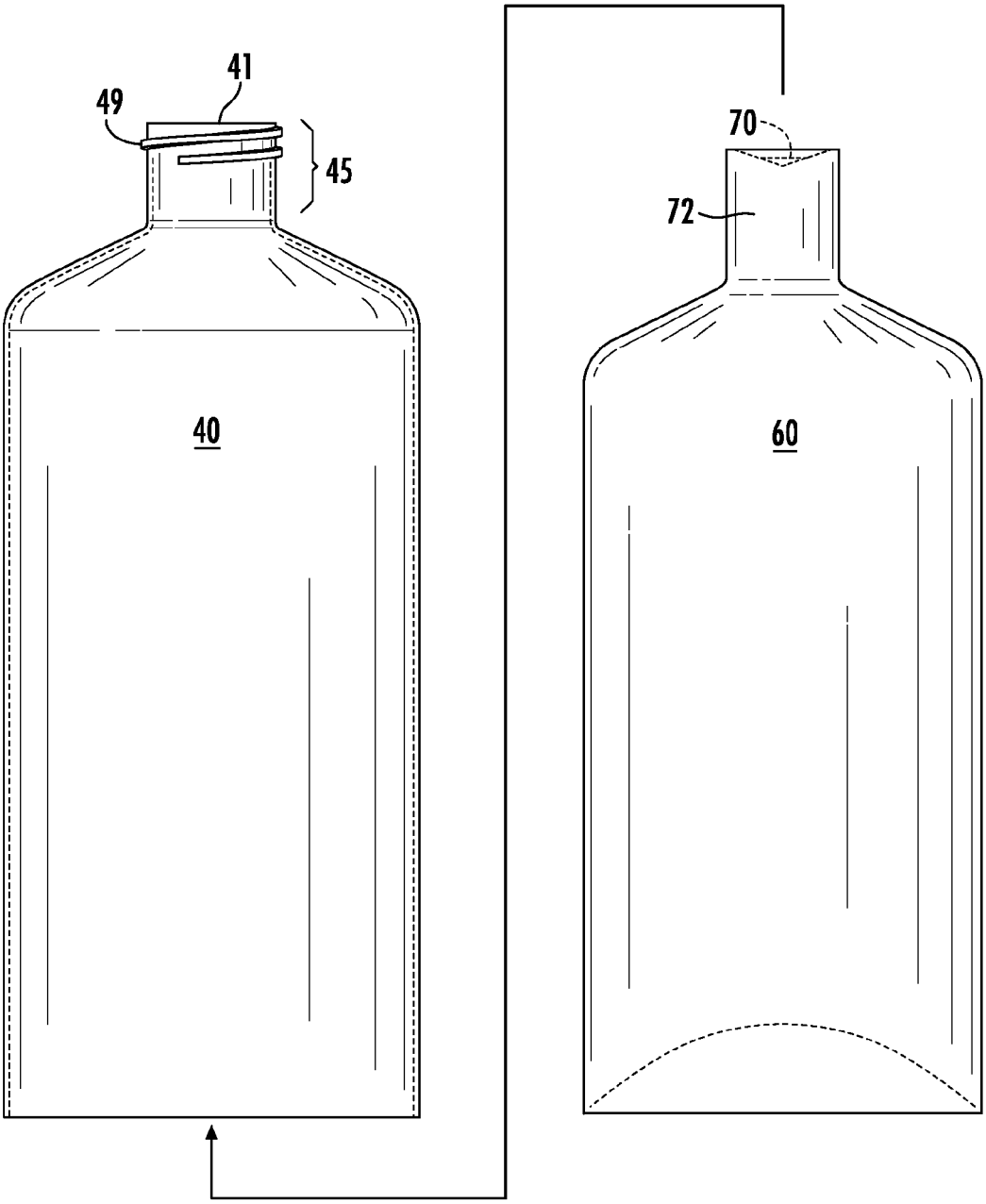
FIGS. 20 to 23 are perspective views of the steps of assembling a packaging system.
Figure 21:
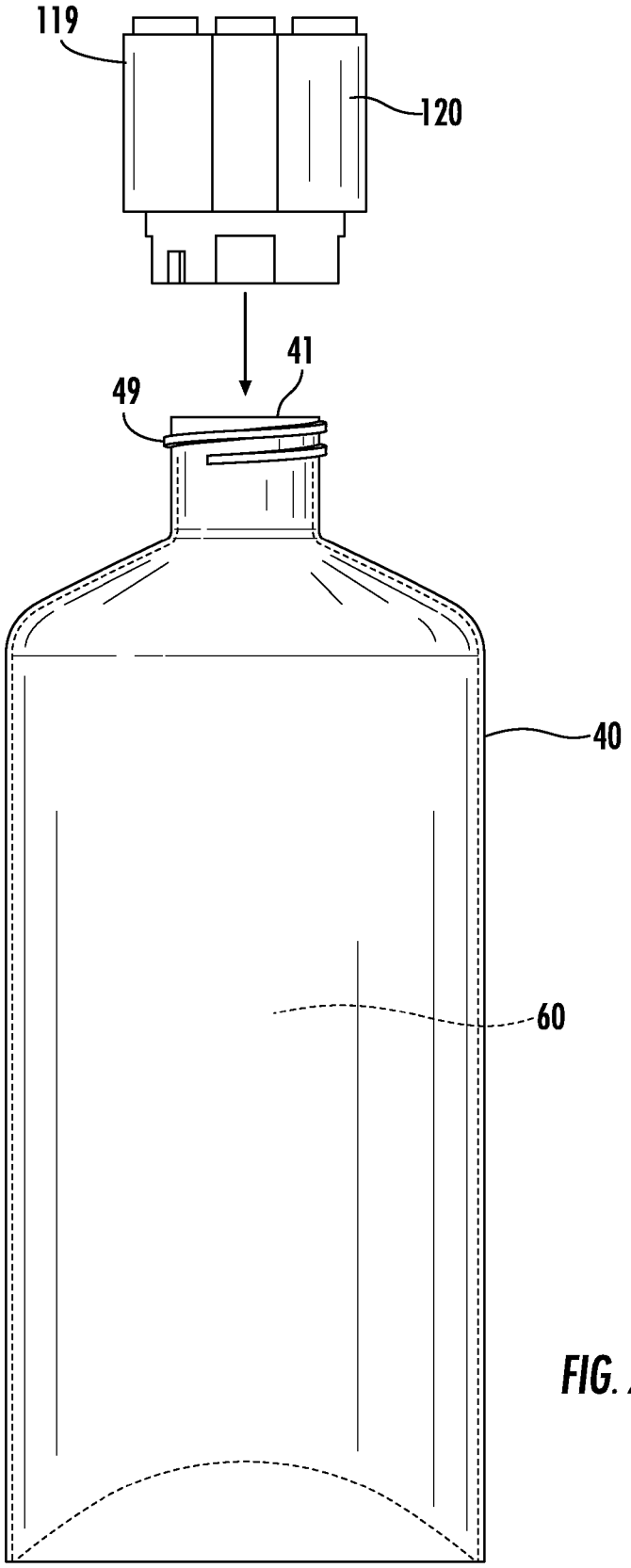
Figure 22:
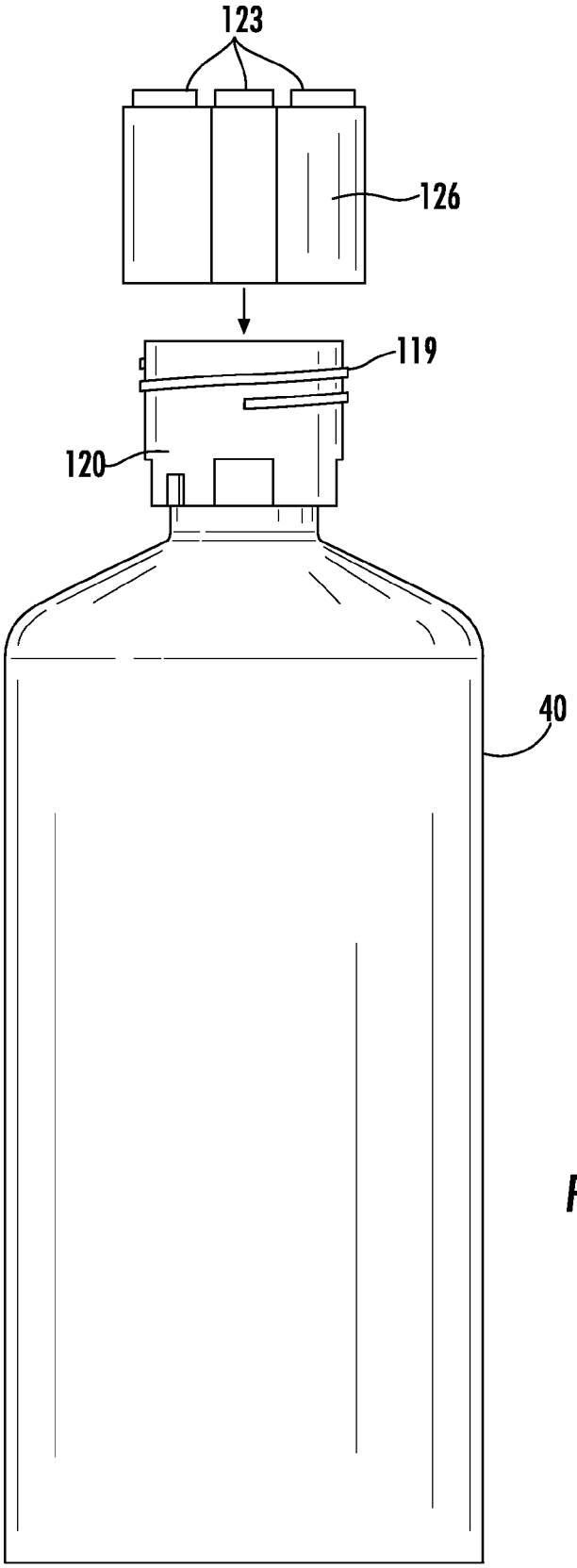
Figure 23:
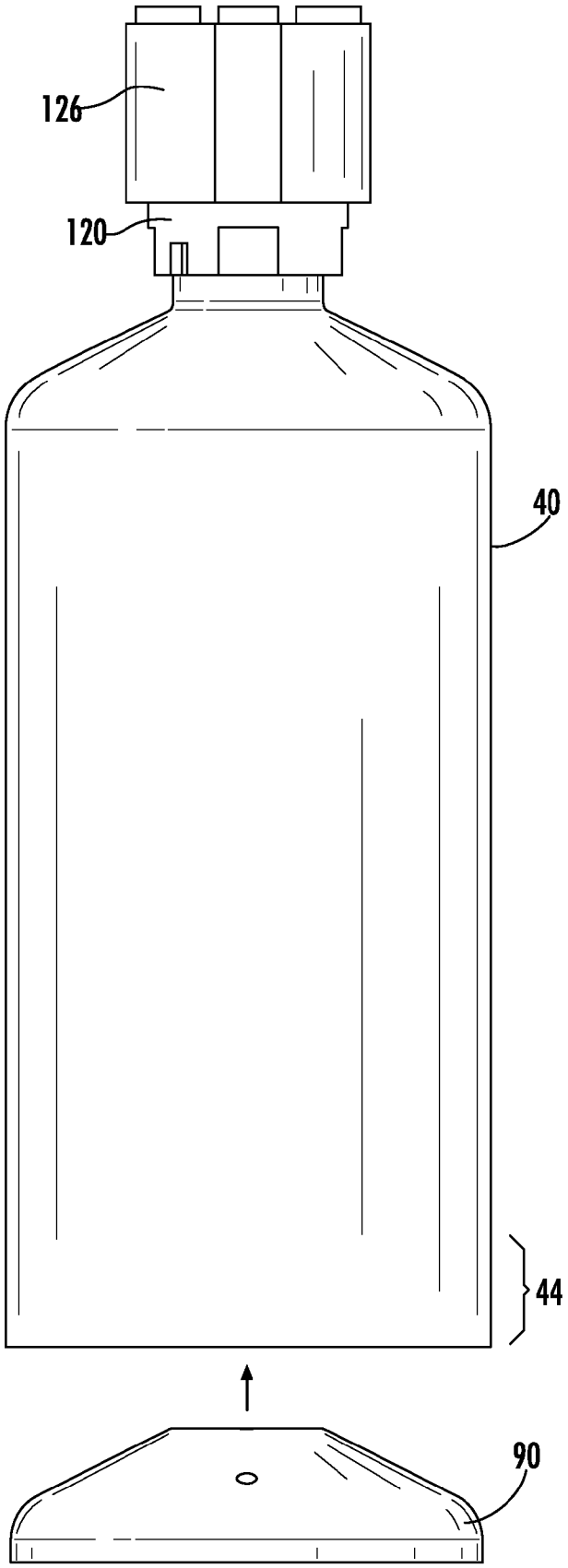
Figure 36:
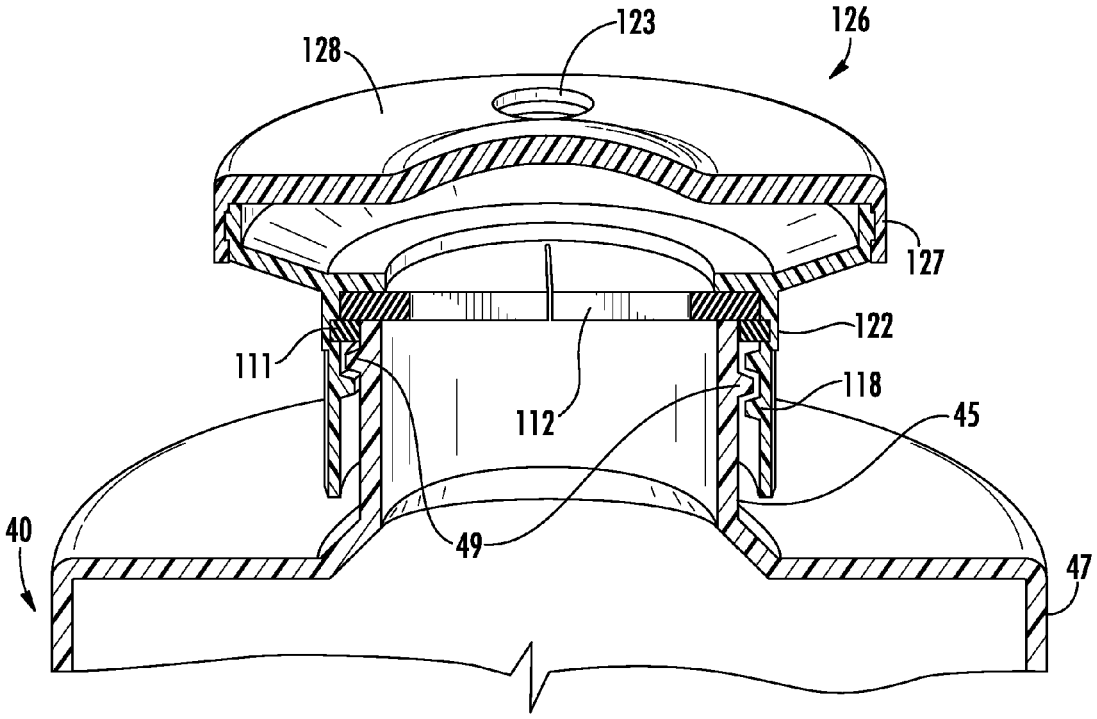
FIG. 36 is a perspective fragmentary cross-sectional view of a portion of a packaging system.
Figure 37:
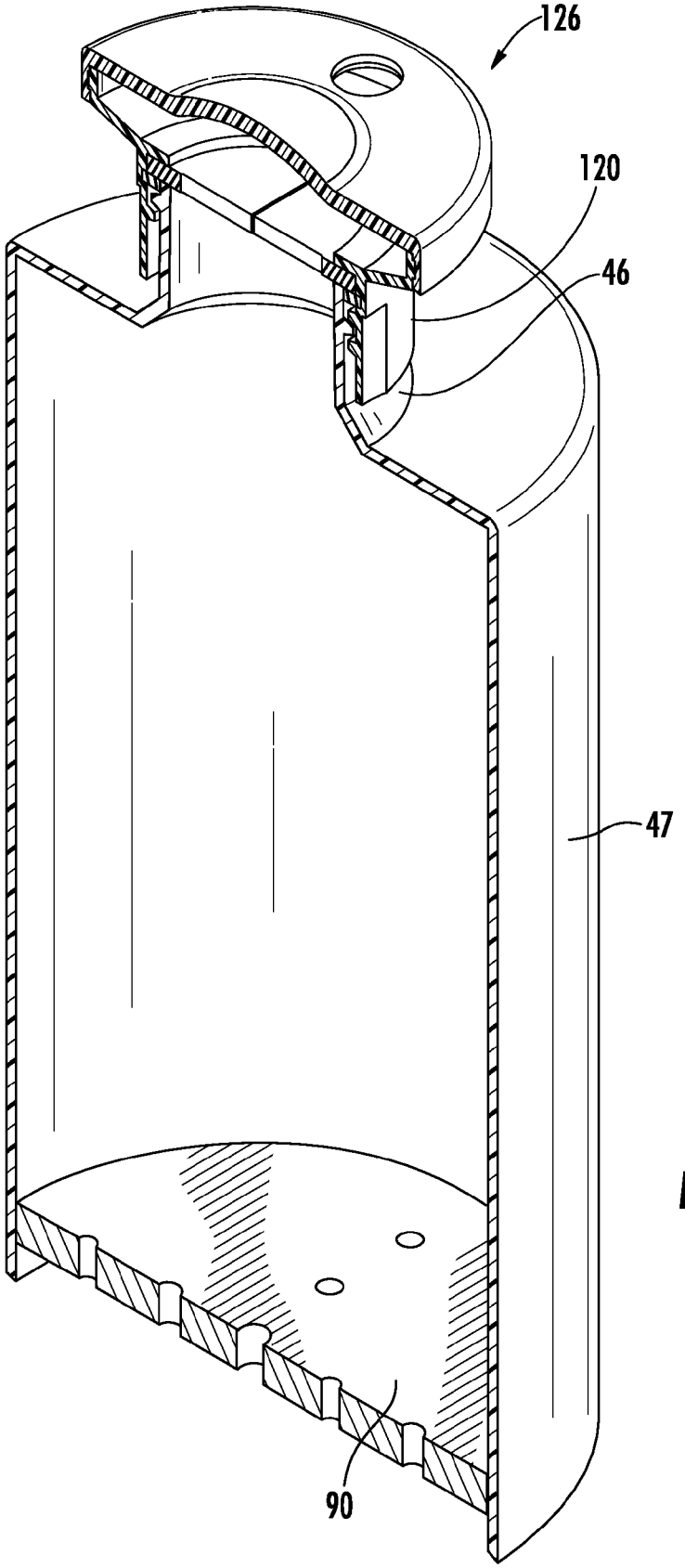
FIG. 37 is a perspective cross-sectional view of a portion of a packaging system.
Figure 38:
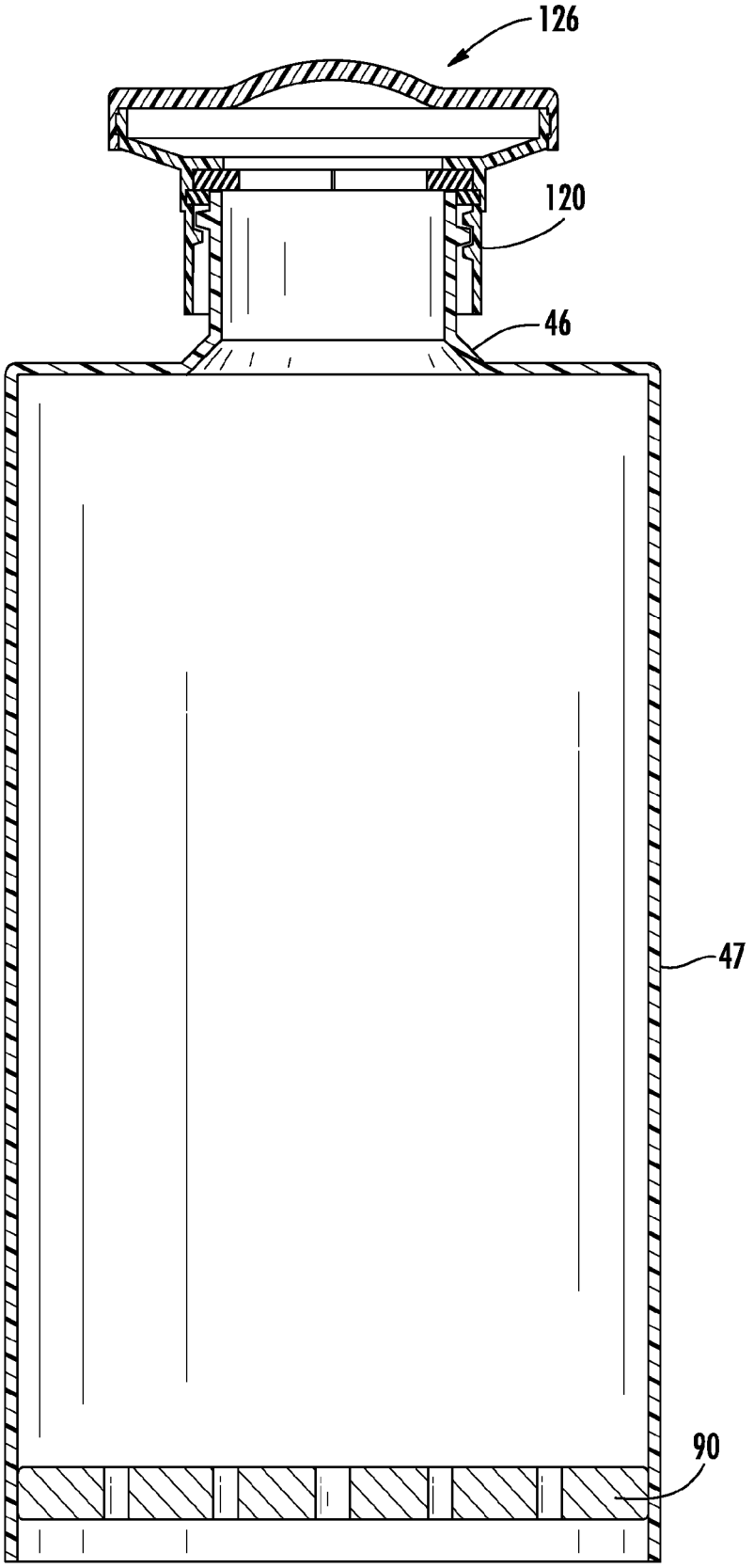
FIG. 38 is an elevational cross-sectional view of a packaging system.
Figure 39:
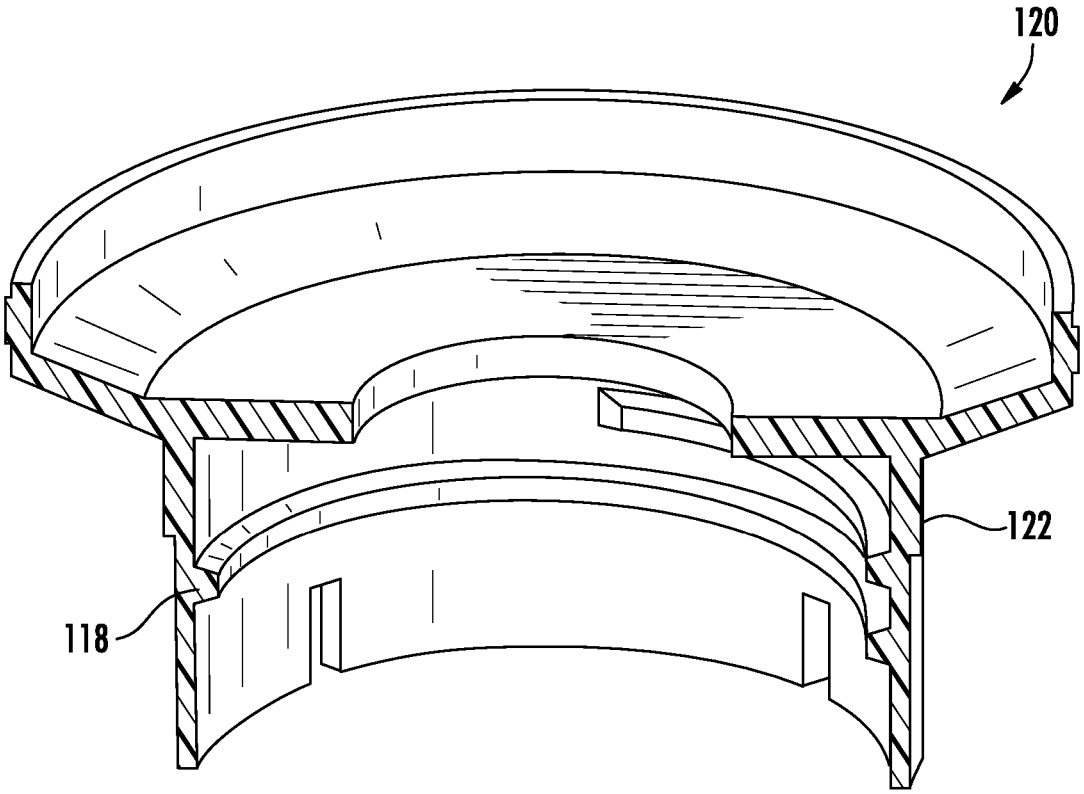
FIG. 39 is a perspective cross-sectional view of a portion of a dispensing assembly.
Figure 40:
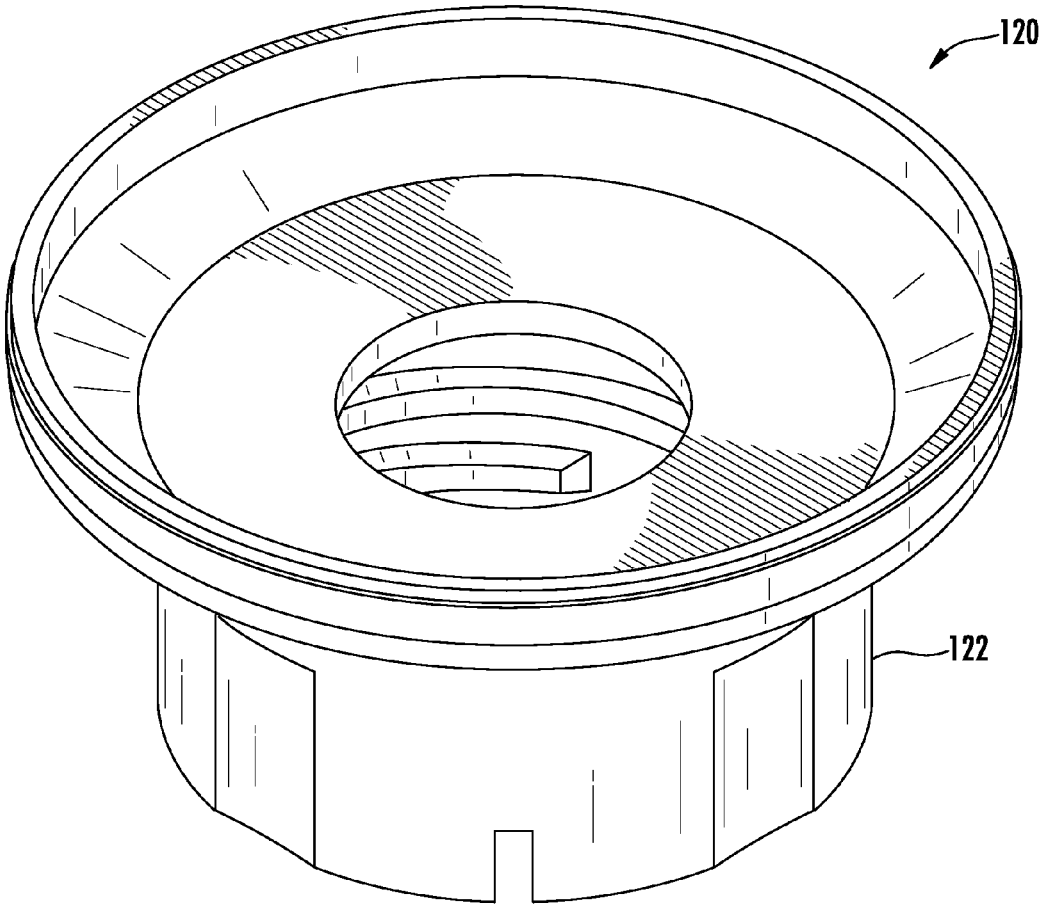
FIG. 40 is a perspective view of a portion of a dispensing assembly.
Figure 41:
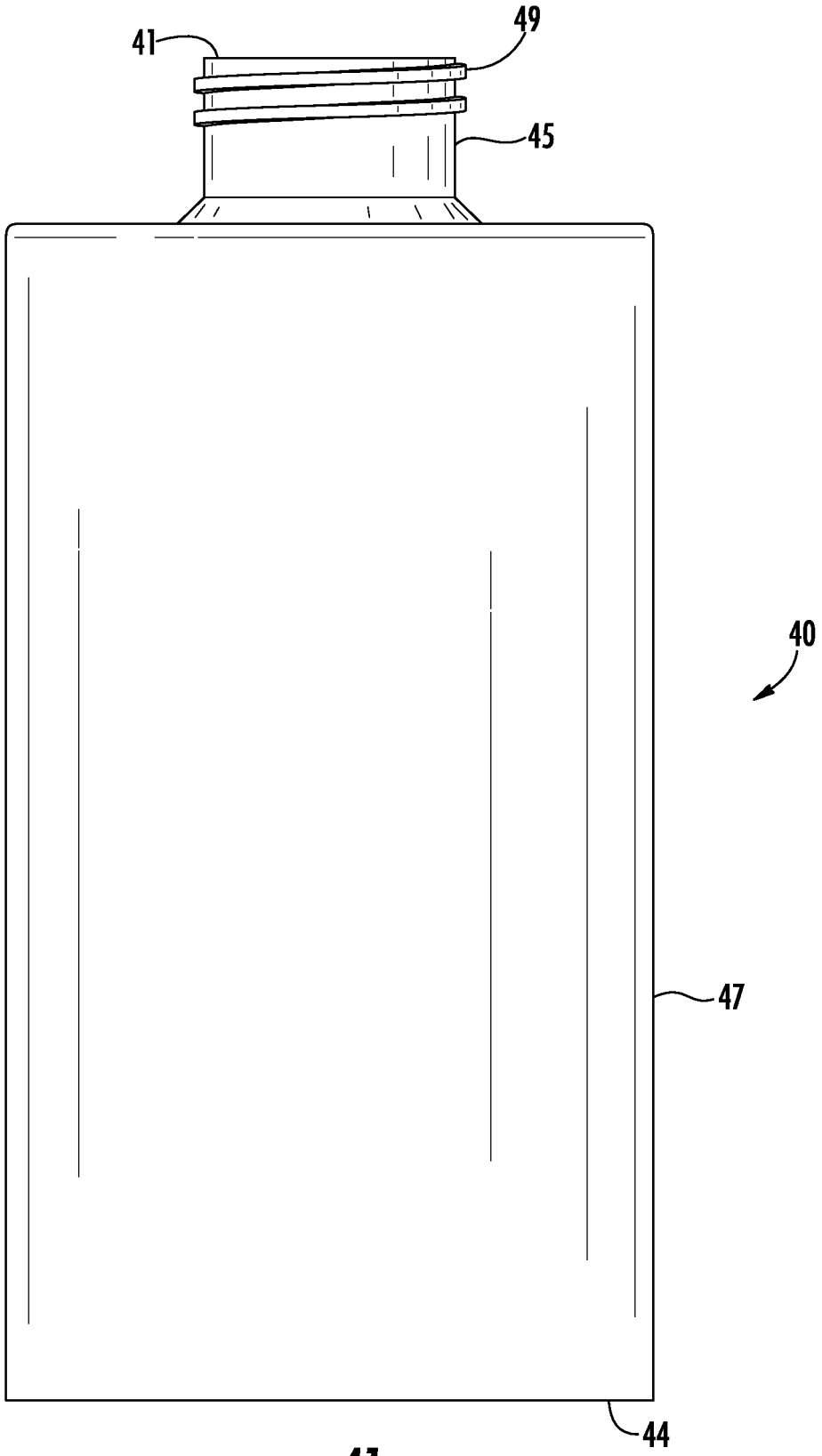
FIG. 41 is an elevational view of a container.
Figure 42:
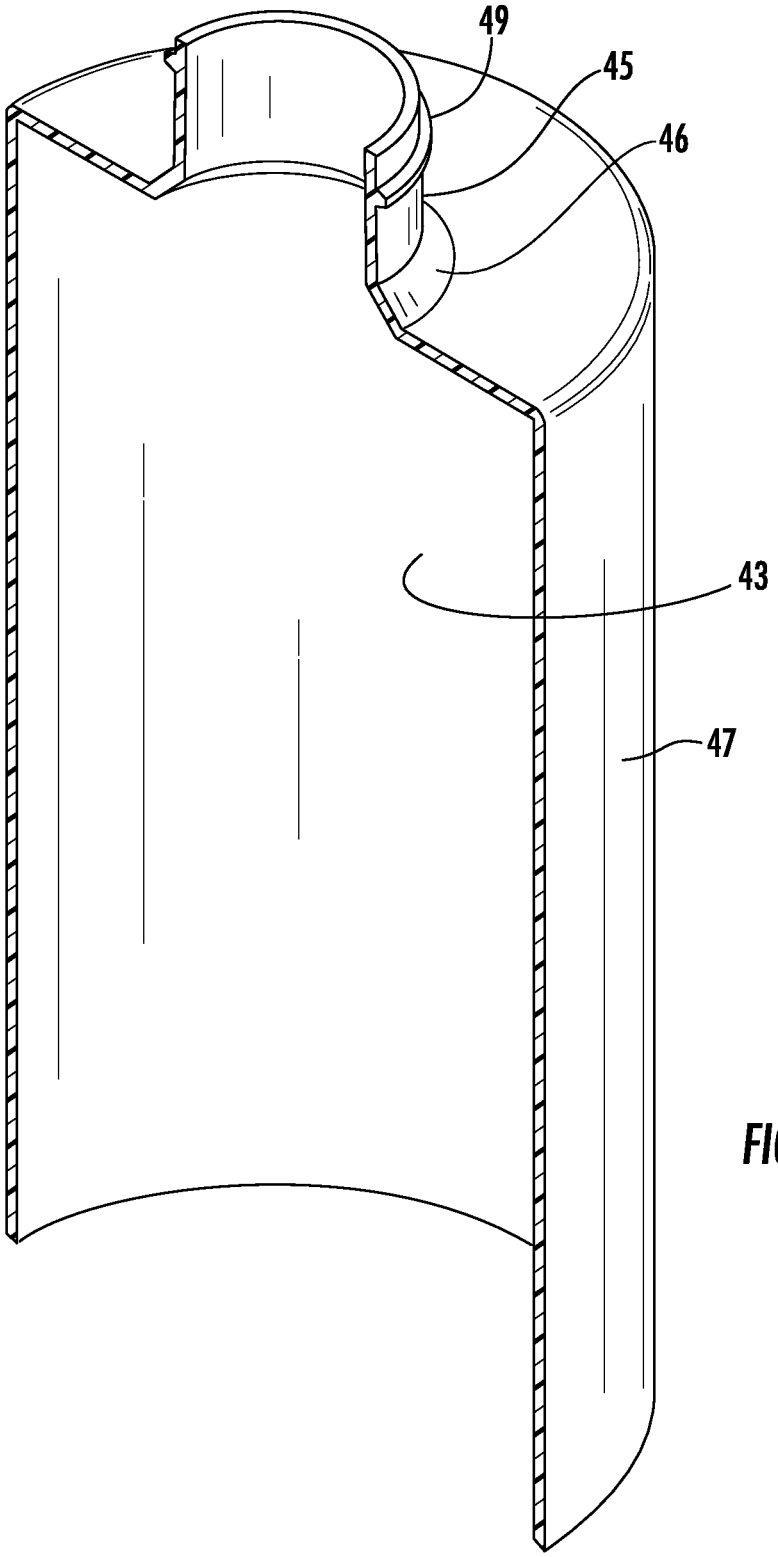
FIG. 42 is a perspective cross-sectional view of a container.
Figure 43:
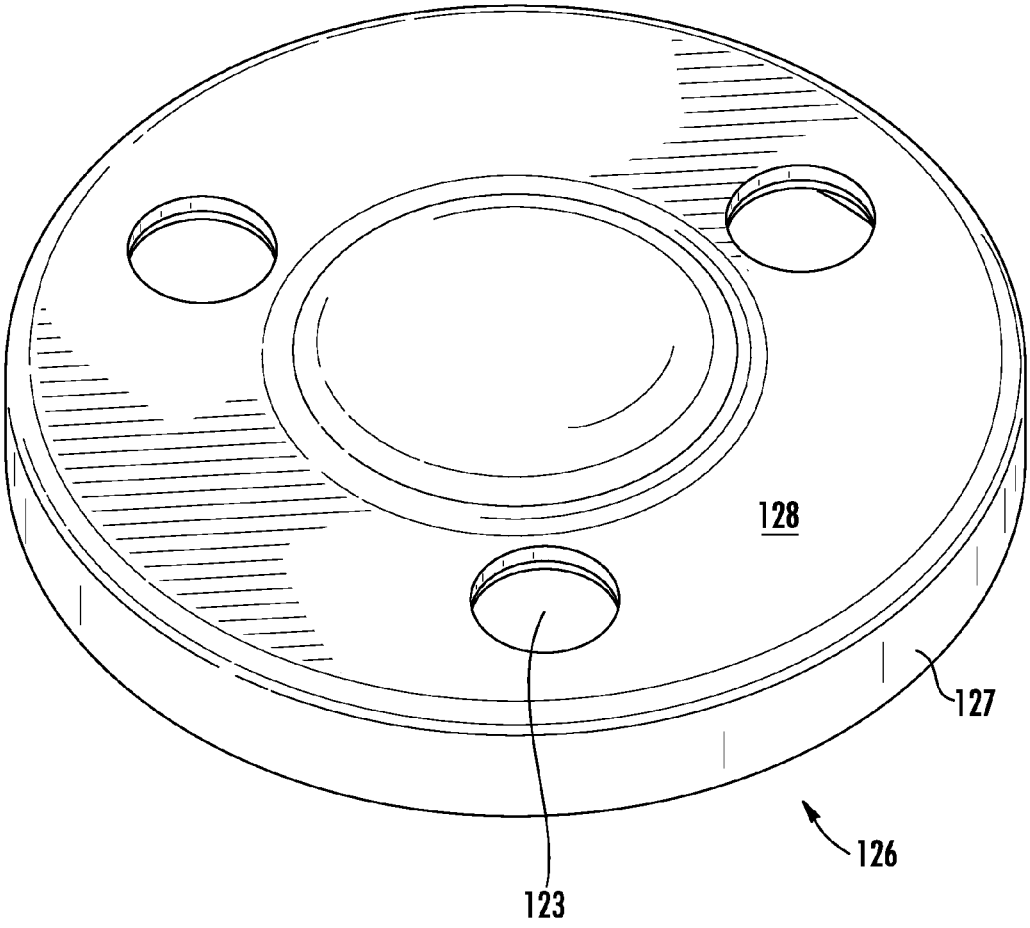
FIG. 43 is a perspective view of a diffuser.

As a first step, package 50, including a sealed pouch 60 containing product 80, can be inserted into the interior of container 40 through second end 44 such that the pouch spout 72 is positioned in container neck 45, as illustrated in FIG. 20. Valve housing 120 is then seated flush atop the container mouth 41. In some embodiments, valve housing 120 includes interior screw threads 118 that align with threads 49 on the neck of container 40 to allow coupling of the valve housing and the container, as depicted in FIGS. 21 and 36. Diffuser 126 can then be releasably or permanently attached to the distal end of the valve housing (the end furthest from the container 40) by aligning the diffuser internal threads 129 with the valve housing external threads 119, as shown in FIG. 22. Alternatively, diffuser 126 can be snap fit in a releasable or permanent arrangement onto valve housing 120. Pusher plate 90 (if present as part of the packaging assembly) can then be inserted within the interior of container 40 at second end 44, as shown in FIG. 23. Alternatively or additionally, the pusher plate can be a component of a dispensing gun as described herein.

It should be appreciated that the methods used to assemble packaging system 20 disclosed above are not limited and can performed in any suitable order. In some embodiments, the packaging system can be partially or fully pre-assembled such that a user need not perform all of the steps described herein.

VI. Methods of Using Dispensing System 10

After assembly, packaging system 20 can be inserted into a dispensing gun 30, as shown in FIGS. 1*a* and 1*b*. In some embodiments, dispensing gun 30 can be of the type that dispenses a portion of the contents of pouch 60 upon each actuation. To this end, dispensing gun 30 can include trigger 32 that forms part of an actuating structure. Specifically, trigger 32 can be coupled to piston 34 that is movable within the interior of container 40 via contact with pusher plate 90. The actuating structure functions such that upon each movement of trigger 32, the piston 34 moves towards first end 42 of the container 40, and a bias spring returns the trigger to its original position. In some embodiments, dispensing gun 30 includes wall 38 that is configured to abut against the front end of system 20 (i.e. the first end 42 of container 40) so that pressure applied by the trigger 32 is effective to dispense product 80. Packaging system 20 can be used with any of a variety of dispensing guns known in the art. See, for example, U.S. Pat. Nos. 3,687,370; 3,945,569; 4,681,524; 5,462,204; 5,812,355; 5,875,922; 6,286,718; 6,454,138; 6,533,187; 6,691,899; and 7,011,238, the entire contents of which are hereby incorporated by reference.

To dispense product 80 disposed within pouch 60, a user can initiate trigger 32 on the dispensing gun 30. When trigger 32 is pulled, piston 34 advances pusher plate 90 within the interior of container 40 toward first end 42. Such movement reduces the volume of pouch 60, thereby collapsing the pouch and increasing the pouch internal pressure. As a result, frangible seal 70 ruptures, allowing product 80 to exit the pouch through spout 72 and passageway 114 of valve 112 of valve housing 120. Product then passes through diffuser 126 and out of system 20 through outlets 123. In this way, product can be dispensed in a desired pattern associated with the outlets in the diffuser. For example, a diffuser with three exit outlets 123 will allow dispensing of three areas of product. Once the trigger has been pulled, a metered dose of product is dispensed and the diffuser and valve housing prevent any substantial leakage of product.

Piston 34 will continue to move towards the second end 44 of container 40 with continued application of pressure (i.e., each pull of trigger 32), thereby dispensing product 80. When pusher plate 90 has reached an abutting position with container shoulders 46, the mating relationship ensures that a maximum amount of product housed within pouch 60 has been dispensed. System 20 can then be removed from dispensing gun 30 and replaced with a new system. As set forth above, in some embodiments, container 40, valve housing 120, diffuser 126, and/or pusher plate 90 can be used repeatedly such that only pouch 60 is replaced.

VII. Advantages of Some Embodiments of the Present Invention

In some embodiments, the invention lowers costs associated with materials and assembly and with sufficient ruggedness to survive filling, closing, packing and shipping.

System 20 and/or pouch 60 can also be economically disposed of after a single use, or after the pouch contents have been dispensed.

The pouch is flexible, reducing storage space needed to house the pouch prior to use. Similarly, the space needed to ship the pouch is less than other alternatives. Further, the flexible pouch requires less space (in trash and in landfills) at the time of disposal.

In addition, pouch 60 is constructed to be substantially free of voids and to have suitable mechanical integrity and flexibility. As a result, the pouch can withstand high pressure treatment, such as can be used to reduce unwanted microorganisms in the packaged product.

The package further allows the dispensing of multiple doses of product in each dispensing application. For example, a package that includes a diffuser with five outlets will allow five spots of product to be dispensed with each pull of the dispensing gun trigger.

VIII. Statement of Embodiments of the Invention

The present application is directed in various embodiments to the subject matter described in the following paragraphs. These are alternative embodiments of any of the first (dispensing system), second (packaging system), third (package), fourth (dispensing assembly), fifth (dispensing gun system), sixth (method of making a package), seventh (method of dispensing a product), eighth (method of making a package), ninth (method of making a package), tenth (method of making a package), eleventh (method of making a package), twelfth (dispensing assembly), thirteenth (method of making a package), fourteenth (method of making a package), fifteenth (method of making a package), sixteenth (method of making a package), seventeenth (method of making a package), eighteenth (segmented pusher plate), nineteenth (cylindrical composite pusher plate), twentieth (package), and twenty first (pusher plate system) aspects of the invention as described hereinabove in the Summary of the Invention. For each aspect, these features can be incorporated alone or in any suitable combination of these features:

a) a pusher plate positioned either within the container interior, or in the dispensing gun, and adapted to movably close the first opening and effect dispensing of product.
b) the container comprises a rigid cylindrical container.
c) the container comprises a neck portion adapted to connect to a dispensing assembly.
d) the container comprises a neck portion adapted to house an exterior fastening member.
e) the fastening member of d) is selected from the group comprising: a location fit, a press fit, a screw thread, a twist lock, a tab, a slot, a snap fit, or combinations thereof.
f) the pouch comprises a flexible, thermoplastic pouch.
g) the pouch has an oxygen transmission rate of no more than 50 cc/m$^2$/24 hr. at 25° C., 0% RH, 1 atm in accordance with ASTM D 3985.
h) the pouch comprises a spout.
i) the frangible seal is positioned within the spout of h).
j) the frangible seal comprises a single label with a first face and a second face, the first face comprising a permanent sealant and the second face comprising a peelable sealant; or first and second labels, each label comprising a first face, wherein the first face of the first label comprises a permanent sealant positioned adjacent the pouch front sheet and wherein the first face of the second label comprises a permanent sealant positioned adjacent to the pouch rear sheet; and a second face, wherein the second face of the first label comprises a peelable sealant positioned adjacent to the second label second face, and/or wherein the second face of the second label comprises a peelable sealant positioned adjacent to the first label second face.
k) the permanent sealant is selected from the group comprising metallocene catalyzed polyethylene, Ziegler-Natta catalyzed linear low density polyethylene, propylene-ethylene copolymer, LDPE, ionomer resin, ethylene/vinyl acetate copolymers, ethylene/methyl methacrylate copolymers, ethylene/butyl acrylate copolymers, and combinations thereof.
l) the peelable sealant is selected from the group comprising: blends of polyethylene and polybutylene, polyethylene, polyethylene blends, random propylene/ethylene copolymer blends, EVA/polypropylene blends, LDPE/polypropylene blends, or combinations thereof.
m) the flowable product comprises a condiment.
n) the dispensing assembly comprises a valve, a valve housing that retains the valve, and a connecting portion that functionally cooperates with, and is in engagement with a container.
o) the valve is selected from the group comprising an umbrella valve, a duckbill valve, a reed valve, a ball valve, a flapper valve, a poppet valve, a Gott valve, a check valve, and combinations thereof.
p) the valve comprises four arms defined by a cross-cut in a central portion of the valve.
q) the dispensing assembly comprises a retainer adapted to secure the valve within the valve housing.
r) the retainer is selected from a retaining ring, a retaining clip, or a flange.
s) the valve housing comprises an interior surface and an exterior surface, at least one of which comprises a fastening member selected from the group comprising a location fit, a press fit, a screw thread, a twist lock, a tab, a slot, a snap fit, or combinations thereof.
t) the dispensing assembly further comprises a diffuser connected to the valve housing.
u) the diffuser of t) is connected to the valve housing with a snap fit.
v) the diffuser comprises two or more outlets.
w) a product is positioned within the interior of the pouch, wherein the product is a flowable food product.
x) the diffuser comprises an interior comprising a fastening member selected from the group comprising: a location fit, a press fit, a screw thread, a twist lock, a tab, a slot, a snap fit, or combinations thereof.
y) movement of the pusher plate is accomplished by displacing a dispensing gun trigger.
z) a metered volume of product is dispensed.
aa) the central seal segment intersected by the longitudinal axis of the pouch is a substantially linear segment arranged substantially perpendicular to the longitudinal axis of the pouch.
bb) the central seal segment is substantially "U" shaped.
cc) the dispensing gun comprises a barrel having a substantially hemispheric cross section.
dd) the dispensing gun comprises a piston and a trigger.
ee) the cylindrical pusher plate is configured, when advanced by the piston into the container, to fit within the container in close proximity to the interior surface of the container, with a gap between the outside diameter of the pusher plate and the interior surface of the container, of between 0.05 mm and 1 mm.
ff) the cylindrical pusher plate comprises a first and second planar surface, the first and second planar surfaces substantially parallel to one another, a circumferential edge having a thickness "T", the circumferential edge normal to and joining the first and second planar surfaces, and a circumferential bevel located on the first planar surface and joining the first planar surface to the circumferential edge.

gg) movement of the pusher plate is accomplished by displacing a dispensing gun trigger.
hh) a metered volume of product is dispensed.
ii) the container comprises an interior surface having a low COF.
jj) the container comprises an interior surface that exhibits a COF of between 0.05 and 0.5.

kk) the film comprises an exterior surface having a low COF.

ll) the film comprises an exterior surface that exhibits a COF of between 0.05 and 0.5.

mm) the valve housing comprises interior and exterior surfaces that each comprise a fastening member selected from the group comprising: a location fit, a press fit, a screw thread, a twist lock, a tab, a slot, a snap fit, or combinations thereof.

nn) the valve housing is positioned proximate to the second opening.

oo) the label includes a peelable interface selected from a peelable sealant, or a printed area on a surface of the film strip that when sealed to the film web, results in a peelable surface.

pp) the label includes a peelable interface selected from a printed area comprising an antifog material.

qq) in a vertical form/fill/seal process, a lay-flat web is selectively treated by any of printing a selective area of the lay-flat web or folded web with a material that lowers the seal strength of the selected area; cross-linking a selective area of the lay-flat web or folded web to lower the seal strength of the selected area; and/or applying an adhesive on a selective area of the lay-flat web or folded web that lowers the seal strength of the selected area.

rr) in a dispensing assembly, a valve lies in juxtaposed relation to the outlet;

ss) in a dispensing assembly, a single disc, juxtaposed adjacent the diffuser, bears a valve.

tt) in a dispensing assembly, a single disc, juxtaposed adjacent the diffuser, bears a plurality of valves, each valve positioned adjacent a respective outlet.

uu) in a packaging system, a segmented pusher plate comprises an outer plate segment, an inner plate segment, and a biasing member, the outer and inner plate segments in a coaxial and concentric arrangement.

vv) in a packaging system, a composite pusher plate comprises a rigid plate component, and an elastomeric plate component attached to the rigid plate component, the elastomeric plate component having a concave configuration on the surface thereof furthest from the rigid plate component.

ww) in a packaging system, a composite pusher plate comprises a rigid plate component, and an elastomeric plate component attached to the rigid plate component, the elastomeric plate component having a concave configuration on the surface thereof furthest from the rigid plate component, and the rigid plate component comprising an outer rigid plate segment, and an inner rigid plate segment, wherein the outer and inner rigid plate segments are arranged in a coaxial configuration, and are concentrically arranged.

xx) the package comprises a contoured seal at the first and second ends of the package.

yy) the package comprises first and second transverse seals each comprising a skirt extending laterally from each side of the respective central seal segment.

zz) the package comprises a slit disposed in each skirt, and extending obliquely from the longitudinal end of each skirt to the respective contoured seal.

aaa) In a packaging system, a pusher plate system comprises a rigid plate component, and an elastomeric plate component, wherein the elastomeric plate component is disposed adjacent and in contacting relationship with the rigid plate.

bbb) In a packaging system of aaa), the elastomeric plate component comprises an annular protrusion along the outside cylindrical periphery of the component.

ccc) In a packaging system of aaa), the elastomeric plate component has an outside diameter greater than the outside diameter of the rigid plate component.

What is claimed is:

1. A packaging system comprising:

a) a container comprising first and second openings and an interior;

b) a package positioned within the container interior, the package comprising a pouch comprising a first and second panel with a frangible seal positioned between the panels, and a flowable product disposed in the pouch; and c) a dispensing assembly;

wherein the frangible seal comprises:

d) a single label with a first face and a second face, the first face comprising a permanent sealant and the second face comprising a peelable sealant; or e) first and second labels, each label comprising:

i) a first face, wherein the first face of the first label comprises a permanent sealant positioned adjacent the pouch front sheet and wherein the first face of the second label comprises a permanent sealant positioned adjacent to the pouch rear sheet; and ii) a second face, wherein the second face of the first label comprises a peelable sealant positioned adjacent to the second label second face, and/or wherein the second face of the second label comprises a peelable sealant positioned adjacent to the first label second face.

2. The packaging system of claim 1 further comprising a pusher plate positioned within the container interior and adapted to movably close the first opening and effect dispensing of product.

3. The packaging system of claim 1, wherein the container comprises a rigid cylindrical container.

4. The packaging system of claim 1, wherein the container comprises a neck portion adapted to connect to the dispensing assembly, the neck portion comprising a fastening member adapted to connect to the dispensing assembly, the fastening member selected from a location fit, a press fit, a screw thread, a twist lock, a tab, a slot, a snap fit, or a combination thereof.

5. The packaging system of claim 1, wherein the pouch comprises a flexible, thermoplastic pouch.

6. The packaging system of claim 1, wherein the pouch has an oxygen transmission rate of no more than 50 cc/m2/24 hr. at 25° C., 0% RH, 1 atm in accordance with ASTM D 3985.

7. The packaging system of claim 1, wherein the pouch comprises a spout, and the frangible seal is positioned within the spout.

8. The packaging system of claim 1, wherein the permanent sealant is selected from the group comprising metallocene catalyzed polyethylene, Ziegler-Natta catalyzed linear low density polyethylene, propylene-ethylene copolymer, LDPE, ionomer resin, ethylene/vinyl acetate copolymers, ethylene/methyl methacrylate copolymers, ethylene/butyl acrylate copolymers, and combinations thereof.

9. The packaging system of claim 1, wherein the peelable sealant is selected from the group comprising blends of polyethylene and polybutylene, polyethylene, polyethylene blends, random propylene/ethylene copolymer blends, EVA/polypropylene blends, LDPE/polypropylene blends, or combinations thereof.

10. The packaging system of claim 1, wherein the flowable product comprises a condiment.

11. The packaging system of claim 1, wherein the dispensing assembly comprises a) a valve, b) a valve housing, and c) a connecting portion that is in engagement with the container.

12. The packaging system of claim 11 wherein the valve is selected from the group comprising an umbrella valve, a duckbill valve, a reed valve, a ball valve, a flapper valve, a poppet valve, a Gott valve, a check valve, and combinations thereof.

13. The packaging system of claim 11, wherein the valve housing comprises a valve seat comprising a retaining ring, retaining clip, or flange.

14. The packaging system of claim 11, further comprising a diffuser connected to the valve housing.

15. The packaging system of claim 14 wherein the diffuser is connected to the valve housing with a snap fit.

16. The packaging system of claim 14, wherein the diffuser comprises two or more outlets.

* * * * *